US006160534A

United States Patent [19]

Katakura

[11] Patent Number: 6,160,534

[45] Date of Patent: Dec. 12, 2000

[54] LIQUID CRYSTAL DISPLAY DRIVE CIRCUIT AND LIQUID CRYSTAL DISPLAY

[75] Inventor: Masayuki Katakura, Kanagawa, Japan

[73] Assignee: Sony Corporation, Tokyo, Japan

[21] Appl. No.: 09/154,504

[22] Filed: Sep. 17, 1998

[30] Foreign Application Priority Data

Sep. 26, 1997 [JP] Japan ..... 9-261973
May 26, 1998 [JP] Japan ..... 10-144716

[51] Int. Cl.[7] ..... G09G 3/36

[52] U.S. Cl. ..... 345/98; 345/100

[58] Field of Search ..... 345/87, 90, 100, 345/204, 98, 92, 94, 96

[56] References Cited

U.S. PATENT DOCUMENTS 5,867,141 2/1999 Asada et al. ..... 345/100
5,995,072 11/1999 Nakajima ..... 345/87

*Primary Examiner*—Richard A. Hjerpe
*Assistant Examiner*—Kevin M. Nguyen
*Attorney, Agent, or Firm*—Ronald P. Kananen; Rader, Fishman & Grauer

[57] ABSTRACT

A liquid crystal display drive circuit capable of reducing deviation between channels and realizing a liquid crystal display of a high image quality without requiring an adjustment step on a manufacturing line. A reference signal is inserted into image data and provision is made of amplifiers for processing input image data to periodically invert and supplying the same to a plurality of channels; a switch circuit; a subtraction circuit for comparing an output of a first amplifier and an output signal in a case of a non-inverted output and comparing an output of a second amplifier and the output signal in a case of an inverted output; a gate circuit for extracting only the reference signal from among output signals of the subtraction circuit and generating offset correction signals corresponding to a non-inverted mode and an inverted mode; switch circuits; integrated circuits; and an adder circuit for adding the offset correction signals corresponding to the non-inverted mode and the inverted mode to the output signal of a sample-and-hold circuit and outputting the same to the liquid crystal display panel.

60 Claims, 30 Drawing Sheets

30C
CH-n OUTPUT
Vy
AMP3n
CHn
54
VOadj
56
VGadj
57
GCA
55
S53
S52
33-n
SH1-3
SP3
53
INTEGRATION CIRCUIT 2
INTEGRATION CIRCUIT 1
52
32-n
SH1-2
SP2-n
I-SW52
G-SW51
GT
31-n
SH1-1
SP1-n
51
TO CH(n+1)
TO CH(n-1)
Vx
P-SW41
S41
POL
40
R42
VINV
AMP42
AMP41
R41
SIM
IMAGE SIGNAL
SP3
SP2-n
SP2-p
SP2-1
SP1-p
SP1-n
SP1-2
SP1-1
TIMING SIGNAL GENERATION CIRCUIT
LCLK
(LINE CLOCK)
PCLK
(PIXEL CLOCK)

30E
CHn
CH-n OUTPUT
AMP3n
R52
R51
VINV
54
POL
S53
S52
INTEGRATION CIRCUIT 2
INTEGRATION CIRCUIT 1
I-SW52
O-SW53
53
52
SH1-3
SH1-2
SH1-1
33-n
32-n
31-n
SP3
SP2-n
SP1-n
G-SW51
51
GT2
TO CH(n+1)
TO CH(n-1)
41A
40B
P-SW41
P-SW42
AMP42a
AMP41a
AMP41b
AMP42b
R42
R44
R43
R41
R48
R47
R46
R45
GT1
G-SW43
IMAGE SIGNAL SIM1
VINV
REFERENCE SIGNAL SREF

IMD
IMAGE DATA
(DIGITAL)
PCLK
(PIXEL CLOCK)
LCLK
(LINE CLOCK)
20b
21-1
22-1
LATCH-1
DAC-1
LATCH-2
DAC-2
21-2
22-2
INPUT 1
INPUT 2
12
DATA LINE SWITCH DRIVE CIRCUIT
DQ1
DQ2
DQ3
DQ4
DQ3
DQ4
DQ7
DQm
PXC11
PXC1m
PXCnm
GL1
GL2
GL3
GL4
GL5
GLn
DL1
DL2
DL3
DL4
DL5
DL6
DL7
DLm
GATE
LINE
DRIVE
CIRCUIT
(SHIFT
REGISTER)
11
10b
PCLK
(PIXEL CLOCK)
LCLK
(LINE CLOCK)
VSYNC(VERTICAL
SYNCHRONIZATION)

FIG.32
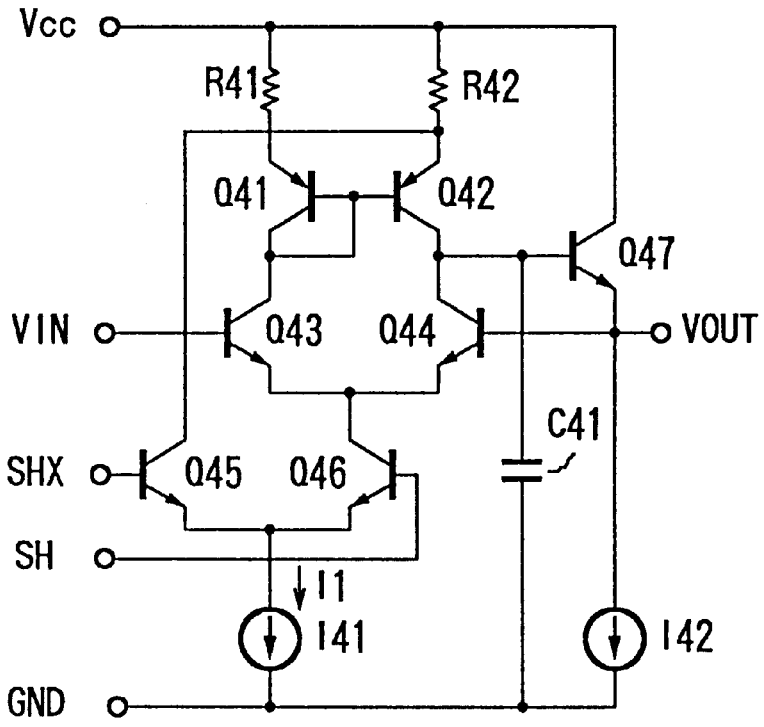
FIG.33A
FIG.33B
FIG.33C
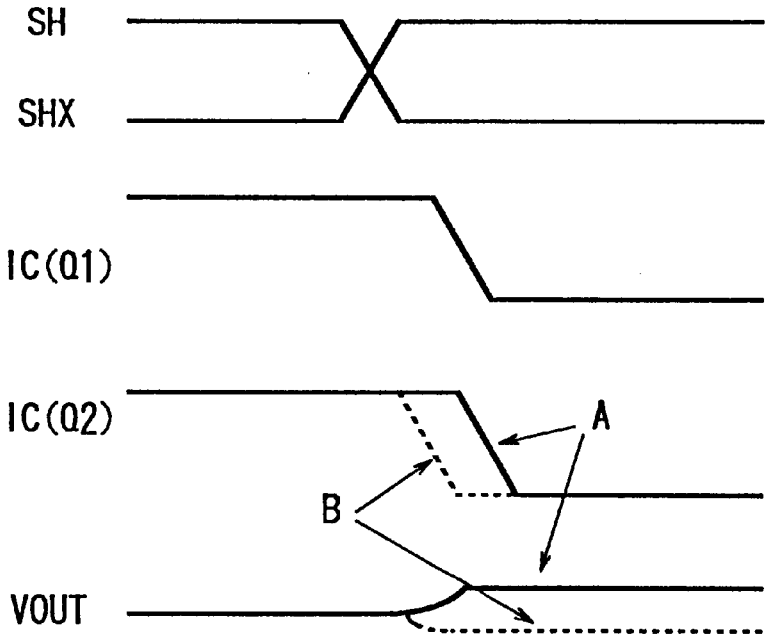

LIQUID CRYSTAL DISPLAY DRIVE CIRCUIT AND LIQUID CRYSTAL DISPLAY

BACKGROUND OF THE INVENTION

1. Field of the Invention

The present invention relates to a drive circuit of a liquid crystal display (LCD), more particularly relates to a circuit for correcting deviation among channels, and to a liquid crystal display including such a drive circuit.

2. Description of the Related Art

In recent years, rapid advances have been made in display panels using a liquid crystal as a display.

This display panel is widely used for viewfinders and liquid crystal display panels of video camcoders, televisions for automobiles, display panels of navigation systems, and displays of notebook type personal computers etc.

Further, recently, television receivers of a rear projection type using liquid crystal panels, projectors for projecting a screen of a personal computer directly on a large screen without using an overhead projector, etc. have been spreading in use.

Further, there is also a movement for replacing the displays of desk top type personal computers conventionally using cathode ray tubes (CRTs) with liquid crystal panels so as to return desk space to the users and save on consumption of electric power.

Behind all of this has been the rise of the degree of precision and the improvement of the image quality (full color, high contrast, wide vision, compatibility with moving pictures, etc.) of the liquid crystal panels and the improvements in the peripheral technology (drive circuits, element technology, backlighting, and so on).

Thanks to the overall improvements in these technologies, liquid crystal display panels are now being used in a wide field of application.

In this regard, however, while the image quality of the newest display panels is becoming close to that of CRT displays, there are still a large number of areas requiring improvement.

As one of these, the drive circuit of the liquid crystal panel can be mentioned.

The drive circuit of a high precision and high image quality liquid crystal display panel is extremely large in size, requires a large number of chips, and requires high precision circuits. The required displayed image quality has therefore become one of the major factors preventing the display panels from being reduced in cost.

Below, problems in the drive circuits of liquid crystal display panels of the related art will be explained in detail using concrete examples.

Many types of liquid crystal elements exist. The panels enabling display of full colors and moving pictures are almost all of the so-called "thin film transistor" (TFT) type where thin film transistors are arranged at the individual liquid crystal elements constituting the pixels.

The circuit configuration of a cell forming a pixel of such a thin film transistor type liquid crystal display panel is shown in FIG. 19.

One end of an individual liquid crystal cell CC of a pixel of a thin film transistor type liquid crystal display panel is connected to a counter electrode EL as shown in FIG. 19. All of the cells of all of the pixels are commonly connected to this counter electrode EL. The other end is connected to a thin film transistor provided for each cell.

The thin film transistor is used as a switch, therefore, while there is inherently no distinction between the source and drain, for convenience's sake, here it is assumed that the source is connected to the liquid crystal cell CC. A gate of the thin film transistor is connected to a gate drive line GL. A line for writing pixel data is selected by a drive signal thereof. Further, the drain is connected to a data drive line DL to which is supplied the pixel data to be written into the individual liquid crystal cells of the selected line.

When the write operation to the selected line is ended, the thin film transistors of the line are turned off, but the voltage of the pixel data is held until the next write operation is carried out due to the capacitance of the liquid crystal cells CC and thin film transistors.

The configuration of the pixel cell of the thin film transistor type liquid crystal display panel shown in FIG. 19 is common to all panels.

On the other hand, there are several types of structures and methods of production of thin film transistors, methods of driving the counter electrodes, and methods of driving the pixel data. These will be organized and the overall situation and peripheral structures will be explained below.

The structures and processes for production of thin film transistors may be roughly classified into methods using amorphous silicon and methods using polycrystalline silicon.

The former do not require any high temperature process, so a large size panel using glass as a substrate is easily formed.

The latter involve a high temperature process, so require a quartz substrate and therefore have been limited to use for small sized panels heretofore. Recently, due to the advances in the technology of a laser annealing etc., the technology has been developed for forming polycrystalline silicon thin film transistors at a low temperature and it has become possible to manufacture medium sized panels of the polycrystalline silicon thin film transistor type.

The degree of mobility of the carriers in a polycrystalline silicon thin film transistor is larger than that in an amorphous silicon thin film transistor by about one order of magnitude. Accordingly, in the case of an amorphous thin film transistor, the ON resistance thereof is high, so a considerably long write time had to be taken.

Contrary to this, in the case of a polycrystalline silicon thin film transistor, the write time may be made considerably short. This results in a large difference in the configuration of the drive circuit of the gate.

FIG. 20 is a view of the system configuration of a liquid crystal display, showing also a drive circuit, in an amorphous thin film transistor type liquid crystal display panel.

In FIG. 20, reference numeral 10 denotes the liquid crystal display panel, and 20 an image data drive circuit.

In the liquid crystal display panel 10, m and n number of pixel cells PXC comprised of the liquid crystal cells and thin film transistors are arranged in a horizontal direction and a vertical direction. Terminals S and G of the pixel cells PXC are data drive signal terminals and gate drive signal terminals, respectively.

The pixel cells PXC arranged along the same horizontal direction line are connected to common gate drive lines GL1 to GLn, while these gate drive lines GL1 to GLn are connected to a gate line drive circuit 11. Further, the pixel cells PXC arranged along the same vertical direction column are connected to common data drive lines DL1 to DLm, while these data drive lines DL1 to DLm are connected to the image data drive circuit 20 via the pixel data drive terminal.

The gate line drive circuit 11 is basically constituted by a shift register and generates a line selection signal by a vertical synchronization signal VSYNC and a line clock LCLK.

Further, the image data drive circuit 20 comprises m number of latches 21-1 to 21-m and digital-to-analog converters (DACs) 22-1 to 22-m. The output of each is connected to the pixel data drive terminal of each column. The latches 21-1 to 21-m and the digital-to-analog converters 22-1 to 22-m convert the digital image data IMD supplied as serial data to one line's worth of parallel analog signals.

By such a configuration, in a period of a certain line of the pixel data (video signal) IMD, a predetermined line is selected by the gate line drive circuit and one line's worth of m number of pixel data is supplied in parallel to the pixel data drive terminals, whereby the pixel data is written into the pixels.

As the write time, substantially one line's worth of time, typically 10 to several tens of $\mu$s, can be used. This makes it possible to ensure a sufficient write time even in an amorphous thin film transistor type liquid crystal display having a large ON resistance.

FIG. 21 is a view of another example of the configuration of the image data drive circuit.

This image data drive circuit 20*a* converts one line's worth of pixel data to parallel analog signals by sample-and-hold (SH) circuits 23-1 to 23-m and 24-1 to 24-m. In this case, the image data is supplied as analog signals. In order to convert serial signals to a parallel format, as shown in FIG. 21, two sample-and-hold circuits are necessary for each data line.

In an actual liquid crystal display panel, the number of pixels of one line, that is, the number m of the data lines DL, is equal to 640 in for example a VGA specification panel.

Recently, panels of larger numbers of pixels have become demanded. A greater number of pixels per line such as m=800 in the SVGA specification, m=1124 in the XGA specification, and m=1280 in the SXGA specification is now being required. Further, in the case of color displays, three times these numbers of pixels become necessary.

In this way, recent color liquid crystal display panels require image data drive circuits comprised of about 3000 channels of latches and digital-to-analog converters or sample and hole circuits (6000 circuits when counting sample-and-hold circuit elements). This in turn requires a large number of integrated circuits (ICs) with large numbers of pins and technology for forming the as many as 3000 interconnections between these integrated circuits and the liquid crystal panel. Further, to obtain a high image quality, it is necessary to ensure that these image data drive circuits all feature substantially the same characteristics.

Contrary to this, since a polycrystalline silicon thin film transistor has a small ON resistance, the write time can be greatly shortened.

For example, in a panel having a small number of pixels such as for a viewfinder of a video camcoder, as shown in FIG. 22, it is possible to construct almost all of the circuits on the liquid crystal display panel.

The liquid crystal display panel 10*a* shown in FIG. 22 sequentially selects data line switches DQ1 to DQm by a data line switch drive circuit 12 and fetches the image data into the data drive lines DL1 to DLm.

It is sufficient so far as the circuit for supplying the image data samples and holds the analog data and drives the liquid crystal panel by a signal in a form of a step wave. Since the thin film transistors of a large number of data line switches are connected to an input terminal of the image data of the liquid crystal panel, the input capacitance thereof is considerably large, so the circuit must be able to drive a large capacitance.

This type of configuration is only possible in panels of about 200,000 pixels in which several hundreds of ns are allocated to an ON time of the data line switches.

In a liquid crystal panel of the VGA specification having about twice this number of pixels and of the SVGA, XGA, and SXGA specifications having further larger numbers of pixels, even with polycrystalline silicon thin film transistors having a small ON resistance, the time allocated to the data line is too short and it is not possible to write signals into the data drive line by this method.

In this way, in a polycrystalline silicon thin film transistor type liquid crystal display panel having more than a certain number of pixels, the required write time is secured by not one input of image data, but by dividing the input into p number of channels.

As the number p of channels, 2, 3, 4, 6, 12, 24, etc. is used according to the number of pixels.

FIG. 23 is a view of the system configuration of a liquid crystal display including a liquid crystal display panel in the case where the input is divided into 2 channels.

In this liquid crystal display, the input to the liquid crystal display panel 10*b* is divided into an input 1 and an input 2, and the data is input in parallel. For this reason, two thin film transistors each of the data line switch are driven together such as DQ1/DQ2, DQ3/DQ4, and DQm−1/DQm.

This configuration corresponds to the configuration of FIG. 20 of the amorphous thin film transistor type liquid crystal display panel. Here, the image data is input as a digital signal.

Where the image data is supplied as an analog signal, as shown in FIG. 24, an image data drive circuit 20*c* may be constituted by a sample-and-hold circuit.

This configuration corresponds to the configuration of FIG. 21 of the amorphous thin film transistor type liquid crystal display panel. The sample-and-hold circuits 23-1, 24-1, and 25-1 and 23-2, 24-2, and 25-2 are constituted by three-stage cascade connections.

The reason why the three-stage configuration is adopted is that at least three stages are necessary in order to convert serial signals to p number of channels of parallel signals and output the same at the same timing and further to prevent the cascade connected sample-and-hold circuits in the channels from simultaneously entering into the sample mode.

If the sample-and-hold circuits were to operate ideally, in principle two stages would be sufficient, but in order to simultaneously output all channels, in at least one channel among the p number of channels, the initial stage sample-and-hold circuit and the next stage sample-and-hold circuit must simultaneously enter into the sample mode. Entry of vertical stripes into the displayed image as a result of a minute differences in characteristics between that channel and another channel due to this is therefore prevented.

The reason why there is no problem if there are two or more stages in the amorphous thin film transistor type liquid crystal display panel shown in FIG. 21 is that there is a blanking period between lines of the image data for convert one line's worth of signals to parallel signals, so a simultaneous sample mode can be avoided even with just two sample-and-hold circuits.

In this way, a polycrystalline silicon thin film transistor type liquid crystal display panel is characterized in that the image data drive circuit is greatly simplified in comparison with an amorphous thin film transistor type liquid crystal display panel.

Next, an explanation will be made of the fact that the applied voltage must be periodically inverted so as to drive the liquid crystal elements.

The optical characteristic of a liquid crystal element is determined by the absolute value of the applied voltage as shown in FIG. 25 and does not depend upon the polarity.

On the other hand, application of an electrical field in the same direction means that liquid crystal molecules are continuously twisted in the same direction. This becomes a cause of deterioration and image persistence. For this reason, the general practice is to invert the direction of the electrical field every predetermined period. The methods thereof may be roughly classified into the following two types.

A first method will be explained in relation to FIG. 26.

In this example, the voltage (counter electrode signal) VCOM of the counter electrode common to all cells of the liquid crystal elements is fixed to for example 7V. Signals supplied to the liquid crystal elements are inverted in a period A and a period B with the counter electrode signal VCOM as the axis of symmetry.

This inversion is carried out for example for every line, but the signals applied to the individual liquid crystal cells are inverted for every frame.

Next, a second method will be explained in relation to FIG. 27.

In this method, the counter electrode signal VCOM is also changed in the period A and the period B. The optical characteristic of a liquid crystal element is determined by a relative relationship of the drive signal to the counter electrode and the cell, therefore, FIG. 27 and FIG. 26 are equivalent for a liquid crystal element.

In this method, a new function of driving the counter electrode becomes necessary, but the amplitude of the video data when including the inversion operation becomes a half or less. Accordingly, this is convenient for realizing a lowering of voltage and lowering of power consumption of a video data drive circuit.

Above, a general explanation was given of the configuration of the thin film transistor type liquid crystal display and the drive method for the same. Next, an explanation will be given of the problem of deviation in characteristics in the image data drive circuit according to the present invention.

The number of channels of a image data drive circuit is from several hundreds to 1000 channels or more in the case of the amorphous thin film transistor type and about 2 to 12 channels in the case of the polycrystalline silicon thin film transistor type except for simple panels having small numbers of pixels.

In the case of color, further, three sets of these are necessary. When the characteristics of these channels are not well matched, a phenomenon occurs where only pixels of a certain column will be a little darker or brighter than those of other columns and vertical stripes will start to be observed. For this reason, the maximum deviation of channels, while depending also on the characteristics of the liquid crystal elements, is about ±10 mV. With this, the deviation is almost never able to be visually detected.

This is because, in the optical characteristic of the liquid crystal element shown in FIG. 25, when a tangent is drawn in an area in which the applied voltage and the transmission rate are linear, a dynamic range thereof is only about 1 to 2V. When considering that a detection limit of vertical stripes is about 1%, the dynamic range is about ±10 mV.

When the resolution of color is about 16 colors (4 bits) or 256 colors (8 bits), this problem is not that serious since the object of use is generally the display of text and graphic information.

However, recent display panels are provided with a display capability of 32,000 colors (15 bits), 260,000 colors (18 bits). and so-called "full color" 16,000,000 colors (24 bits) and therefore can display video information. Accordingly, very strict specifications are now being set for the deterioration of the image quality due to vertical stripes etc.

FIG. 28 is a view for explaining an input/output characteristic due to error. FIG. 28 assumes a case where a liquid crystal element is driven by 2 to 12V corresponding to the characteristic of FIG. 26.

In FIG. 28, a straight line indicated by <1> indicates the relationship of Vout=Vin in the specification.

A straight line indicated by <2> indicates an offset error. If there is only offset error, the allowable offset voltage is ±10 mV.

A straight line indicated by <3> indicates a gain error with which the error becomes zero when Vin=0. The precision of the gain required for guaranteeing an error of ±10 mV when Vin=12V is ±0.83%.

A straight line indicated by <4> indicates a gain error where adjustment is made so that the error becomes zero at the center (7V) of a required voltage range (2 to 12V). The precision of the gain required in this case is ±0.2%.

In this way, matching of characteristics among channels required for an image data drive circuit requires very strict specifications for both of the offset error and gain error.

An image data drive circuit is usually required to have the functions of a sample-and-hold circuit or digital-to-analog converter, an amplification circuit, and a buffer circuit.

First, for an overview, consider for example the circuit shown in FIG. 29. The transmission characteristic of this circuit is given by the following equation. Voff is an input conversion offset voltage of an operational amplifier AMP.

$$Vo=(1+R2/R1)\cdot(Vi+Voff) \quad (1)$$

The error of the transmission characteristic of this circuit is determined by the input conversion offset voltage Voff and a relative difference of the resistance values of R1 and R2. In the case of a required specification of 10 mV, an offset voltage of the operational amplifier AMP sufficiently smaller than this can be realized if the device constituting the operational element is a bipolar type transistor.

In the case of a metal oxide semiconductor (MOS) type transistor, it is considerably difficult to hold the offset voltage sufficiently smaller than 10 mV.

As the relative precision of the resistance value, about ±1% can be guaranteed by suitably designing the pattern structure, but it is difficult to greatly exceed this.

Further, in a sample-and-hold circuit, the higher the operating speed, the easier offset occurs. This is because, for the high speed operation, the held capacitance value becomes small. Due to a parasitic capacitance etc. of the switching element, transfer of excess charges appears as the offset voltage at the time of a switching operation.

Next, an explanation will be given of a more concrete example of the related art for suppressing this deviation in characteristics among channels.

FIG. 30 is a view of a basic circuit of a complementary metal oxide semiconductor (CMOS) type digital-to-analog converter used in the image data drive circuit of an amorphous thin film transistor type liquid crystal display panel. In FIG. 30, an example of 8 bits is shown.

In this circuit, the minimum voltage Vmin and the maximum voltage Vmax are supplied from the outside, and 256 types of voltages with equipotential difference are generated by the resistors R1 to R255.

Only one transistor is selected from among the switch transistors Q1 to Q256 by a signal decoded from the fetched 8 bits of data. The voltage thereof is taken out at the digital-to-analog converter output.

In this circuit, since the MOS transistor is used just as a switch, if the voltage generated by resistance division is correct, no offset will be generated elsewhere. In order to avoid influence from the error of the resistor train, taps are provided in the middle of the resistor train.

In FIG. 30, taps Vc1 to Vcn are provided at 4 LSB intervals. By connecting the taps of the resistor trains of all circuits in parallel, the voltages of all circuits are forcibly made the same. By reducing the relative characteristic difference among circuits, a required inter-channel deviation is realized.

As apparent from the above explanation, in an amorphous thin film transistor type liquid crystal display panel, even in a VGA specification panel—the simplest for a display for a personal computer -, 1920 image data drive channels are necessary for a color panel.

One channel becomes one digital-to-analog converter based on the principle as shown in FIG. 30. About 200 to 300 of such digital-to-analog converters are integrated on one IC chip. Several of such ICs are therefore used to construct the image data drive circuit required for a display.

There are very few examples of actual use of an analog input amorphous thin film transistor type liquid crystal display panel using a sample-and-hold circuit as shown in FIG. 21. Almost all panels are of the digital-to-analog converter system as shown in FIG. 20. This is because it is very difficult to suppress the difference in characteristics among channels and therefore difficult to obtain a high image quality.

Accordingly, rather than the analog system of the simple circuit configuration using sample-and-hold circuits, the digital system using digital-to-analog converters, which is easier to obtain performance from even if the size of the circuit becomes extremely large, has been the mainstream.

Next, an explanation will be given of a image data drive circuit of a polycrystalline silicon thin film transistor type liquid crystal display panel of the related art.

Polycrystalline silicon thin film transistor type liquid crystal display panels have become practical only relatively recently. Due in part to this, the circuitry is still not as well established compared with the amorphous thin film transistor type. Of the two, the analog system using sample-and-hold circuits has been used more often.

The number of pixel data drive channels in a polycrystalline silicon thin film transistor type is a very small 2 to 24 or so (three times this in the case of color), but a high speed operation is required.

For this reason, in the digital system using digital-to-analog converters shown in FIG. 23, video signal use digital-to-analog converters are used. It is however again very difficult to guarantee a difference of characteristics of less than ±10 mV between video signal use digital-to-analog converters. For this reason, adjustment of the offset and gain is required. This is possible since the number of data drive channels of the polycrystalline silicon thin film transistor type is small. In the amorphous thin film transistor type, adjustment of channels is not practical.

In the analog system using sample-and-hold circuits, for example, the following steps may be taken.

First, by the concept of FIG. 29, the circuits are constituted so that as much as possible all circuits operate as voltage followers.

This is because if R2/R1 is made 0 in the above equation (1), the difference in characteristic becomes only the offset voltage and is no longer dependent upon the resistance ratio.

Accordingly, the sample-and-hold circuits and the buffer circuits are basically constituted so as to become voltage followers.

Further, a circuit for periodically inverting the drive signal to the liquid crystal elements is arranged at a stage before the sample-and-hold circuits. This circuit has a function of inverting the polarity of the signal and shifting the DC level, therefore, it is almost impossible to hold the error among circuits to within ±10 mV.

Accordingly, if a single circuit is inserted in common for all image signals before the signals are converted to serial signals, it becomes unnecessary to consider variation among circuits.

FIG. 31 shows a concrete example of the configuration of an image data drive circuit 30 of a polycrystalline silicon thin film transistor type liquid crystal display panel.

In this circuit, an image signal SIM is input to an amplifier AMP41 and an inverting amplifier AMP42 constituting the voltage follower.

Further, the output thereof is switched by a signal POL from a timing signal generation circuit 40 by a switch SW41. The output thereof is supplied to the sample-and-hold circuits 31-1 to 31-6 of six channels.

Each channel is constituted by three sample-and-hold circuits 31-1 to 33-1, 31-2 to 33-2, 31-3 to 33-3, 31-4 to 33-4, 31-5 to 33-5, and 31-6 to 33-6.

Outputs of the sample-and-hold circuits 33-1 to 33-6 are buffered by amplifiers AMP31 to AMP36 constituting voltage followers. The outputs thereof drive the pixel data drive terminals of the liquid crystal display panel.

Note that the timing signal generation circuit 40 also generates sample pulses SP1-1 to SP1-6, SP2-1 to SP2-3, and SP3 of these sample-and-hold circuits 31-1 to 33-1, 31-2 to 33-2, 31-3 to 33-3, 31-4 to 33-4, 31-5 to 33-5, and 31-6 to 33-6.

By such a design, the difference in characteristics between channels is relatively reduced, but it was difficult to keep this to within ±10 mV. Particularly, it is difficult to realize a low offset voltage characteristic in high speed sample-and-hold circuits.

The reason for this will be explained below.

FIG. 32 is a circuit diagram of a concrete example of the configuration of a sample-and-hold circuit.

This circuit is the sample-and-hold circuit most generally used in a bipolar type IC and is constituted by npn type transistors Q41 to Q47, resistors R41 and R42, a capacitor C41, and current sources I41 and I42.

SH and SHX indicate differential signals for switching the sample operation and the hold operation. When the signal SH is at "H (high level)" and the signal SHX is at "L (low level)", the mode is the sample mode, a current I1 flows through the transistor Q46, the transistors Q41 to Q44 and Q47 operate a s voltage followers, and the input VIN is transmitted to the output VOUT as it is.

When the signal SH is at "L" and the signal SHX is at "H", the mode becomes the hold mode, the transistors Q41 and Q42 are turned off, and the capacitor C41 holds the voltage immediately before this to thereby perform the hold operation. This circuit operates very Ideally in the case of a low speed sample-and-hold operation.

However, if it is intended to make this operate exceeding several tens of MHz or 100 MHz, the characteristic of the offset voltage etc. is deteriorated.

This is because, the current I1 and a capacitance C of the capacitor C41 determine the through rate of the circuit, so in order to obtain a high speed through rate, it is necessary to make the current I1 as large as possible and make the capacitance C as small as possible.

However, when considering the instant of shift from the sample operation to the hold operation, when turning off the transistor Q46, the transistors Q43 and Q44 almost simultaneously turn off. This is because they operate under substantially the same conditions.

However, the transistors Q41 and Q42 are turned off slightly later due to the effect of the parasitic capacitance etc. As a result, the transistor Q42 turns off later than the transistor Q44. For this reason, an excess charge accumulates in the capacitor C41 from the transistor Q42 and a voltage higher than the inherent output is held.

In order to prevent this from affecting the system, the collector current of the transistor Q45 is used at the time of the hold mode to forcibly lower the emitter voltage of the transistor Q42. The collector current of the transistor Q45 starts to flow slightly earlier than the turning off of the collector current of the transistor Q44. Accordingly, depending on the setting, the transistor Q42 sometimes turns off earlier than the turning off of the transistor Q44.

FIG. 33 is a view explaining the deviation of the held output from the inherent value due to the timing when the transistors Q41 and Q42 are turned off.

This deviation is shorter than one nanosecond (ns) when a device of a cutoff frequency of for example several GHz is used.

However, in the case of a high speed sample-and-hold circuit, the capacitance C must also be lowered to for example about 100 to 300 fF. In such a case, such a slight time difference becomes an offset voltage of several mV or several tens of mV.

Further, the time when the transistors Q42 and Q44 turn off depends upon the difference in characteristics between the npn transistor Q44 and the pnp transistor Q42.

In a usual bipolar IC device, the highest priority is given to the characteristic of the npn transistor. In a so-called "lateral direction pnp" pnp transistor structure, the cutoff frequency is sometimes more than two orders of magnitude lower than that of an npn transistor.

Further, as an option for improving the characteristic of the pnp transistors, there is a bipolar IC device having a vertical direction pnp transistor structure, but in such a device as well, the characteristic of the pnp transistor is generally inferior to the characteristic of the npn transistor.

Accordingly, precise control of the timing of turning off the transistors Q42 and Q44 is very difficult from the viewpoint of the manufacture of the device as well.

Further, if using a device having a high cutoff frequency in order to realize a high speed sample-and-hold characteristic, the "early" voltage determining the output resistance of the transistor is lowered, the inherent gain falls slightly due to the voltage follower, or a yield voltage at the time of an inverse bias between the base and the emitter falls. Accordingly, signals having a large amplitude cannot be handled, and therefore an amplification stage becomes necessary at a stage after the sample-and-hold circuits, the precision of the gain thereof becomes a problem, etc., so the problem arises that it becomes very difficult to suppress the deviation of characteristics among channels as the speed becomes higher.

These problems become conspicuous particularly when the number p of channels is increased. In an image data drive circuit constituted on the same chip, however, matching is still relatively easy.

However, when the number of channels becomes 12 or 24, due to the restrictions of power consumption and the restrictions of the chip size, it becomes necessary to divide the chip into a plurality of chips. Then, it is necessary to consider the case where for example ICs of different manufacturing lots, ICs manufactured at different times, and in an extreme case ICs of different manufacturing lines are combined.

Under such conditions, it is very difficult to keep the deviation among channels small. In the case of a polycrystalline silicon thin film transistor type liquid crystal display panel, there have been many cases where an adjustment step must be inserted in the manufacturing line.

SUMMARY OF THE INVENTION

The present invention was made in consideration with such a circumstance and has as an object thereof to provide a liquid crystal display drive circuit capable of reducing the deviation among channels and capable of realizing a liquid crystal display of a high image quality without insertion of an adjustment step in the manufacturing line.

Another object of the present invention is to provide a liquid crystal display using such a drive circuit.

To attain the above first object, according to a first aspect of the present invention, there is provided a liquid crystal display drive circuit for converting image data supplied as serial signals into parallel signals of p number of channels, p being at least 2, and outputting the signals as the image data to the liquid crystal display panel to perform a simultaneous write operation, wherein a reference signal of a predetermined duration and of a voltage set between a white level and a black level is inserted in a blanking period of the image data and wherein provision is made of an inverting means for processing the input image data so as to periodically invert and supplying the same to the plurality of channels; a subtracting means for comparing a first reference voltage and a channel output signal when the output of the inverting means is non-inverted and comparing a second reference voltage and the channel output signal when it is inverted; an offset correction signal generating means for extracting only the reference signal from among output signals of the subtracting means and generating an offset correction signal corresponding to the non-inverted mode and the inverted mode based on the reference signal; and an adding means for adding the offset correction signals corresponding to the non-inverted mode and the inverted mode to the output signal of the inverting means and outputting the result as the channel output signal to the subtracting means and a liquid crystal display panel.

Further, in the first aspect of the present invention, preferably the offset correction signal generating means comprises a gate circuit for taking out a signal which gates a time position of the reference signal; a first integrating means for integrating the signal gating the time position of the reference signal from the gate circuit to generate the offset correction signal in a non-inverted period; and a second integrating means for integrating the signal gating the time position of the reference signal from the gate circuit to generate the offset correction signal in the inverted period.

Further, in the first aspect of the present invention, preferably each channel contains at least two cascade connected sample-and-hold circuits between the output of the inverting means and the adding means; the image data supplied as serial signals is an analog signal; and the first and second reference voltages are the signals passing through the inverting means at the point of supply to the channels in the non-inverted mode and inverted mode.

Further, in the first aspect of the present invention, preferably each channel contains a cascade-connected latch circuit and analog-to-digital converter between the output of the inverting means and the adding means; the image data supplied as serial signals is a digital signal; and the first and second reference voltages are levels respectively corresponding to the analog value of the voltage of the reference signal in the non-inverted mode and the inverted mode.

According to a second aspect of the invention, there is provided a liquid crystal display drive circuit for converting image data supplied as serial signals into parallel signals of p number of channels, p being at least 2, and outputting the signals as the image data to the liquid crystal display panel to perform a simultaneous write operation, wherein a reference signal of a predetermined duration and of a voltage set between a white level and a black level is inserted in a blanking period of the image data and wherein provision is made of an inverting means for processing the input image data so as to periodically invert and supplying the same to the plurality of channels; a subtracting means for comparing a first reference voltage and a channel output signal when the output of the inverting means is non-inverted and comparing a second reference voltage and the channel output signal when it is inverted; a gain controlling means for controlling a gain of the image data from the inverting means using a gain in accordance with a gain correction signal; a correction signal generating means for extracting only the reference signal from among output signals of the subtracting means, generating two correction signals respectively corresponding to the non-inverted mode and the inverted mode based on the reference signal, outputting a sum of the two correction signals as the offset correction signal, and outputting a difference of the two correction signals as the gain correction signal to the gain controlling means; and an offset subtracting means for subtracting the offset correction signal from the correction signal generating means from the output signal of the gain controlling means and outputting the result as the channel output signal to the subtracting means and the liquid crystal display panel.

Further, in the second aspect of the present invention, preferably the correction signal generating means comprises a gate circuit for taking out a signal which gates a time position of the reference signal; a first integrating means for integrating the signal gating the time position of the reference signal from the gate circuit to generate a first correction signal in a non-inverted period; a second integrating means for integrating the signal gating the time position of the reference signal from the gate circuit to generate a second correction signal in the inverted period; an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

Further, in the second aspect of the present invention, preferably each channel contains at least two cascade-connected sample-and-hold circuits between the output of the inverting means and the adding means; the image data supplied as serial signals is an analog signal; and the first and second reference voltages are the signals passing through the inverting means at the point of supply to the channels in the non-inverted mode and inverted mode.

Further, in the second aspect of the present invention, preferably each channel contains a cascade-connected latch circuit and analog-to-digital converter between the output of the inverting means and the adding means; the image data supplied as serial signals is a digital signal; and the first and second reference voltages are levels respectively corresponding to the analog value of the voltage of the reference signal in the non-inverted mode and the inverted mode.

Further, in the second aspect of the present invention, preferably each channel contains a cascade-connected latch circuit and analog-to-digital converter between the output of the inverting means and the adding means; the image data supplied as serial signals is a digital signal; and the analog-to-digital converter is a multiplication type analog-to-digital converter for adding the gain correction signal to the reference voltage for setting a full scale thereof.

According to a third aspect of the present invention, there is provided a liquid crystal display drive circuit for converting image data supplied as serial signals to parallel signals of p number of channels, p being at least 2, and outputting the signals as image data to a liquid crystal display panel to perform a simultaneous write operation, wherein provision is made of a reference signal inserting means for inserting a reference signal of a predetermined duration and of a voltage set between a white level and a black level in a predetermined period of the image data; a first inverting means for processing the image data in which the reference signal is inserted so as to periodically invert and supplying the same to the plurality of channels; a second inverting means for processing the reference signal so as to periodically invert and supplying the same to the plurality of channels; a subtracting means for subtracting the output of the second inverting means from the channel output signal; an offset correction signal generating means for extracting only a section into which the reference signal is inserted from the output signal of the subtracting means to generate offset correction signals corresponding to the non-inverted mode and the inverted mode based on the reference signal; and an adding means for adding the offset correction signals corresponding to the non-inverted mode and the inverted mode to the output signal of the inverting means and outputting the result as the channel output signal to the subtracting means and liquid crystal display panel.

Further, in the third aspect of the present invention, preferably further provision is made, at the output side of the adding means, of an output buffer which has a gain Ab exceeding 1, processes the output signal of the related adding means with the gain Ab, and outputs the result as the channel output signal; the first inverting means has a gain ±As; the second inverting means has a gain ±Ab, and a product of the gain ±As of the first inverting means and the gain ±Ab of the output buffer is set to become equal to the gain ±Ab of the second inverting means.

Further, in the third aspect of the present invention, preferably the offset correction signal generating means has a gate circuit for taking out a signal which gates a time position of the reference signal; a first integrating means for integrating the signal gating the time position of the reference signal from the gate circuit to generate the offset correction signal in a non-inverted period; and a second integrating means for integrating the signal gating the time position of the reference signal from the gate circuit to generate the offset correction signal in the inverted period.

Further, in the third aspect of the present invention, preferably each channel contains at least two cascade-connected sample-and-hold circuits between the output of the inverting means and the adding means; the image data supplied as serial signals is an analog signal; and the first and second reference voltages are signals passing through the inverting means at the point of supply to the channels in the non-inverted mode and inverted mode.

Further, according to a fourth aspect of the present invention, there is provided a liquid crystal display drive circuit for converting image data supplied as serial signals to parallel signals of p number of channels, p being at least 2, and outputting the signals as image data to a liquid crystal display panel to perform a simultaneous write operation, wherein provision is made of a reference signal inserting means for inserting a reference signal of a predetermined duration and of a voltage set between a white level and a black level in a predetermined period of the input image data; a first inverting means for processing the image data into which the reference signal is inserted so as to periodically invert and supplying the same to a plurality of channels; a second inverting means for processing the reference signal so as to periodically invert and supplying the same to the plurality of channels; a gain controlling means for controlling a gain of the image data from the inverting means with a gain in accordance with a gain correction signal; a subtracting means for subtracting the output of the second inverting means from the channel output signal; a correction signal generating means for extracting only a section into which the reference signal is inserted from the output signal of the subtracting means to generate two correction signals respectively corresponding to the non-inverted mode and the inverted mode based on the reference signal, outputting the sum of the two correction signals as the offset correction signal, and outputting the difference of the two correction signals as the gain correction signal to the gain controlling means; and an offset subtracting means for subtracting the offset correction signal from the correction signal generating means from the output signal of the gain controlling means and outputting the result as the channel output signal to the subtracting means and liquid crystal display panel.

Further, in the fourth aspect of the present invention, preferably further provision is made, at the output side of the adding means, of an output buffer which has a gain Ab exceeding 1, processes the output signal of the related adding means with the gain Ab, and outputs the result as the channel output signal; the first inverting means has a gain ±As; the second inverting means has a gain ±Ab; and a product of the gain ±As of the first inverting means and the gain ±Ab of the output buffer is set to become equal to the gain ±Ab of the second inverting means.

Further, in the fourth aspect of the present invention, preferably the correction signal generating means has a gate circuit for taking out a signal which gates the time position of the reference signal; a first integrating means for integrating the signal gating the time position of the reference signal from the gate circuit to generate a first correction signal in the non-inverted period; a second integrating means for integrating the signal gating the time position of the reference signal from the gate circuit to generate a second correction signal in the inverted period; an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

Further, in the fourth aspect of the present invention, preferably each channel contains at least two cascade-connected sample-and-hold circuits between the output of the inverting means and the adding means; the image data supplied as serial signals is an analog signal; and the first and second reference voltages are signals passing through the inverting means at the point of supply to the channel in the non-inverted mode and in the inverted mode.

In more detail, according to the first aspect of the present invention, the inverting means processes the input image data so as to be periodically inverted and supplies the result to a plurality of channels. Then, in each channel, the subtracting means compares the first reference voltage and the channel output signal in the non-inverted period and compares the second reference voltage and the channel output signal in the inverted period. It inputs a signal indicating the result of the comparison to the offset correction signal generating means, where only the reference signal is extracted. Then, this generates offset correction signals corresponding to the non-inverted mode and the inverted mode based on the reference signal and supplies the same to the adding means. The adding means adds the offset correction signals corresponding to the non-inverted mode and the inverted mode to the output signal of the inverting means, outputs the result as the channel output signal to the liquid crystal display panel, and feeds this back to the subtracting means.

According to the second aspect of the present invention, the inverting means processes the input image data so as to be periodically inverted and supplies the result to a plurality of channels. In each channel, the subtracting means compares the first reference voltage and the channel output signal in the non-inverted period and compares the second reference voltage and the channel output signal in the inverted period. It then inputs a signal indicating the result of this comparison to the correction signal generating means, where only the reference signal is extracted. Then, this generates offset correction signals corresponding to the none inverted mode and the inverted mode based on the reference signal, takes the sum of the two correction signals and outputs the result thereof as the offset correction signal to the offset subtracting means, and takes the difference of the two correction signals and outputs the result thereof as the gain control signal to the gain controlling means. The gain controlling means processes the input image data with a gain in accordance with a gain control signal and outputs the result to the offset subtracting means. Then, the offset subtracting means subtracts the offset correction signal from the correction signal generating means from the output signal of the gain controlling means, outputs the result to the liquid crystal display panel, and feeds this back to the subtracting means.

Further, according to the third aspect of the present invention, the reference signal inserting means inserts a reference signal in a predetermined period of the input image data and inputs the image data in which the reference signal is inserted to a first inverting means. The first inverting means processes the image data in which the reference signal is inserted so as to be periodically inverted and supplies the result to the plurality of channels. Further, the second inverting means processes the reference signal so as to be periodically inverted and supplies the same to the plurality of channels. Then, in each channel, the subtracting means subtracts the output of the second inverting means from the channel output signal and inputs the result to the offset correction signal generating means. The offset correction signal generating means extracts only the section in which the reference signal is inserted from the input signal. Then, it generates offset correction signals corresponding to the non-inverted mode and the inverted mode based on the reference signal and supplies the same to the adding means. The adding means adds the offset correction signals corresponding to the non-inverted mode and the inverted mode to the output signal of the inverting means, outputs the result as the channel output signal to the liquid crystal display panel, and feeds this back to the subtracting means.

Further, according to the fourth aspect of the present invention, the reference signal inserting means inserts a reference signal in a predetermined period of the input image data and inputs the image data in which the reference signal is inserted to a first inverting means. The first inverting means processes the image data in which the reference signal is inserted so as to be periodically inverted and supplies the same to the plurality of channels. Further, the second inverting means processes the reference signal so as to be periodically inverted and supplies the same to the plurality of channels. Then, in each channel, the subtracting means subtracts the output of the second inverting means from the channel output signal and inputs the result to the correction signal generating means. The correction signal generating means extracts only the section in which the reference signal is inserted from the input signal. Then, it generates two offset correction signals corresponding to the non-inverted mode and the inverted mode based on the reference signal, takes the sum of the two correction signals and outputs the result thereof as the offset correction signal to the offset subtracting means, and takes the same time, the difference of the two correction signals and outputs the result thereof as the gain control signal to the gain controlling means. The gain controlling means processes the input image data with a gain in accordance with a gain control signal and outputs the result to the offset subtracting means. Then, the offset subtracting means subtracts the offset correction signal from the correction signal generating means from the output signal of the gain controlling means, outputs the result to the liquid crystal display panel, and feeds this back to the subtracting means.

According to fifth to eighth aspects of the invention, there are provided liquid crystal displays containing the drive circuits of the above first to fourth aspects of the invention, respectively.

BRIEF DESCRIPTION OF THE DRAWINGS

These and other objects and features of the present invention will become apparent from the following description of the preferred embodiments given with reference to the attached drawings, in which:

FIG. 32 is a circuit diagram of a concrete example of the configuration of a sample-and-hold circuit; and FIGS. 33A to 33C are views for explaining a deviation of a held output from an original value of a timing of turning off of the transistors Q41 and Q42 of FIG. 32.

DESCRIPTION OF THE PREFERRED EMBODIMENTS

Figure 1:
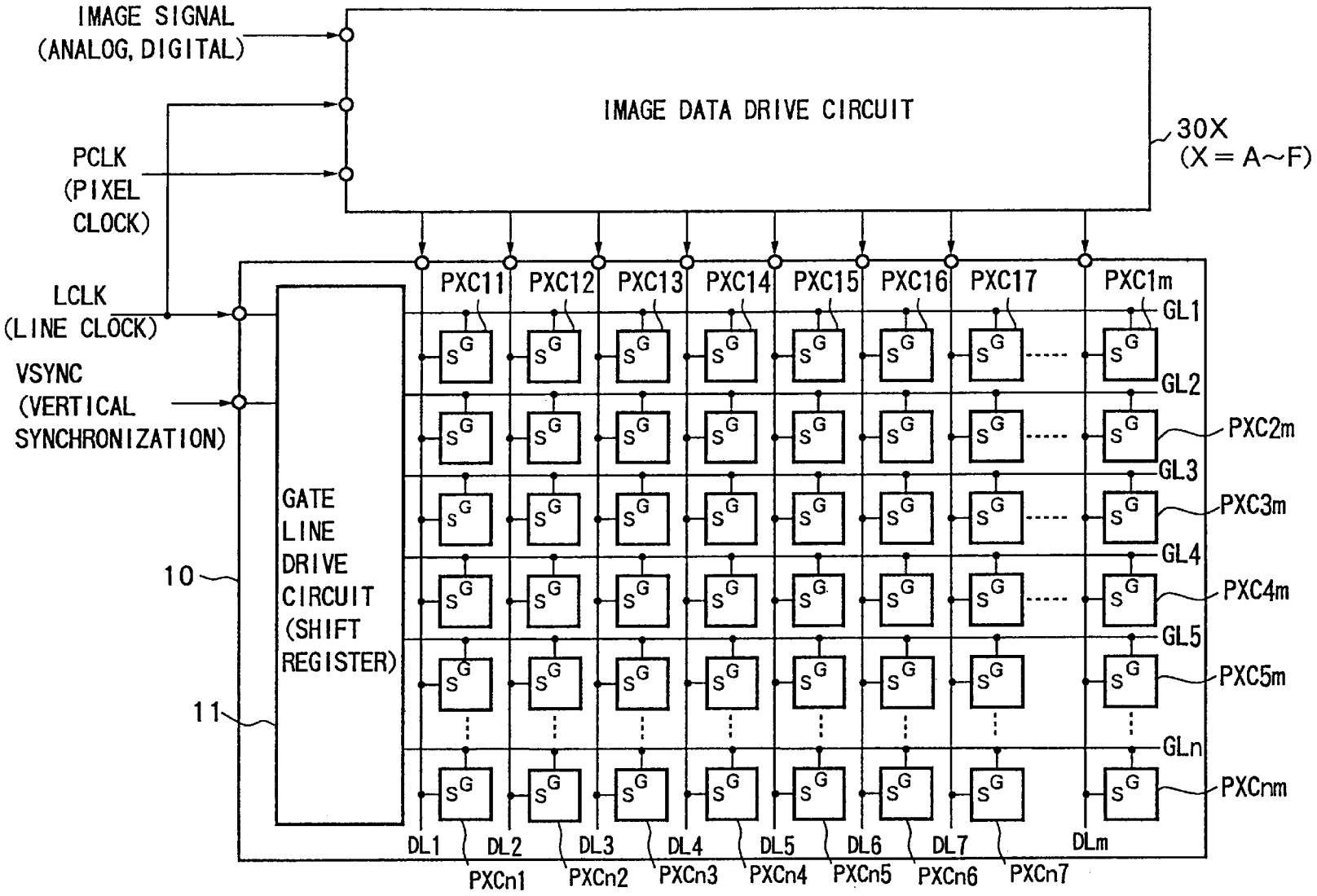
FIG. 1 is a view of an example of system configuration of a liquid crystal display according to the present invention.

FIG. 1 is a view of an example of the system configuration of a liquid crystal display adopting image data drive circuits indicated by 30A to 30F in FIG. 2, FIG. 4, FIG. 6, FIG. 10, FIG. 12 and FIG. 15 according to the present invention.

In FIG. 1, reference numeral 10 denoted the liquid crystal panel, and 30X an image data drive circuit.

Below, preferred embodiments of the image data drive circuit 30X will be described with reference to the accompanying drawings.

First Embodiment

Figure 2:
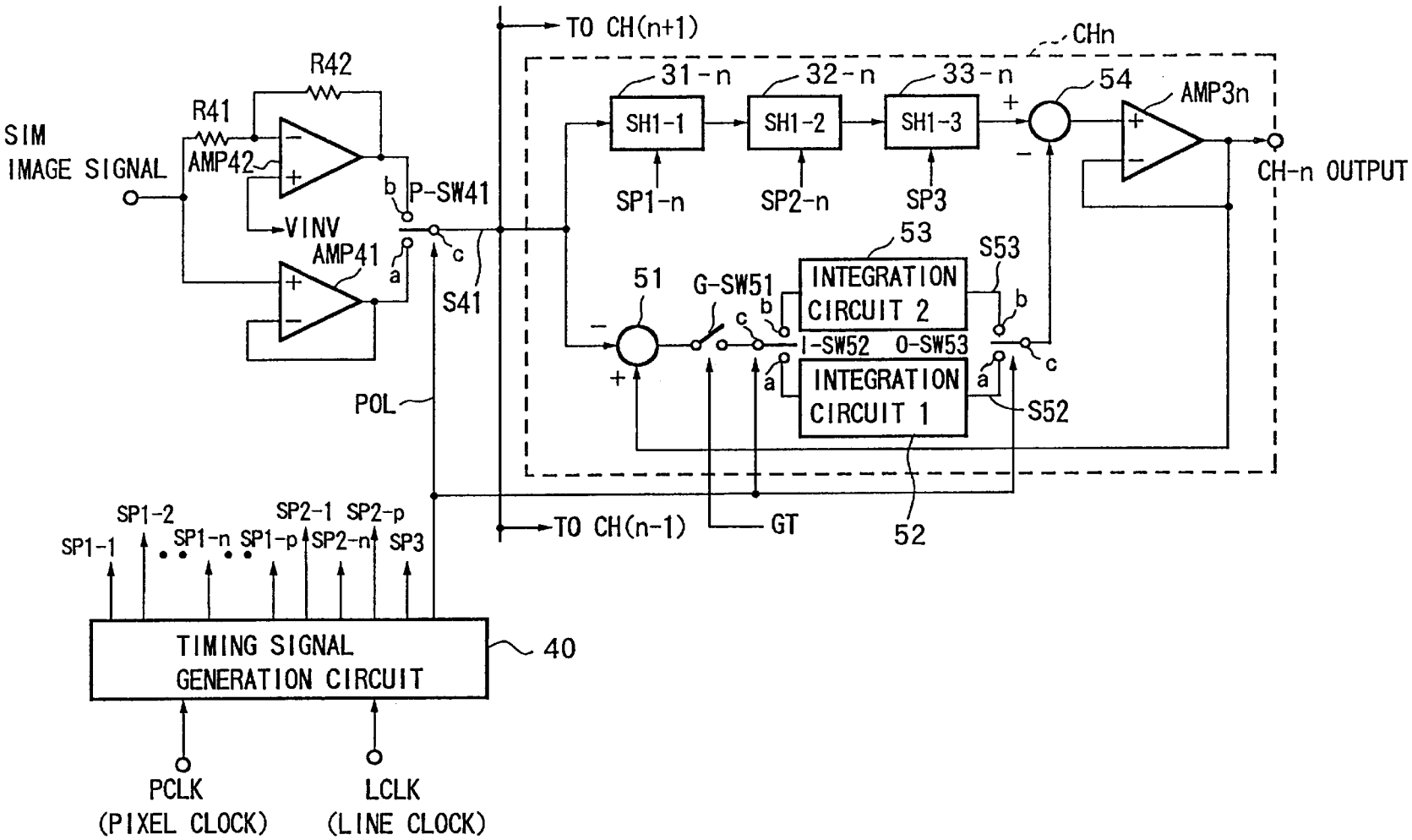
FIG. 2 is a view of the configuration of an image data drive circuit used for a polycrystalline silicon thin film transistor type liquid crystal display panel according to a first embodiment of the present invention and a view of the configuration of an image data drive circuit of an analog system using sample-and-hold circuits.

FIG. 2 is a view of the configuration of an image data drive circuit used for a polycrystalline silicon thin film transistor type liquid crystal display panel according to a first embodiment of the present invention and shows an image data drive circuit of an analog system using sample-and-hold circuits. In the figure, the same constituent parts as those in FIG. 31 indicating the related art are represented by the same reference symbols.

Figure 31:
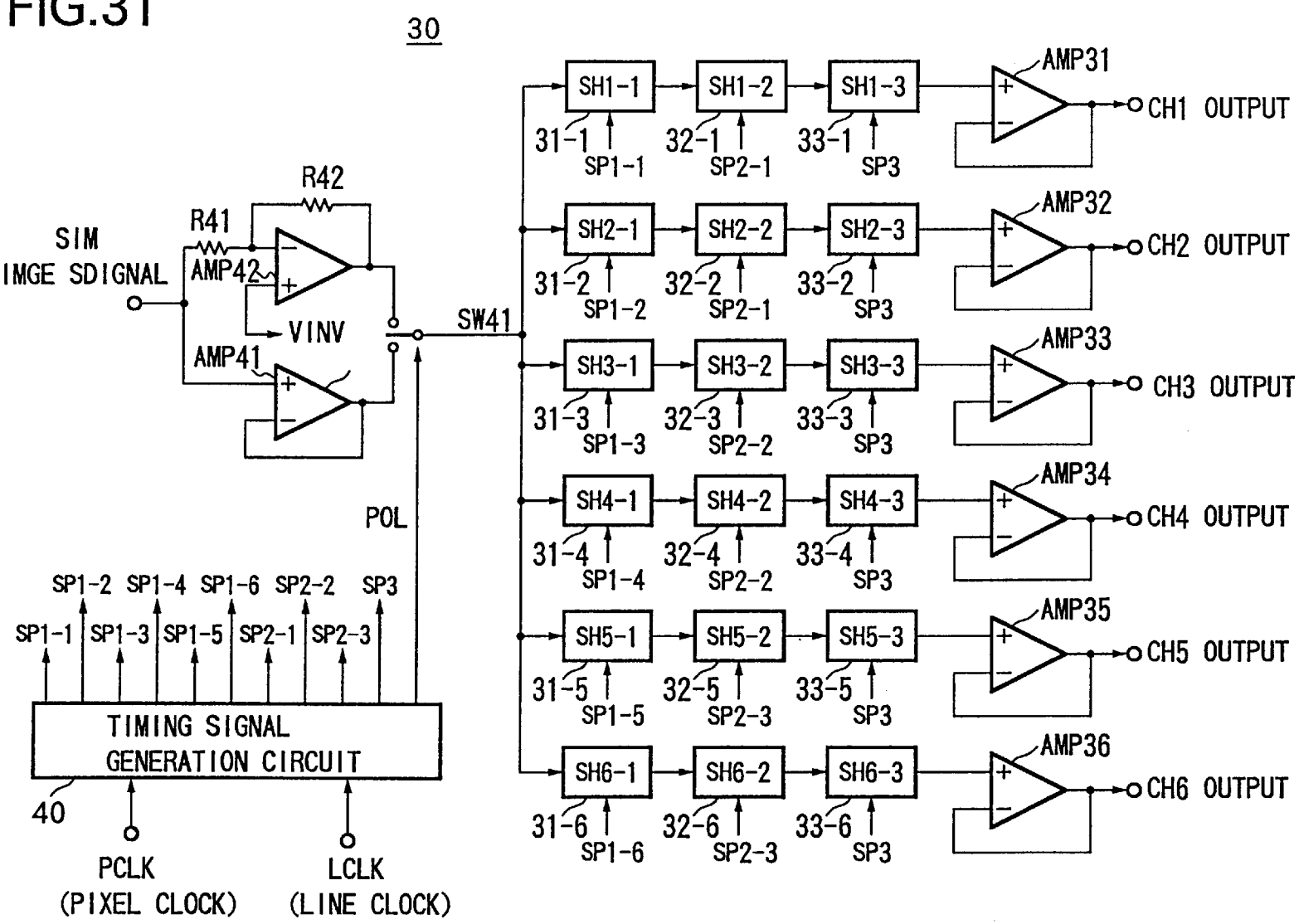
FIG. 31 is a view of a concrete example of the configuration of the image data drive circuit of a polycrystalline silicon thin film transistor type liquid crystal display panel.

Further, an image data drive circuit 30A of FIG. 2 exhibited all functions for obtaining parallel outputs of six channels in FIG. 31, but in FIG. 2, for simplification, only the drive circuit of one channel n surrounded by a dotted line is indicated.

This image data drive circuit 30A is constituted by, as shown in FIG. 2, sample-and-hold circuits 31-n, 32-n, and 33-n, a timing signal generation circuit 40, a subtraction circuit 51, integration circuits 52 and 53, an adder circuit 54, an amplifier AMP3n constituting a voltage follower, an amplifier AMP41 as a non-inverting circuit, an inverting amplifier AMP42, resistors R41 and R42, and switch circuits P-SW41, G-SW 51, I-SW52, and O-SW53.

Further, FIGS. 3A to 3D are views of signal waveforms of different portions of the circuit of FIG. 2.

Figures 3A, 3B, 3C, 3D:
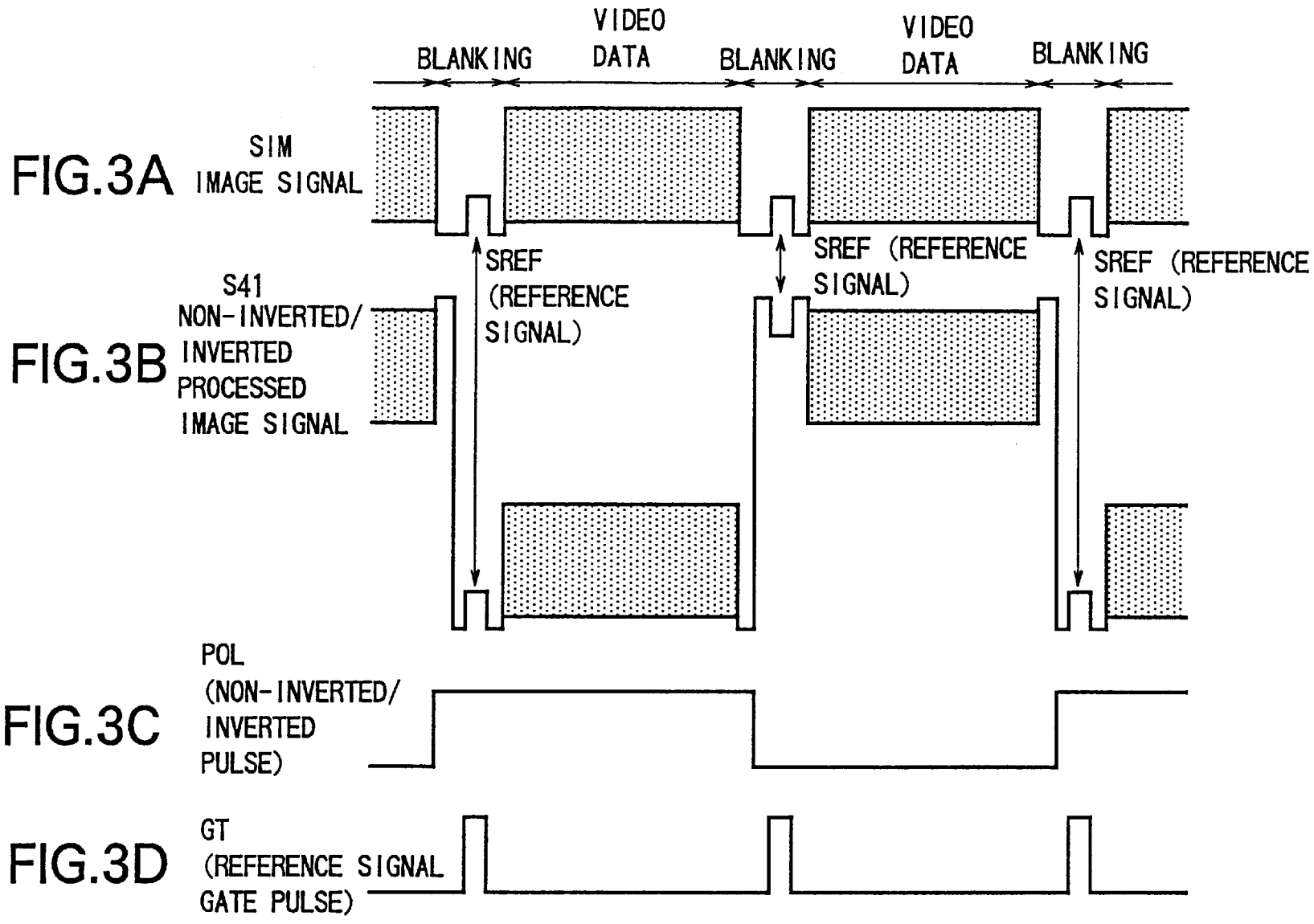
FIGS. 3A to 3D are views of signal waveforms of different portions of the circuit of FIG. 2.

In the first embodiment, an image signal SIM which is input, as shown in FIG. 3A, has inserted in it a reference signal SREF in a blanking period.

The reference signal SREF has a level which becomes the reference for cancelling offset and selected to be a level where the offset among channels is most easily detected visually as a stripe pattern. With a complete white or black level, offset is hard to be visually detected even if offset exists. A level which is somewhat dim and has a low degree of brightness is most easily visually detected, therefore such a level is inserted as the reference signal SREF.

The image signal SIM is input to a non-inverted input terminal (+) of the amplifier AMP41 and to an inverted input terminal (−) of the inverting amplifier AMP42 via the resistor R41.

The output terminal of the amplifier AMP41 is connected to the inverted input terminal (−) whereby a voltage follower is constituted. This output terminal is connected to an input terminal a of the switch circuit P-SW41. The amplifier AMP41 constituting this voltage follower outputs the input image signal SIM in the non-inverted mode as it is to the switch circuit P-SW41.

An inverted reference voltage VINV is supplied to the non-inverted input terminal (+) of the inverting amplifier AMP42, and the output terminal is connected to the inverted input terminal (−) via the resistor R42 and connected to an input terminal b of the switch circuit P-SW41.

The inverting amplifier AMP42 inverts the input image signal SIM and outputs the same to the switch circuit P-SW41.

The switch circuit P-SW41 connects the input terminal a to an output terminal c when receiving the non-inversion/inversion switch signal POL as shown in FIG. 3C generated at the timing signal generation circuit 40 at a high level, while connects the input terminal b to the output terminal c when receiving it at a low level.

Accordingly, the switch circuit P-SW41 supplies the non-inverted image signal S41 to the sample-and-hold circuit 31-n and subtraction circuit 51 of the initial stage of each channel when the non-inversion/inversion switch signal POL is at a high level, while supplies the inverted image signal S41 thereto when it is at a low level as shown in FIG. 3B.

In the channel n, the sample-and-hold circuits 31-n, 32-n, and 33-n are cascade-connected, and the output of the sample-and-hold circuit 33-n is input to the adder circuit 54.

Then, the output of the adder circuit 54 is buffered by the amplifier AMP3n constituting a voltage follower, and the output thereof drives the pixel data drive terminal of the liquid crystal display panel as the channel output signal and is fed back to the + input of the subtraction circuit 51.

The timing signal generation circuit 40 receives a pixel clock PCLK and a line clock LCLK, generates sample pulses SP1-n, SP2-n, and SP3 of the sample-and-hold circuits 31-n, 32-n, and 33-n, and generates the non-inversion/inversion switch signal POL for switch control of the switch circuits P-SW41, I-SW52, and O-SW53.

A switch timing of the non-inversion/inversion switch signal POL in the blanking period and away from the reference signal is selected.

The subtraction circuit 51 compares the image signal immediately after the non-inversion/inversion processing and the output signal of each channel and outputs the same to the gate switch circuit G-SW51.

The gate switch circuit G-SW51 extracts only the part of the reference signal SREF in synchronization with the time position of the reference signal SREF set at a certain voltage in the image data by the gate pulse signal GT from the outside as shown in FIG. 3D and outputs the same to the switch circuit I-SW52.

The switch circuit I-SW52 connects the input terminal c to the output terminal a connected to the input of the integration circuit 52 when receiving the non-inversion/inversion switch signal POL generated at the timing signal generation circuit 40 at a high level, while connects the input terminal c to the output terminal b connected to the input of the integration circuit 53 when receiving it at a low level.

Accordingly, the switch circuit I-SW52 inputs the non-inverted reference signal to the integration circuit 52 when the non-inversion/inversion switch signal POL is at a high level, while inputs the inverted reference signal to the integration circuit 53 when it is at a low level.

The switch circuit O-SW53 connects the input terminal a connected to the output of the integration circuit 52 to the output terminal c when receiving the non-inversion/inversion switch signal POL generated at the timing signal generation circuit 40 at a high level, while connects the input terminal b connected to the output of the integration circuit 53 to the output terminal c when receiving it at a low level.

Accordingly, the switch circuit O-SW53 inputs the output of the integration circuit 52 to the adder circuit 54 when the non-inversion/inversion switch signal POL is at a high level, while inputs the output of the integration circuit 53 to the adder circuit 54 when it is at a low level.

The integration circuit 52 integrates (averages) the reference signal extracted in the non-inverted period to generate an offset correction signal S52 in the non-inverted mode.

The integration circuit 53 integrates (averages) the reference signal extracted in the inverted period to generate an offset correction signal S53 in the inverted mode.

The adder circuit 54 adds the offset correction signal S52 or S53 to the output of the sample-and-hold circuit 33-n and inputs the result to the non-inverted input terminal (+) of the amplifier AMP3n.

Next, the operation by the above configuration will be explained.

First, non-inversion processing is carried out by the amplifier AMP41 with respect to the image signal SIM, and inversion processing is carried out at the inverting amplifier AMP42.

Then, the non-inverted image signal and inverted image signal obtained in the non-inversion processing and inversion processing are alternately supplied to the sample-and-hold circuit 31-n and subtraction circuit 51 of the initial stage of each channel in accordance with the supply level of the non-inversion/inversion switch signal POL generated at the timing signal generation circuit 40.

In the channel CHn, the non-inverted or inverted input image signal is subjected to the sampling and holding processing at the three sample-and-hold circuits 31-n, 32-n, and 33-n and output as the channel output signal by the amplifier AMP3n serving as the buffer via the adder circuit 54 for adding the offset correction signals.

Further, this output is fed back to the subtraction circuit 51.

In a channel CHn, in order to obtain the offset correction signal, first, the subtraction circuit 51 compares the non-inverted or inverted input image signal and the output signal of the channel.

From this compared signal, in synchronization with the gate pulse signal GT, only the part of the reference signal inserted in the image signal is extracted at the gate switch circuit G-SW51.

Note that, at this time, since the output is later than the input by several clocks due to the three sample-and-hold circuits, desirably a leading edge thereof is narrower than the reference signal by several clocks corresponding to the amount of delay.

The extracted reference signal is input to the integration circuit 52 in the non-inverted section via the switch circuits I-SW52 switched at the supply level of the non-inversion/inversion switch signal POL, while is input to the integration circuit 53 and integrated in the inverted section.

Between the outputs of the integration circuits 52 and 53, the output of the integration circuit 52 is fed back, via the switch circuit O-SW53 switched at the supply level of the non-inversion/inversion switch signal POL, to the adder circuit 54 as the offset correction signal S52 in the non-inverted mode, while the output of the integration circuit 53 is fed back to the adder circuit 54 as the offset correction signal S53 in the inverted mode.

Then, in the adder circuit 54, the offset correction signal is added to the output of the sample-and-hold circuit 33-n, and the channel output is obtained via the amplifier AMP3n serving as the buffer.

Namely, in each reference signal period in the non-inverted mode and inverted mode, offset correction signals S52 and S53 generated at the integration circuits 52 and 53 are added to the image signal so that the offset voltage between the input and output of the image data drive circuit becomes zero and the inter-channel deviation is suppressed to a minimum.

As explained above, according to the first embodiment, since the reference signal is inserted into the image signal, independent offset correction voltages are generated in the non-inverted mode and the inverted mode of the pixel drive waveform, and the offset of the pixel drive waveform is corrected, the inter-channel deviation can be reduced and a liquid crystal display of a high image quality can be realized without an adjustment step in the manufacturing line.

Second Embodiment

Figure 4:
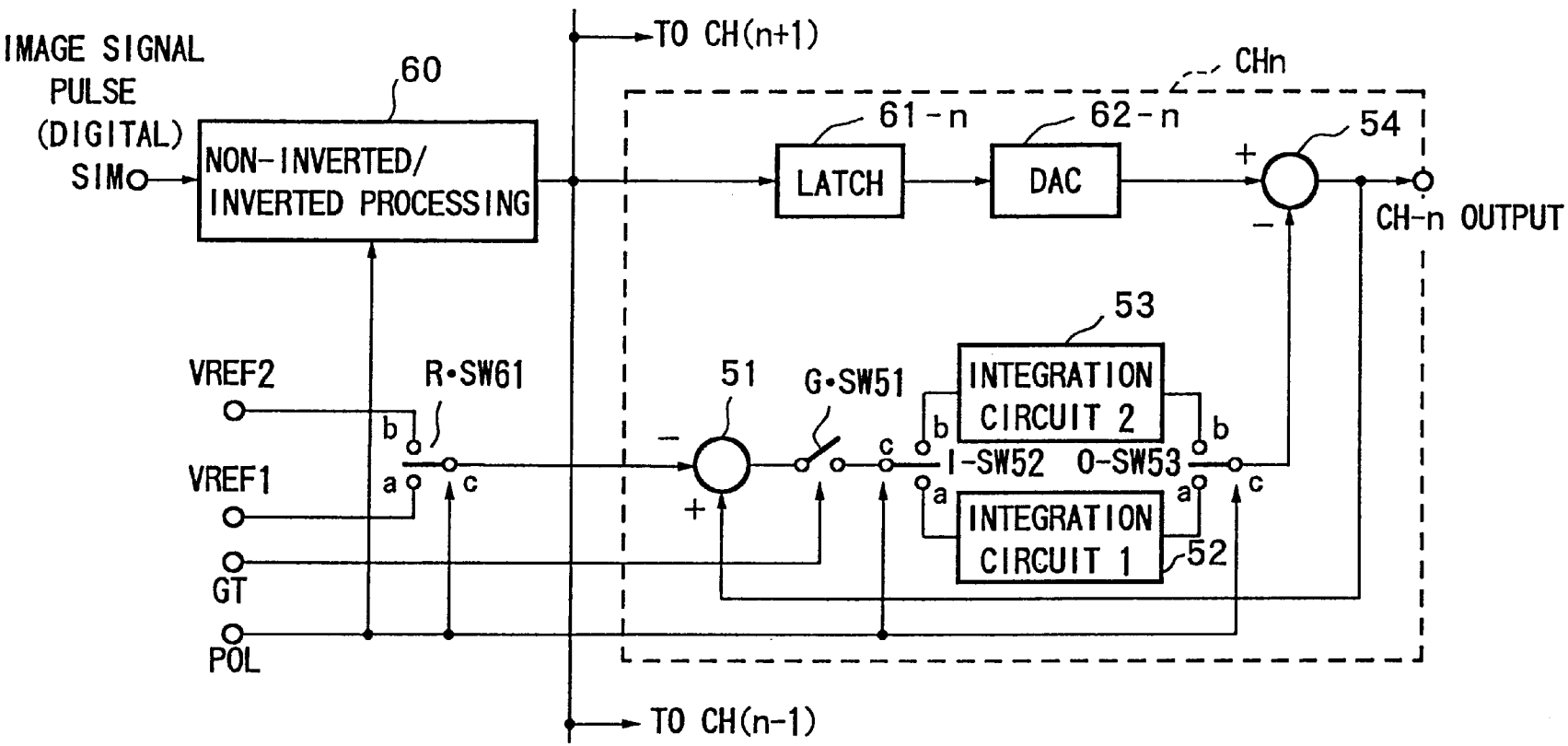
FIG. 4 is a view of the configuration of an image data drive circuit used for a polycrystalline silicon thin film transistor type liquid crystal display panel according to a second embodiment of the present invention and a view of the configuration of an image data drive circuit of a digital system using a latch and a digital-to-analog converter.

FIG. 4 is a view of the configuration of an image data drive circuit used for a polycrystalline silicon thin film transistor type liquid crystal display panel according to a second embodiment of the present invention and a view of an image data drive circuit of a digital system using a latch and a digital-to-analog converter.

This image data drive circuit 30B is constituted by, as shown in FIG. 4, a subtraction circuit 51, integration circuits 52 and 53, an adder circuit 54, a non-inversion/inversion processing circuit 60, a latch 61-n, a digital-to-analog converter 62-n, and switch circuits G-SW51, I-SW52, O-SW53, and R-SW61.

In this second embodiment, as the image data, in the same way as that shown as the image data in FIG. 3A, a signal obtained by inserting a reference signal in the blanking period is supplied as a digital signal.

This signal is converted to a signal which repeatedly alternates between a non-inverted mode of the digital signal as it is and an inverted mode by the non-inversion/inversion processing circuit 60. As this switch signal, the non-inversion/inversion switch signal POL shown in FIG. 3C is used.

The output of the non-inversion/inversion processing circuit 60 is input to p number of channel portions. Each channel is constituted by a latch 61-n and a digital-to-analog converter 62-n. By this, the data is converted to parallel analog signals of p number of channels.

The output of the digital-to-analog converter 62-n is taken out as the output via the adder circuit 54 for adding the offset correction signals and, at the same time, fed back to one input of the subtraction circuit 51 for performing the comparison with the reference signal level.

The other input of the subtraction circuit 51 is supplied with a signal obtained by switching either of the reference voltage VREF1 or VREF2 corresponding to the reference signal level by the switch circuit R-SW61 in accordance with the input drive of the non-inversion/inversion switch signal POL.

Note that the reference voltages VREF1 and VREF2 respectively correspond to the reference signal levels in the non-inverted and inverted modes. Unlike the above analog system, the reference level on the input side, that is, before conversion to parallel signals, is not obtained as the analog signal, therefore corresponding voltages are prepared as VREF1 and VREF2. The rest of the operation and the effects thereof are the same as those of the first embodiment.

Next, an explanation will be given of the effect of the circuits of FIG. 2 and FIG. 4 in relation to FIG. 5.

Figure 5:
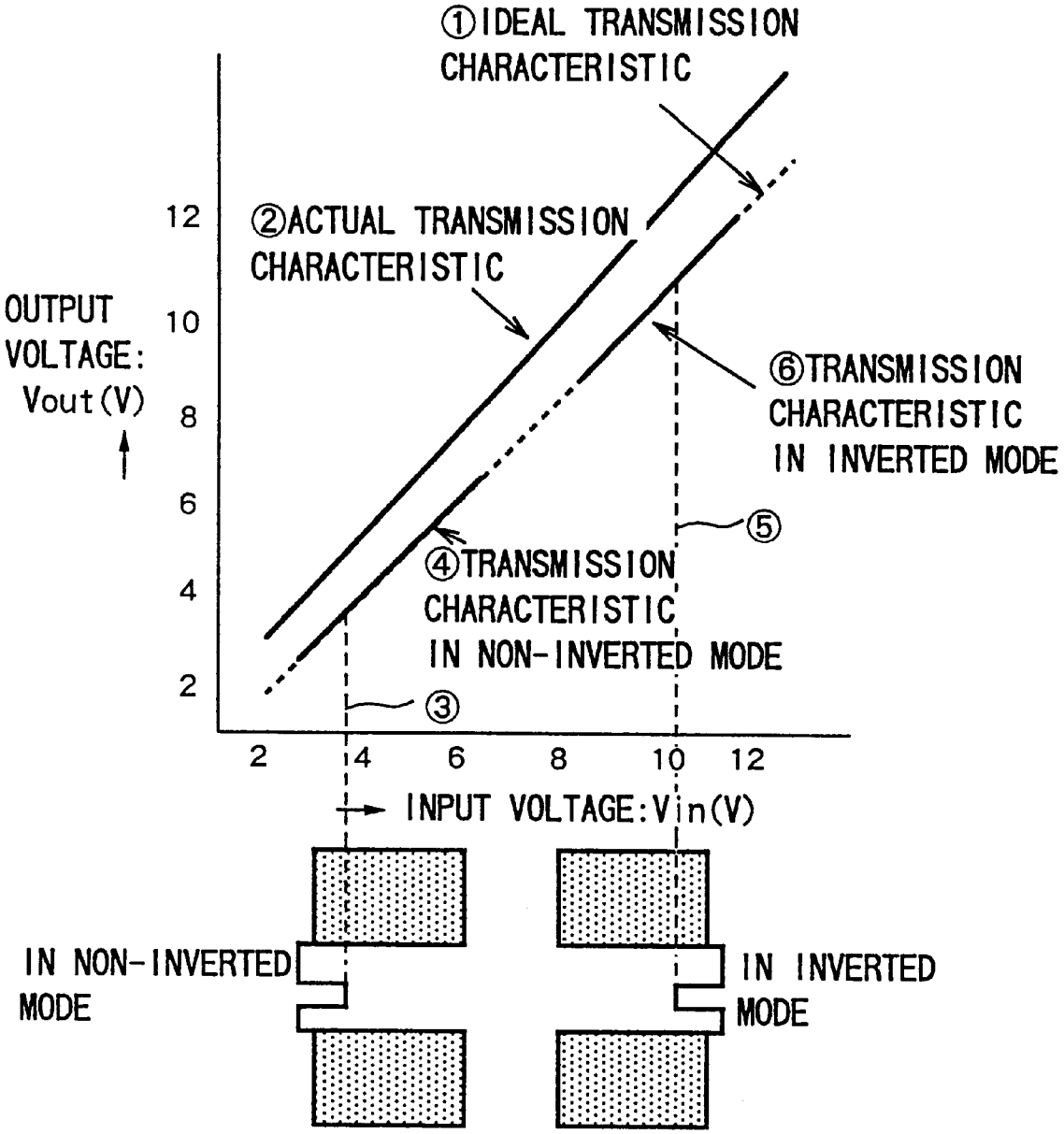
FIG. 5 is a view for explaining the effects of the circuits of FIG. 2 and FIG. 4.

In FIG. 5, the line indicated by <1> indicates the ideal transmission characteristic of the input/output.

The line indicated by <2> indicates an actual transmission characteristic having an offset and gain error.

In the circuit of FIG. 2, the integration circuit 52 generates an offset correction signal giving a zero voltage difference between the input and output in the reference signal in the non-inverted mode shown in <3> in FIG. 5.

As a result, a transmission characteristic as shown in <4> is obtained.

Further, the integration circuit 53 generates an offset correction signal giving a zero voltage difference between the input and output in the reference signal in the inverted mode shown in <5> in FIG. 5.

As a result, a transmission characteristic as shown in <6> is obtained.

If the gain error is zero, the transmission characteristic will coincide with the ideal transmission characteristic at all points if the offset is cancelled, but in actuality there is gain error, so they coincide at only one point.

However, according to the present circuit, offset correction signals can be independently generated in the non-inverted mode and the inverted mode. Accordingly, the characteristic can be brought in to coincidence with the ideal transmission characteristic at any two points in the non-inverted mode and the inverted mode. This becomes the voltage of the reference signal.

In the non-inverted/inverted mode, by matching two independent points, the effect that visually the deviation is further reduced to about ½ to ⅓ in comparison with a simple matching of the offset is obtained by selecting the voltage of the same gain error to a level where vertical stripes due to the offset between channels can be most easily visually detected. This is therefore more effective.

As mentioned above, the inter-channel deviation is relatively small on the same chip. Accordingly, if the number of channels is about 6 channels, it is possible and desirable to integrate them on one chip.

However, when the number of channels becomes 12 or 24, it becomes difficult to insert them into one chip in terms of power consumption or chip size. Further, when considering general use for a variety of liquid crystal display panels, it is commercially most desirable that common use be made possible by using two or four chips of the same type integrating for example 6 channels for 12 channels or 24 channels.

The ICs combined in such a case differ in the manufacturing lot or manufacturing time, therefore it was very difficult to keep the inter-channel deviation small in the related art.

According to the present circuit, by inserting the reference signal, the circuit operates so that the offset of that level automatically becomes zero, therefore the inter-channel deviation can be kept extremely small even among ICs of different manufacturing lots and different manufacturing times. This contributes to the realization of a liquid crystal display panel of a high image quality.

The second embodiment is preferably applied to a digital system, more particularly a display device using a polycrystalline silicon thin film transistor type liquid crystal display panel, as opposed to the analog system shown in the first embodiment.

Further, in a display using an amorphous thin film transistor type liquid crystal display panel, this embodiment is also useful as the means for improving the performance and image quality of the image data drive circuit of the analog system using sample-and-hold circuits.

Third Embodiment

Figure 6:
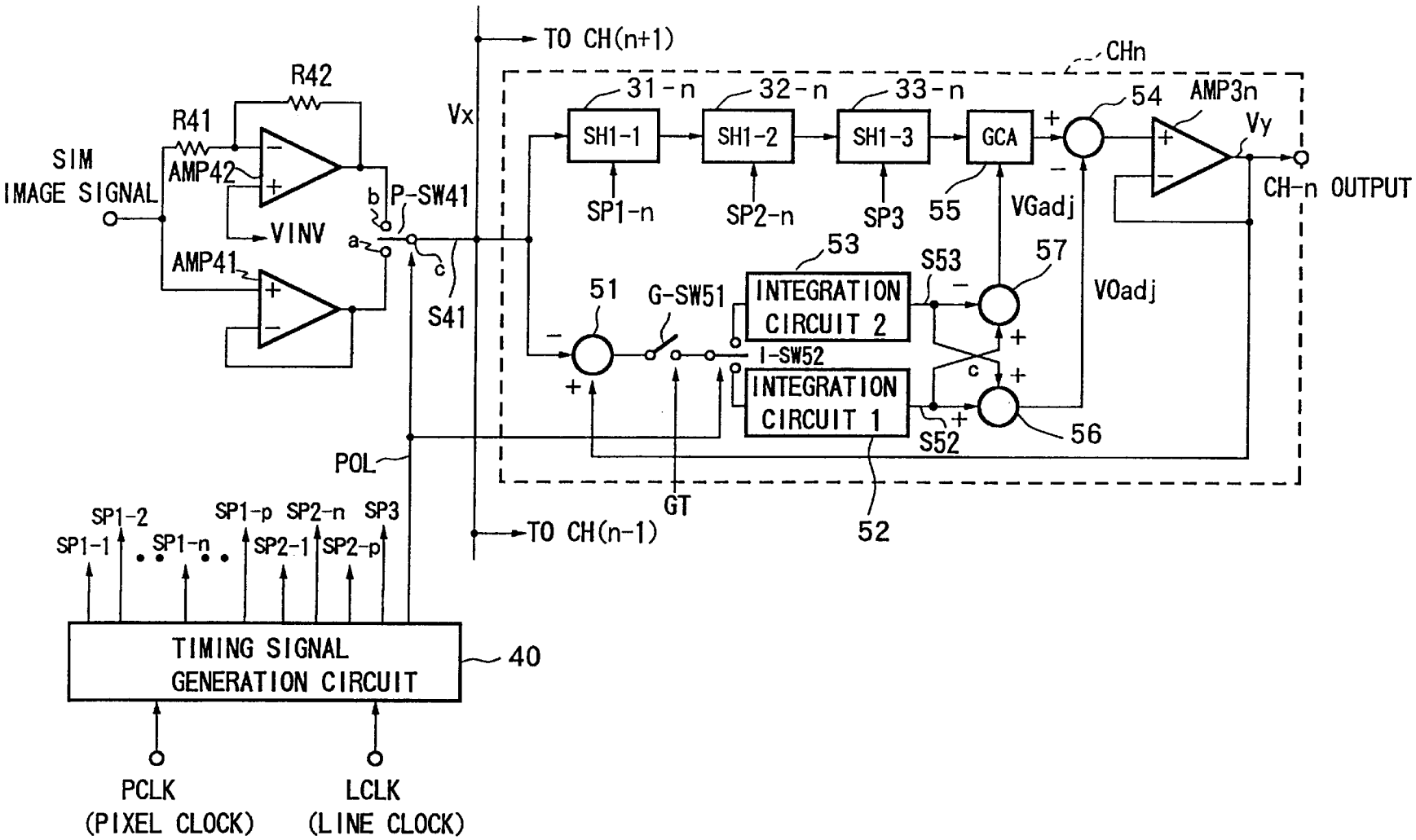
FIG. 6 is a view of the configuration of an image data drive circuit used for a polycrystalline silicon thin film transistor type liquid crystal display panel according to a third embodiment of the present invention and a view of the configuration of the image data drive circuit of an analog system using sample-and-hold circuits.

FIG. 6 is a view of the configuration of an image data drive circuit of the analog system using sample-and-hold circuits used for a polycrystalline silicon thin film transistor type liquid crystal display panel according to a third embodiment of the present invention. In the figure, the same constituent parts as those of FIG. 2 showing the first embodiment and FIG. 31 showing the related art are represented by the same reference symbols.

The image data drive circuit 30B of FIG. 6 exhibits all functions for obtaining parallel outputs of 6 channels in FIG. 31 in the same way as the case of FIG. 2, but in FIG. 6, for simplification, only the drive circuit of one channel n surrounded by the dotted line is shown.

The difference of the third embodiment from the above first embodiment resides in that a gain control circuit (GCA: gain control amplifier) 55 with a gain which is controlled by a gain correction signal VGadj is provided between the output of the sample-and-hold circuit 33-n and the addition terminal of the adder circuit 54 and in that, in place of the switch circuit O-SW53, provision is made of an adder circuit 56 for adding a correction signal S52 from the integration circuit 52 and the correction signal S53 from the integration circuit 53 and supplying the result as an offset correction signal VOadj to the adder circuit 54 and of a subtraction circuit 57 for subtracting the correction signal S53 from the integration circuit 53 from the correction signal S52 from the integration circuit 52 and supplying the same as the gain correction signal VGadj to the gain control circuit 55.

Note that the order of connection of the sample-and-hold circuit, the gain control circuit, the adder circuit, and the subtraction circuit is not limited to that of FIG. 6 and may any order.

FIGS. 7A to 7D are views of the signal waveforms of different portions of the circuit of FIG. 6.

In the third embodiment, part of the image signal SIM in the blanking period indicated by a bold line in FIG. 7 is used as the reference signal SREF for detecting the offset voltage.

This reference signal SREF may be set or inserted separately from a pedestal level of the blanking period, but for detecting the difference of offset between the non-inverted mode and inverted mode (that is, the gain error), it is more efficient if the pedestal, that is, a more black level, is used as it is.

In FIG. 6, in the image signal SIM, the non-inversion/inversion switch processing is carried out by switching the switch circuit P-SW41 by the non-inversion/inversion switch signal POL. The switching timing of the non-inversion/inversion switch signal POL is selected to be in the blanking period and away from the timing of the part indicated by the bold line in FIG. 7 used as the reference signal SREF. In this embodiment, the inversion operation is carried out before the reference signal.

Below, an explanation will be made of the operation by the above configuration with reference to FIG. 8 and FIG. 9.

Figure 8:
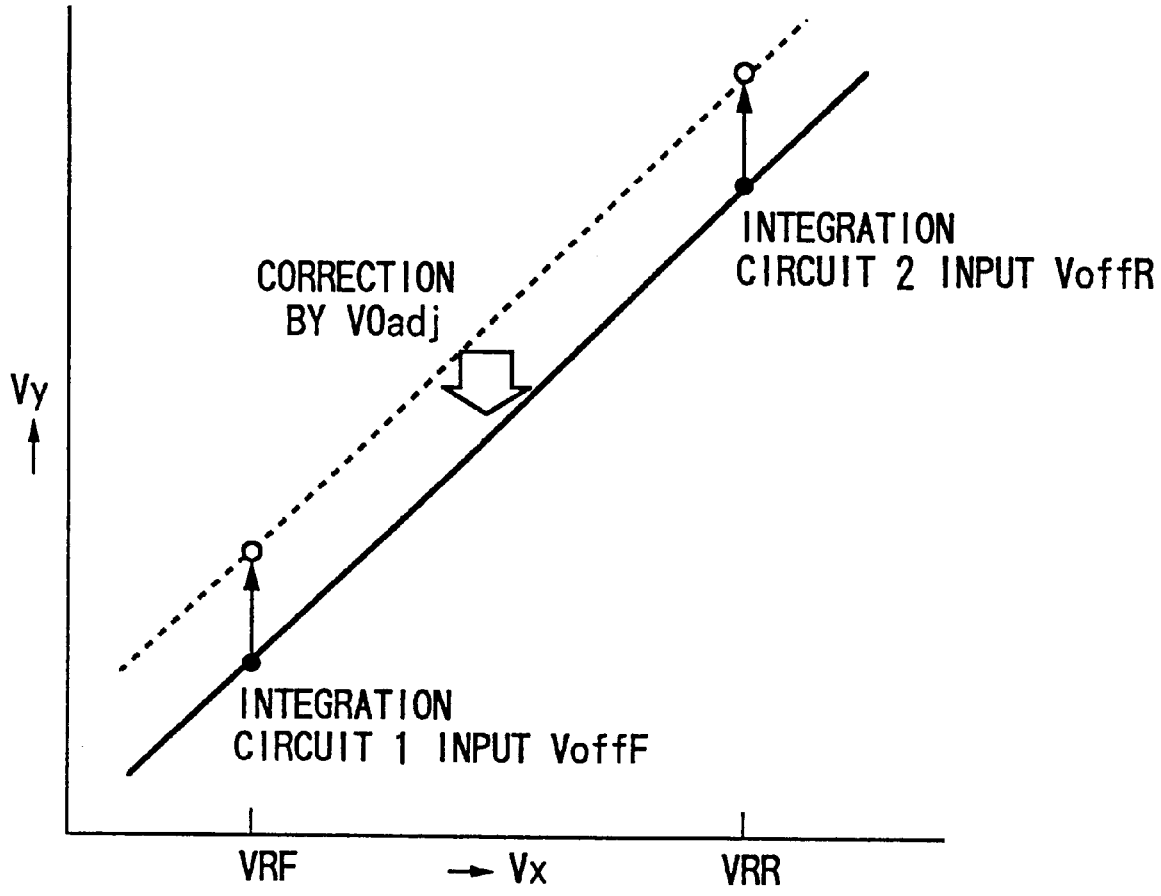
FIG. 8 is a view for explaining an offset error and a gain error in the circuit of FIG. 6 (or FIG. 15)
Figure 9:
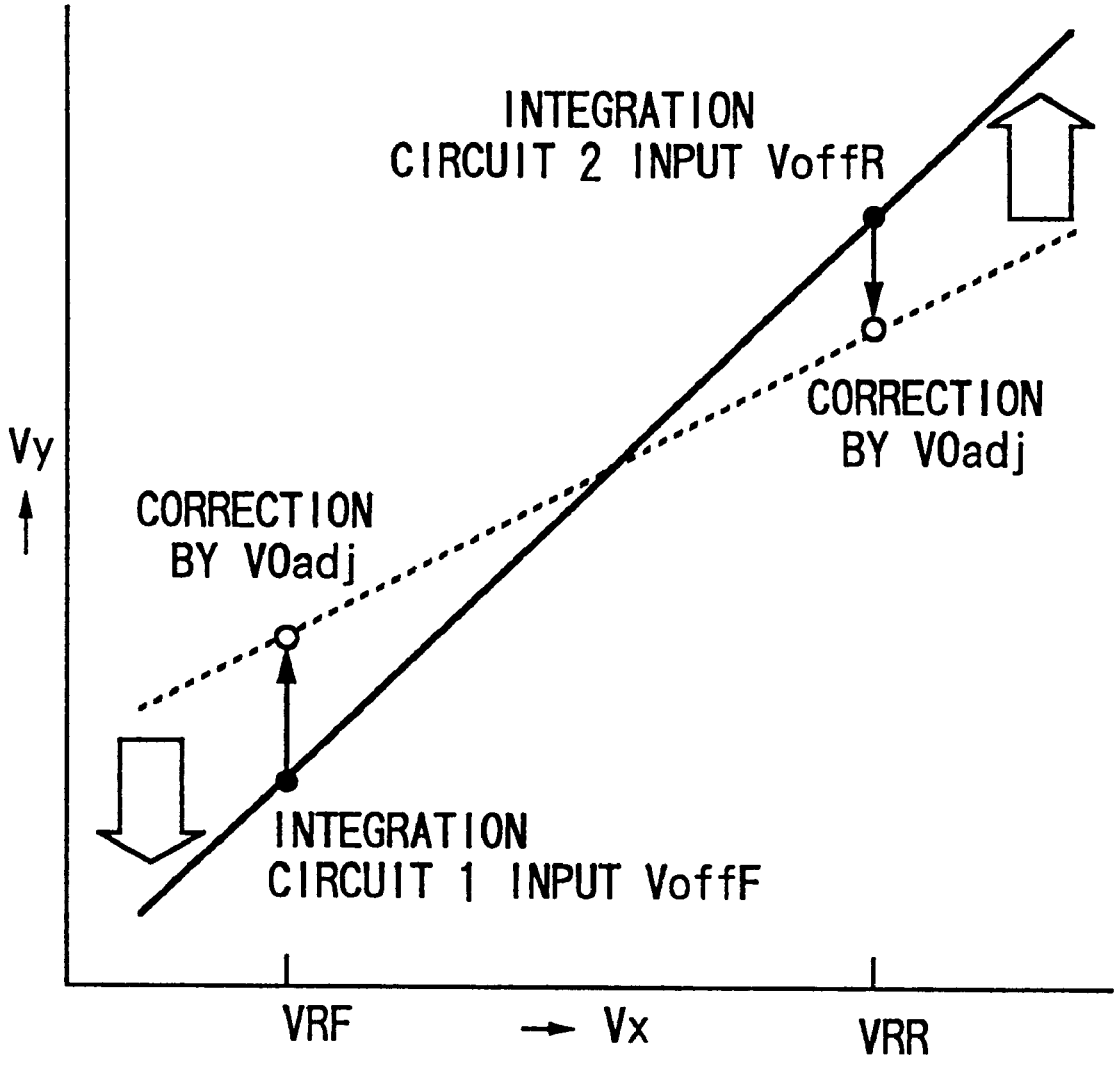
FIG. 9 is a view for explaining the offset error and the gain error in the circuit of FIG. 6 (or FIG. 15)

FIG. 8 is a view for explaining the operation when there is an offset voltage in a path from the sample-and-hold circuit to the amplifier AMP3*n;* while FIG. 9 is a view for explaining the operation when there is a gain error.

In FIG. 8 and FIG. 9, the abscissas represent an output Vx (S41) of the switch circuit P-SW41 for switching the non-inverted mode and the inverted mode, that is, the signal commonly supplied to pixel data drive circuits of a plurality of channels. The ordinates represent an output signal Vy of the amplifier AMP3*n* of a certain channel.

Further, VRF and VRR are the reference signal levels of the non-inverted mode and inverted mode, respectively. A solid line indicates the input and ideal output characteristic, a broken line in FIG. 8 indicates the input/output characteristic when there is a positive offset voltage, and the broken line in FIG. 9 indicates the transmission characteristic when there is a gain error.

First, non-inversion processing is carried out with respect to the image signal SIM by the amplifier AMP41, and inversion processing is carried out in the inverting amplifier AMP42.

Then, the non-inverted image signal and inverted image signal Vx (S41) obtained by the non-inversion processing and inversion processing are alternately supplied to the sample-and-hold circuit 31-*n* and subtraction circuit 51 of the initial stage of each channel in accordance with the supply level of the non-inversion/inversion switch signal POL generated at the timing signal generation circuit 40.

In the channel CHn, the non-inverted or inverted input image signal is subjected to the sampling and holding processing at three sample-and-hold circuits 31-*n,* 32-*n,* and 33-*n* and output from the amplifier AMP3*n* serving as the buffer as the channel output signal via the gain control circuit 55 and further via the adder circuit 54 for adding the offset correction signals.

Further, this output is fed back to the subtraction circuit 51.

In the channel CHn, in order to obtain the offset correction signal, first, the subtraction circuit 51 compares the non-inverted or inverted input image signal and the output signal of the channel.

Here, when there is the offset voltage VoffF at the time of input of the reference signal VRF in the non-inverted mode, the offset voltage VoffF appears at the output of the adder circuit 51. Similarly, when assuming that the offset voltage VoffF exists at the time of the input of the reference signal VRR in the inverted mode, the offset voltage VoffF appears at the output of the adder circuit 51.

The output signal of this adder circuit 51 is sampled at the gate switch circuit G-SW51 in synchronization with the gate pulse signal GT. Only the part of the reference signal inserted in the image signal is extracted.

The extracted reference signal is input to the integration circuit 52 via the switch circuit I-SW52 switched at the supply level of the non-inversion/inversion switch signal POL in the non-inverted section, while is input to the integration circuit 53 and integrated in the inverted section.

At this time, where there is the offset voltage VoffF at the time of input of the reference signal VRF in the non-inverted mode, a sampling signal containing the offset of the switch circuit I-SW52 is input to the integration circuit 52, while where there is the offset voltage VoffF at the time of input of the reference signal VRR in the inverted mode, a sampling signal containing an offset of the switch circuit I-SW52 is input to the integration circuit 53.

The correction signal S52 from the integration circuit 52 and the correction signal S53 from the integration circuit 53 are respectively input to the adder circuit 56 and the subtraction circuit 57.

In the adder circuit 56, the correction signal S52 and the correction signal S53 are added and the result supplied as the offset correction signal VOadj to the adder circuit 54 serving as the offset subtracting means.

On the other hand, in the subtraction circuit 57, the correction signal S53 is subtracted from the correction signal S52 and the result supplied as the gain correction signal VGadj to the gain control circuit 55.

In the gain correction circuit 55, the output signal level of the sample-and-hold circuit 33-*n* is adjusted with a gain based on the gain correction signal VGadj and the result supplied to the adder circuit 54.

Then, at the adder circuit 54, the offset correction signal VOadj is added to the output of the gain control circuit 55, and the channel output is obtained via the amplifier AMP3*n* serving as the buffer.

Further concretely explaining this, as mentioned above, the offset correction signal VOadj and the gain correction signal VGadj are generated as the sum and difference of outputs of the integration circuits 52 and 53, respectively.

As shown in FIG. 8, where the transmission characteristic of the circuit has only an offset, VoffF=VoffR and the outputs of the integration circuits 52 and 53 also become equal.

Accordingly, the gain correction signal VGadj is not generated, and only the offset correction signal VOadj is generated.

In this case, the input signal of the amplifier AMP3*n* serving as the buffer is input after the subtraction of the offset correction signal VOadj from the output of the gain control circuit 55, therefore, as shown in FIG. 8, the output signal Vy of the amplifier AMP3*n* is subjected to corrected so that the input/output characteristic shifts to the lower side as a whole.

Then, when the offset becomes zero at VRF and VRR, there are no longer inputs of the integration circuit 52 and the integration circuit 53, and the circuit becomes a stable state.

Further, where there is a gain error in the circuit, as the initial state, as shown in FIG. 9, a positive offset voltage VoffF Is input to the integration circuit 52 in the non-inverted mode and a negative offset VoffR is input to the integration circuit 53 in the inverted mode.

The positive and negative values of the outputs of the integration circuit 52 and the integration circuit 53 integrating them are gradually increased.

At this time, the offset correction signal VOadj of the sum of the two holds a value of almost zero. On the other hand, the gain correction signal VGadj of the difference of the two takes the positive value, and the value is increased.

In the gain control circuit 55, when the gain correction signal VGadj is increased, the gain thereof is increased. As a result, the gain of the gain control circuit 55 is increased.

By this, as shown in FIG. 9, the transmission characteristic rotates in a counterclockwise direction, and the correction operation is carried out in a direction to make it coincide with the ideal characteristic.

As explained above, according to the third embodiment, even if the circuit has an offset error or gain error, by using the reference signal in non-inverted/inverted mode, detecting the sum and difference of reference signals of the input and the output, correcting the offset by the sum, and correcting the gain by the difference, it becomes possible to bring the transmission characteristic thereof into complete coincidence with the ideal characteristic and make the thin film transistor type liquid crystal display panel display an image of a high quality without vertical stripes.

Fourth Embodiment

Figure 10:
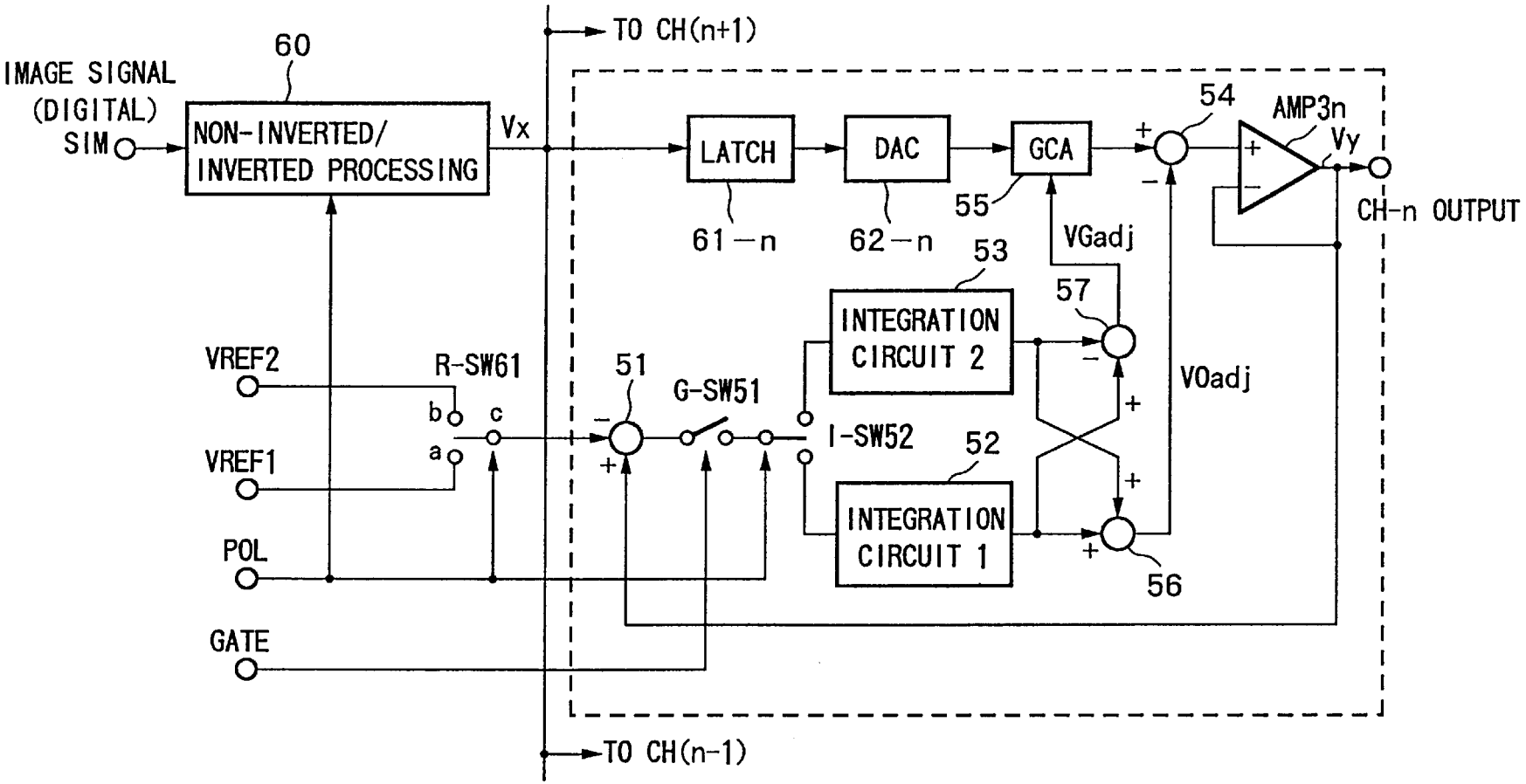
FIG. 10 is a view of the configuration of an image data drive circuit used for a polycrystalline silicon thin film transistor type liquid crystal display panel according to a fourth embodiment of the present invention and a view of the configuration of the image data drive circuit of a digital system using a latch and a digital-to-analog converter.

FIG. 10 is a view of the configuration of an image data drive circuit used for a polycrystalline silicon thin film transistor type liquid crystal display panel according to a fourth embodiment of the present invention and a view of the image data drive circuit of the digital system using a latch and digital-to-analog converter.

This image data drive circuit 30D is constituted by, as shown in FIG. 10, subtraction circuits 51 and 57, integration circuits 52 and 53, adder circuits 54 and 56, a gain control circuit 55, a non-inversion/inversion processing circuit 60, a latch 61-*n*, a digital-to-analog converter 62-*n*, and switch circuits G-SW51, I-SW52, and R-SW61.

Figures 7A, 7B, 7C, 7D:
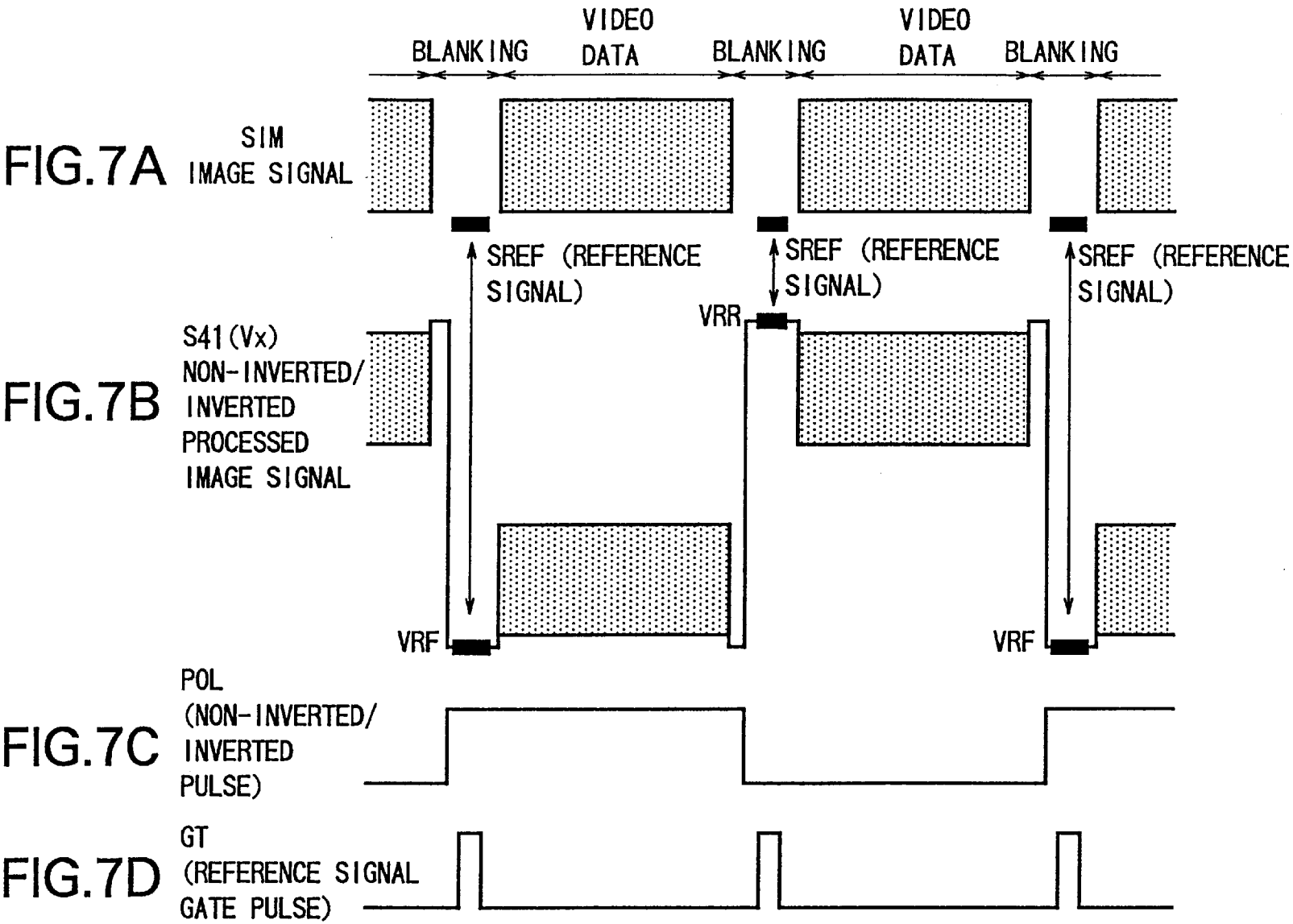
FIGS. 7A to 7D are views of the signal waveforms of different portions of the circuit of FIG. 6.

In this fourth embodiment, as the image data, in the same way as that shown as the image data in FIG. 7A, a signal obtained by inserting a reference signal in the blanking period is supplied as the digital signal.

This signal is converted to a signal which repeatedly alternates between a non-inverted mode of the digital signal as it is and an inverted mode by the non-inversion/inversion processing circuit 60. As this switch signal, the non-inversion/inversion switch signal POL shown in FIG. 7C is used.

The output of the non-inversion/inversion processing circuit 60 is input to p number of channel portions. Each channel is constituted by a latch 61-*n* and a digital-to-analog converter 62-*n*. By this, the data is converted to parallel analog signals of p number of channels.

The output of the digital-to-analog converter 62-*n* is output from the amplifier AMP3*n* serving as the buffer after passing through the gain control circuit 55 controlled in its gain by the gain correction signal VGadj and the adder circuit 54 for adding the offset correction signal Voadj.

Vx is a digital signal and therefore cannot be directly compared with the output signal Vy. For this reason, the reference voltage VREF1 corresponding to the reference signal in the non-inverted mode and the reference voltage VREF2 corresponding to the reference signal in the inverted mode are supplied, switched by the switch circuit R-SW61 controlled by the non-inversion/inversion switch signal POL, and input to one input terminal of the subtraction circuit 51.

Note that the reference voltages VREFF1 and VREF2 respectively correspond to the reference signal level in the non-inverted mode and the inverted mode.

In this way, the difference between the circuit according to the fourth embodiment and the circuit of the third embodiment resides in that, unlike the above analog system, the reference level on the input side, that is, before the conversion to parallel signals, is not obtained as analog signals and cannot be directly compared, therefore voltages corresponding to the reference signals of Vx are used as VREF1 and VREF2. The rest of the operation and the effects thereof are the same as those of the third embodiment.

Note that the digital system indicated as the fourth embodiment can have the gain control circuit constituted integrally with the analog-to-digital converter, whereby the advantage is gained that the circuit can be made simple and high in performance. Next, the principle thereof will be explained.

Figure 11:
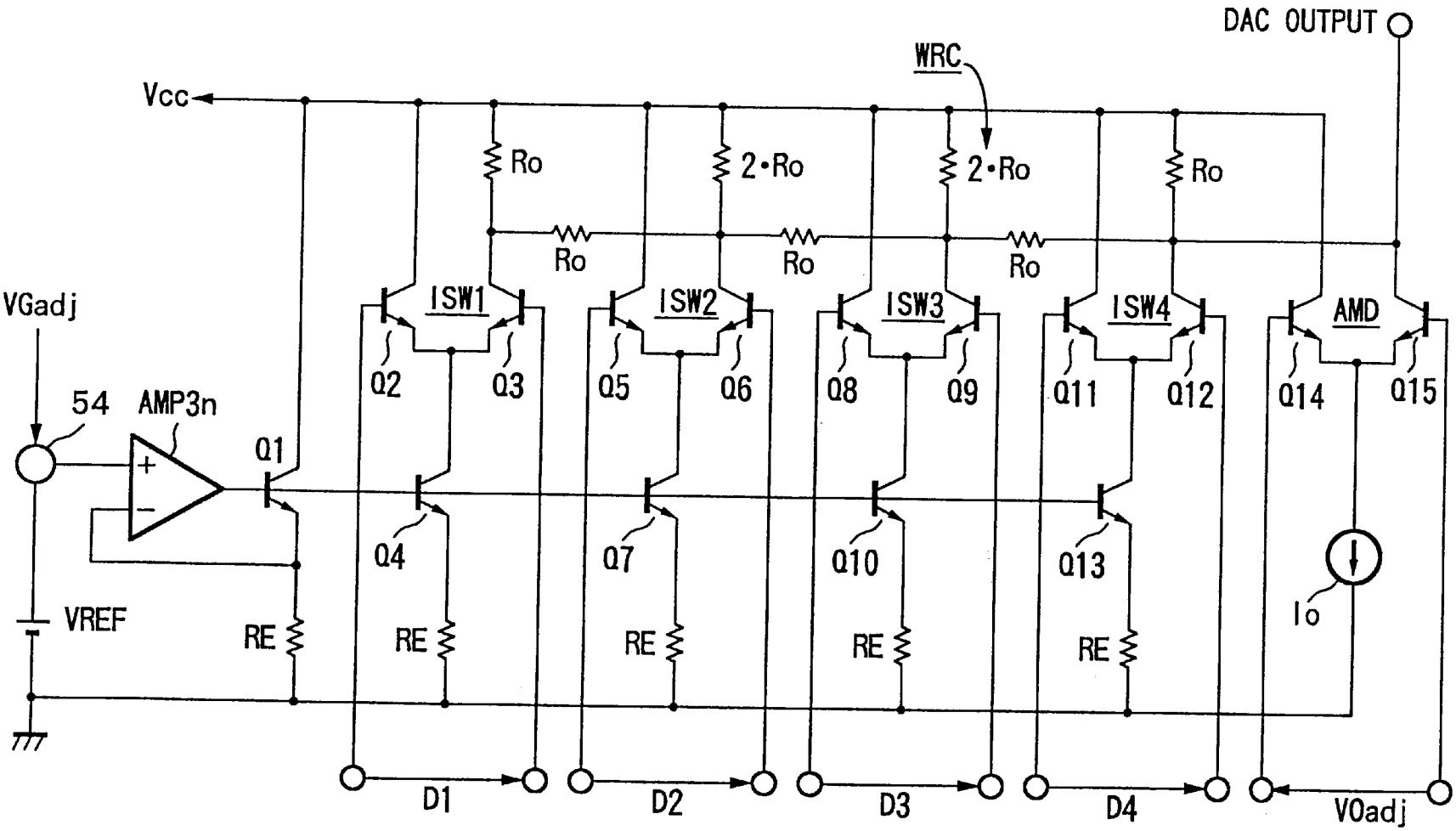
FIG. 11 is a view of a concrete example of a 4-bit analog-to-digital converter.

FIG. 11 shows a 4-bit analog-to-digital converter which uses as principal constituent elements the current switches ISW1 to ISW4 comprising differential pairs of emitter-coupled npn type transistors Q2 and Q3. Q5 and Q6, Q8 and Q9, and Q11 and Q12, four npn type transistors Q4, Q7, Q10 and Q13 as current sources with collectors which are connected to the connection point of emitters of the current switches ISW1 to ISW4, an "R-2R" weighting circuit WRC comprising a combination of resistor elements of resistance values R and 2R provided at outputs of the current switches ISW1 to ISW4, and a correction portion AMD comprising a differential pair of emitter-coupled npn type transistors Q14 and Q15.

In the configuration shown in FIG. 11, through transistors Q4, Q7, Q10, and Q12 serving as current sources receive a current such as I=(VREF+VGadj) due to the function of the output of the subtraction amplifier AMP3*n*.

Namely, the current is controlled by the gain correction signal VGadj. This current determines the full scale of the D4 conversion output, therefore becomes equivalent to the change of the gain.

Such a system is referred to as multiplication type digital-to-analog conversion.

In the circuit shown in FIG. 11, by supplying the offset correction signal VOadj to the base of the differential pair transistor Q15 constituting the correction unit AMD, the offset correction function of controlling the collector current of the transistor Q15 is imparted.

The invention is not limited to this example. There are a large number of circuit systems for analog-to-digital converters. No matter what the system, however, if the gain correction signal is added to a parameter determining the full scale thereof, it is possible to impart a gain correction function as a multiplication type analog-to-digital converter.

Fifth Embodiment

Figure 12:
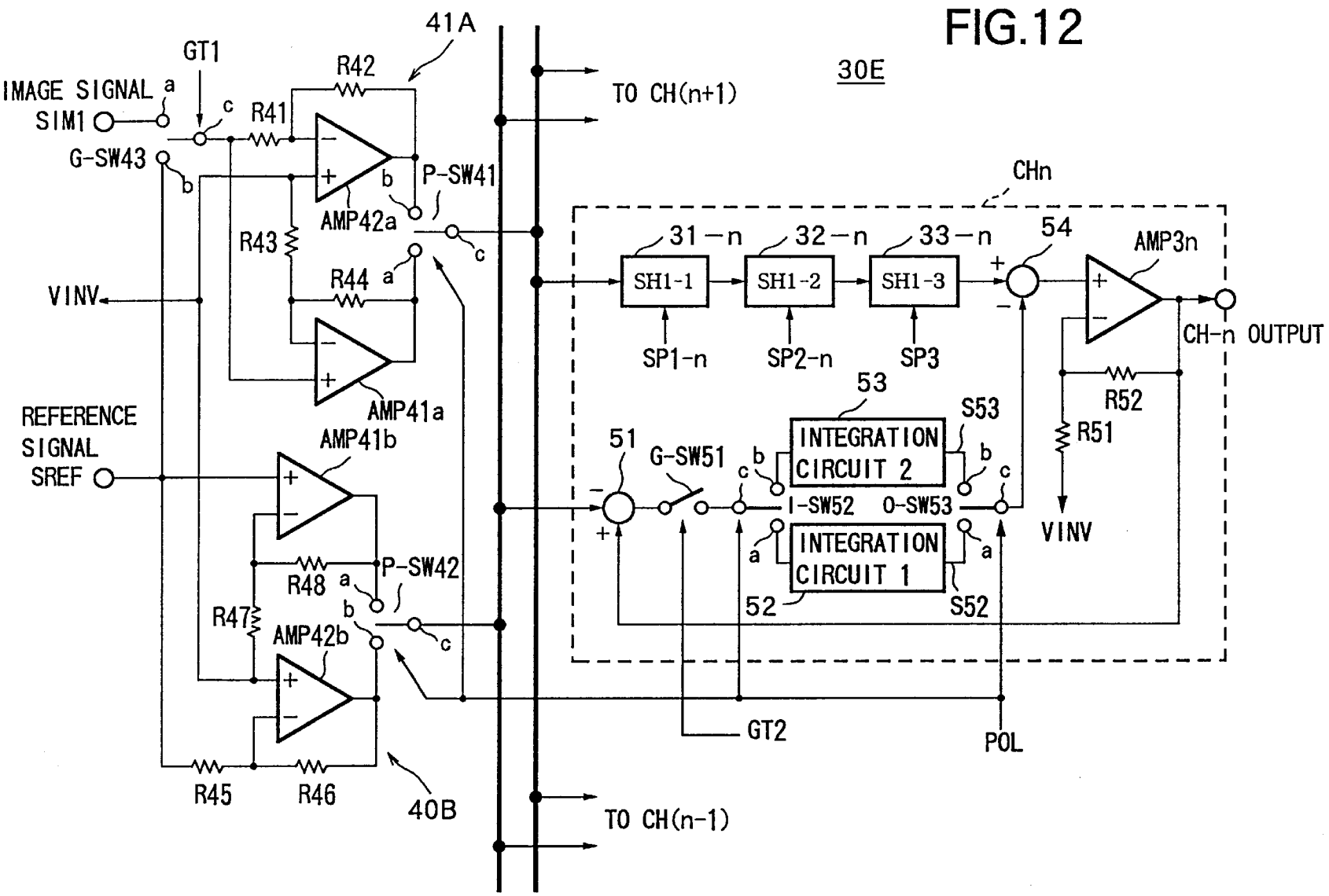
FIG. 12 is a view of the configuration of an image data drive circuit used for a polycrystalline silicon thin film transistor type liquid crystal display panel according to a fifth embodiment of the present invention and a view of the configuration of the image data drive circuit of an analog system using sample-and-hold circuits.

FIG. 12 is a view of the configuration of an image data drive circuit used for a polycrystalline silicon thin film transistor type liquid crystal display panel according to a fifth embodiment of the present invention and is a view of an image data drive circuit of an analog system using sample-and-hold circuits. In the figure, the same constituent parts as those of FIG. 2 showing the first embodiment are represented by the same reference symbols.

Further, the image data drive circuit 30E of FIG. 12 shows only the drive circuit of one channel n surrounded by the dotted line for simplification.

This image data drive circuit 30E is constituted by, as shown in FIG. 12, sample-and-hold circuits 31-*n*, 32-*n*, and 33-*n*, a subtraction circuit 51, integration circuits 52 and 53, an adder circuit 54, an amplifier AMP3*n* constituting a voltage follower, amplifiers AMP41*a* and AMP41*b* as non-inversion circuits, inverting amplifiers AMP42*a* and AMP42*b*, resistors R41 to R48, R52, and R53, and switch circuits P-SW41, G-SW43, G-SW51, I-SW52, and O-SW53.

Note that, in FIG. 12, for simplification of the figure, the timing signal generation circuit is omitted.

The difference of the fifth embodiment from the first embodiment resides in that the image signal in which the reference signal is inserted is not input to the image data drive circuit, but provision is made of two non-inversion/inversion system circuits, that is, the image signal use non-inversion/inversion system circuit 41A serving as the first inverting means and the reference signal use non-inversion/inversion system circuit 41B serving as the second inverting means; the image signal SIM1 and the reference signal SREF are separately input; the switch circuit G-SW43 is switched by the gate signal GT1 to Insert the reference signal SREF in for example the blanking period of the image signal SIM1; the image signal non-inverted or inverted by the image signal use non-inversion/inversion system circuit 41A and in which the reference signal is inserted is input to the sample-and-hold circuit 31-*n* of each channel; and the reference signal made non-inverted or inverted at the reference signal use non-inversion/inversion system circuit 41B is input to the subtraction circuit 51 of each channel.

The non-inverted input terminal (+) of the amplifier AMP41*a* of the image signal use non-inversion/inversion system circuit 41A is connected to the output terminal c of the switch circuit G-SW43, while the inverted input terminal (−) is connected to the non-inverted input terminal (+) of the amplifier AMP42*a* via the resistor R43 and connected to its own output and the input terminal a of the switch circuit P-SW41 via the resistor R44. Further, the non-inverted input terminal (+) of the amplifier AMP42*a* is connected to the input line of the inverted reference signal VINV.

Further, the non-inverted input terminal (+) of the amplifier AMP41*b* of the reference signal use non-inversion/inversion system circuit 41B is connected to the input line of the reference signal SREF and the input terminal b of the switch circuit G-SW43, and the inverted input terminal (−) is connected to the non-inverted input terminal (+) of the amplifier AMP42*b* via the resistor R47 and connected to its own output and the input terminal a of the switch circuit P-SW42 via the resistor R48.

The non-inverted input terminal (+) of the amplifier AMP42*b* is connected to the input line of the inverted reference signal VINV, while the inverted input terminal (−) is connected to the input line of the reference signal SREF and the input terminal b of the switch circuit G-SW43 via the resistor R45 and connected to its own output and the input terminal b of the switch circuit P-SW42 via the resistor element R46.

Then, the output terminal c of the switch circuit P-SW41 is connected to the sample-and-hold circuit of each channel CHn, the output terminal c of the switch circuit P-SW42 Is connected to the subtraction circuit 51 of each channel CHn, and the input terminal a of the switch circuit G-SW43 is connected to the input line of the image signal SIM1.

Further, in each channel CHn, the inverted input terminal (−) of the amplifier AMP3*n* is connected to the input line of the inverted reference signal VINV via the resistor element 51 and connected to its own output via the resistor R52.

FIGS. 13A to 13F are views of the signal waveforms of different portions of the circuit of FIG. 12.

Figures 13A, 13B, 13C, 13D, 13E, 13F:
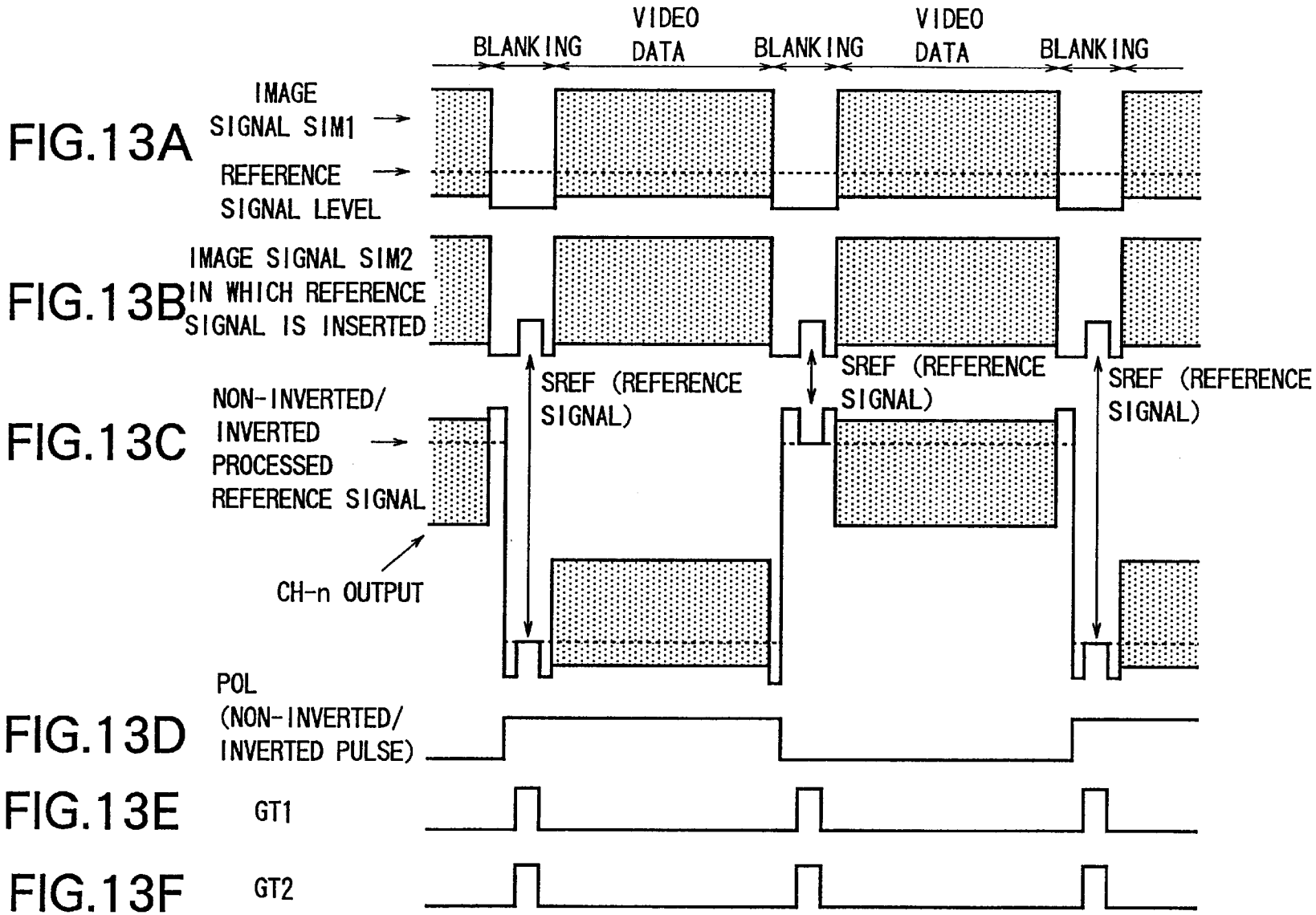
FIGS. 13A to 13F are views of the signal waveforms of different portions of the circuit of FIG. 12.

The waveforms shown in FIGS. 13A and 13B show the relationships between the input image signal SIM1 and the reference signal SREF.

In the fifth embodiment, the image signal SIM which is input, as shown in FIG. 13B, have a reference signal SREF inserted in the blanking period.

In the fifth embodiment, desirably the reference signal SREF is selected to a slightly dim halftone of a level at which vertical stripes due to inter-channel deviation can be most easily visually detected.

In the circuit of FIG. 12, in a section of a high level in which the gate pulse signal GT1 is active, the switch circuit G-SW43, as shown in FIG. 13B, replaces the blanking level of the input image signal SIM1 by the reference level of the reference signal SREF.

The image signal SIM2 in which the reference signal is inserted is subjected to non-inversion/inversion processing by the amplifiers AMP41*a* and AMP42*a* of the image signal use non-inversion/inversion system circuit 41A and the switch circuit P-SW41.

The signal subjected to the non-inversion/inversion processing is supplied to the sample-and-hold circuit of each channel.

The image signal input to the channel CHn passes through the sample-and-hold circuits 31-*n*, 32-*n*, and 33-*n*, is subjected to the sampling and holding processing, and is output as the output signal of the channel CHn as shown in FIG. 13C by the amplifier AMP3*n* serving as the buffer via the adder circuit 54 for adding the offset correction signals.

Further, this output is fed back to the subtraction circuit 51.

Not only is the reference signal SREF inserted in the blanking of the image signal SIM1 which is input, but also, as shown in FIG. 13C, the reference signal SREF per se is subjected to the non-inversion/inversion processing by the amplifiers AMP41*b* and AMP42*b*.

This signal is input to the subtraction circuit of each channel.

In the channel CHn, the reference signal subjected to the non-inversion/inversion processing and the reference signal in the CH-n output are set to completely match when there is no offset error and gain error in the sample-and-hold circuits and the amplifier AMP3*n* serving as the output buffer.

For this purpose, the product of gains (±As) of the amplifiers AMP41*a* and AMP42*a* of the image signal use non-inversion/inversion system circuit 41A and the gain (Ab) of the amplifier AMP3*n* serving as the output buffer must be set so as to become equal to the gain (±Ab) of the amplifiers AMP41*b* and AMP42*b* of the reference signal use non-inversion/inversion system circuit 41B.

Namely, If the so-called open loop gains of the amplifiers AMP41*a*, AMP42*a*, AMP41*b*. AMP42*b*, and AMP3*n* are sufficiently large, they are set so as to satisfy the following equation:

$$\text{Non-inverted mode } (1+R44/R43)\cdot(1+R52/R51)=1+R48/R47$$
$$\text{Inverted mode } (R42/R41)\cdot(1+R52/R51)=R46/R45 \quad (2)$$

In the subtraction circuit 51, the output of the channel CHn and the reference signal subjected to the non-inversion/inversion processing are compared. The comparison output of only the section in which the reference signal is inserted in the image signal is taken out at the gate switch circuit G-SW51 in synchronization with the gate pulse signal GT2.

The taken out signal is input, via the switch circuit I-SW52 switched at the supply level of the non-inversion/ inversion switch signal POL, to the integration circuit 52 in the non-inverted section and to the integration circuit 53 in the inverted section.

Between the outputs of the integration circuits 52 and 53, the output of the integration circuit 52 is fed back, via the switch circuit O-SW53 switched at the supply level of the non-inversion/inversion switch signal POL, to the adder circuit 54 as the offset correction signal S52 in the non-inverted mode, while the output of the integration circuit 53 is fed back to the adder circuit 54 as the offset correction signal S53 in the inverted mode.

Then, in the adder circuit 54, the offset correction signal is added to the output of the sample-and-hold circuit 33-*n*, and the channel output is obtained via the amplifier AMP3*n* serving as the buffer.

Namely, in each reference signal period in the non-inverted mode and inverted mode, offset correction signals S52 and S53 generated at the integration circuits 52 and 53 are added to the image signal (actually subtracted) so that the offset voltage between the input and output of the image data drive circuit becomes zero, whereby the inter-channel deviation is suppressed to a minimum.

By such a configuration, in each of the non-inverted mode and inverted mode, the integration circuit 52 and the integration circuit 53 generate offset correction signals making the reference signal inserted in the image signal and the reference signal subjected to the non-inversion/inversion processing, that is, the output of the switch circuit P-SW42, identical, whereby the circuit is balanced.

Namely, when there is an error in the output of the subtraction circuit 51, the error signal is integrated by the integration circuit and subtracted from the output of the sample-and-hold circuit 33-*n* as the offset correction signal. This operation is continued until the error signal disappears.

When there is an offset error or gain error in the sample-and-hold circuit or the amplifier AMP3*n* serving as the buffer, the offset signal is generated so as to match the level of insertion of the reference signal.

Further, even if there is an offset error or gain error of the non-inversion/inversion circuits of the image signal and reference signal, since these are commonly used in all channels, the errors do not become inter-channel deviation.

Figure 14:
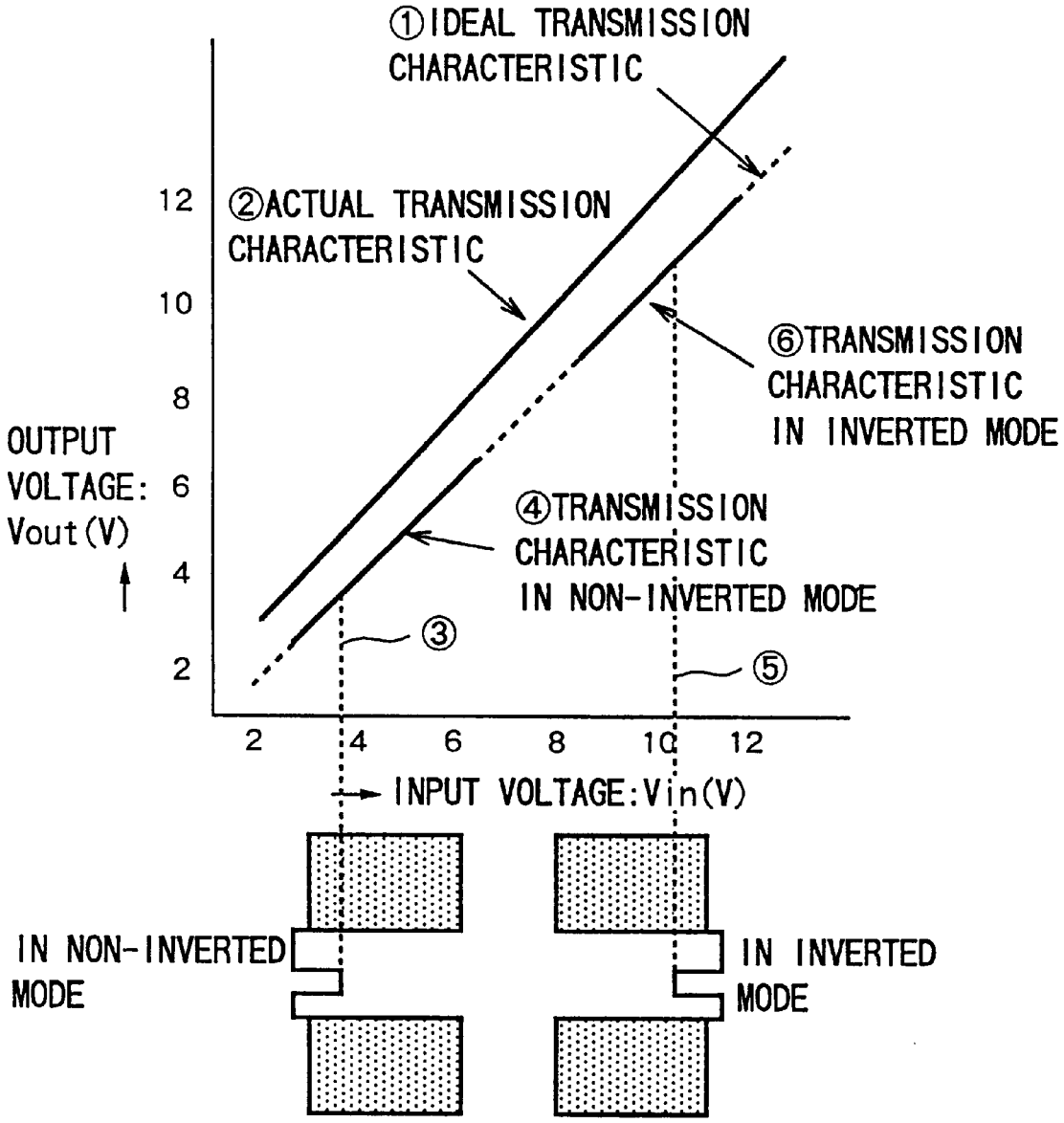
FIG. 14 is a view for explaining the effect of the circuit of FIG. 12.

FIG. 14 is a view explaining the operation of reduction of the inter-channel deviation according to the fifth embodiment as the transmission characteristic.

In FIG. 14, the line indicated by <1> shows the ideal transmission characteristic of the input/output.

The line indicated by <2> shows an actual transmission characteristic having offset and gain errors.

As a result of the offset cancelling operation according to the fifth embodiment, in the non-inverted mode, the transmission characteristic as shown in <4> in the figure is exhibited, and in the inverted mode, the transmission characteristic as shown in <6> is exhibited.

Namely, there are independent transmission characteristics matching with the ideal characteristic at the points of <3> and <5> of the reference levels in the non-inverted mode and the inverted mode.

When there is gate error in each channel, In the configuration of the fifth embodiment, the inter-channel error cannot be completely eliminated.

However, it is possible to keep any problems from arising in image quality if the gain error is made 1 to 2% by selecting as the reference level a level having the highest sensitivity visually with respect to vertical stripes generated due to the inter-channel deviation. Also, a visually large effect of improvement can be obtained also with respect to the gain error.

According to the fifth embodiment, since a gain can be imparted to the output buffer, in contrast to the fact that a power supply voltage having a minimum voltage of about 14V was required with respect to for example a thin film transistor type liquid crystal display panel required to perform a drive of 10 Vp-p in the related art due to a voltage loss of the sample-and-hold circuits, there is an advantage that it becomes possible to obtain a predetermined output at a power supply voltage having a minimum voltage of about 12V by imparting a gain of 1.25 to the output buffer.

Further, this advantage has an extremely large significance in view of the rise of the signal frequency accompanying the increasing fineness of the thin film transistor type liquid crystal display panels and the large capacitance load of the liquid crystal display panels and the resultant increase in the power consumption.

Further, the reduction of the power supply voltage from 14V to 12V makes it easier to modify the structure of the device for an increase of speed and miniaturization, so the possibility of use of a high performance device can be increased.

Sixth Embodiment

Figure 15:
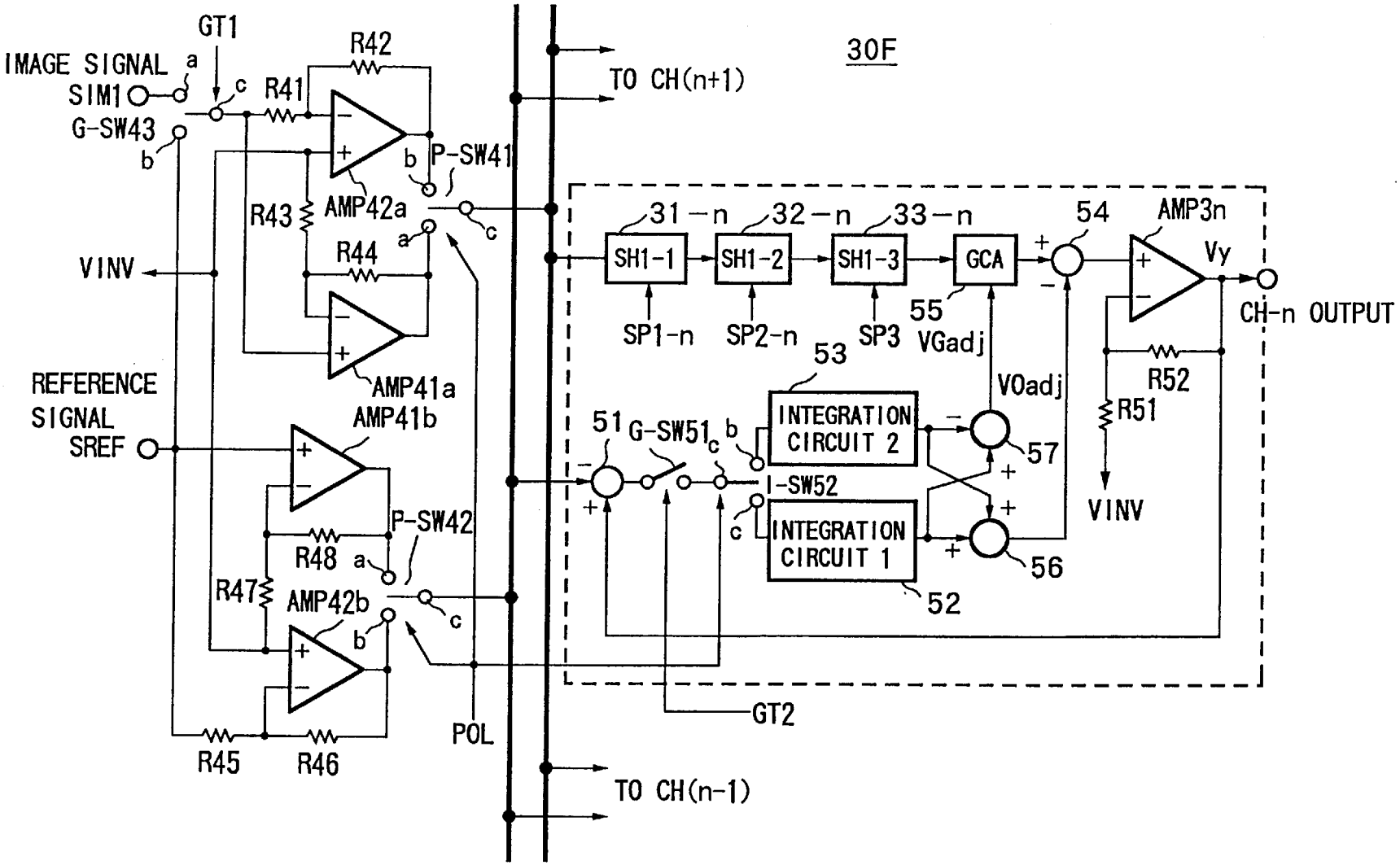
FIG. 15 is a view of the configuration of an image data drive circuit used for a polycrystalline silicon thin film transistor type liquid crystal display panel according to a sixth embodiment of the present invention and a view of the configuration of the image data drive circuit of an analog system using sample-and-hold circuits.
Figures 16A, 16B, 16C, 16D, 16E:
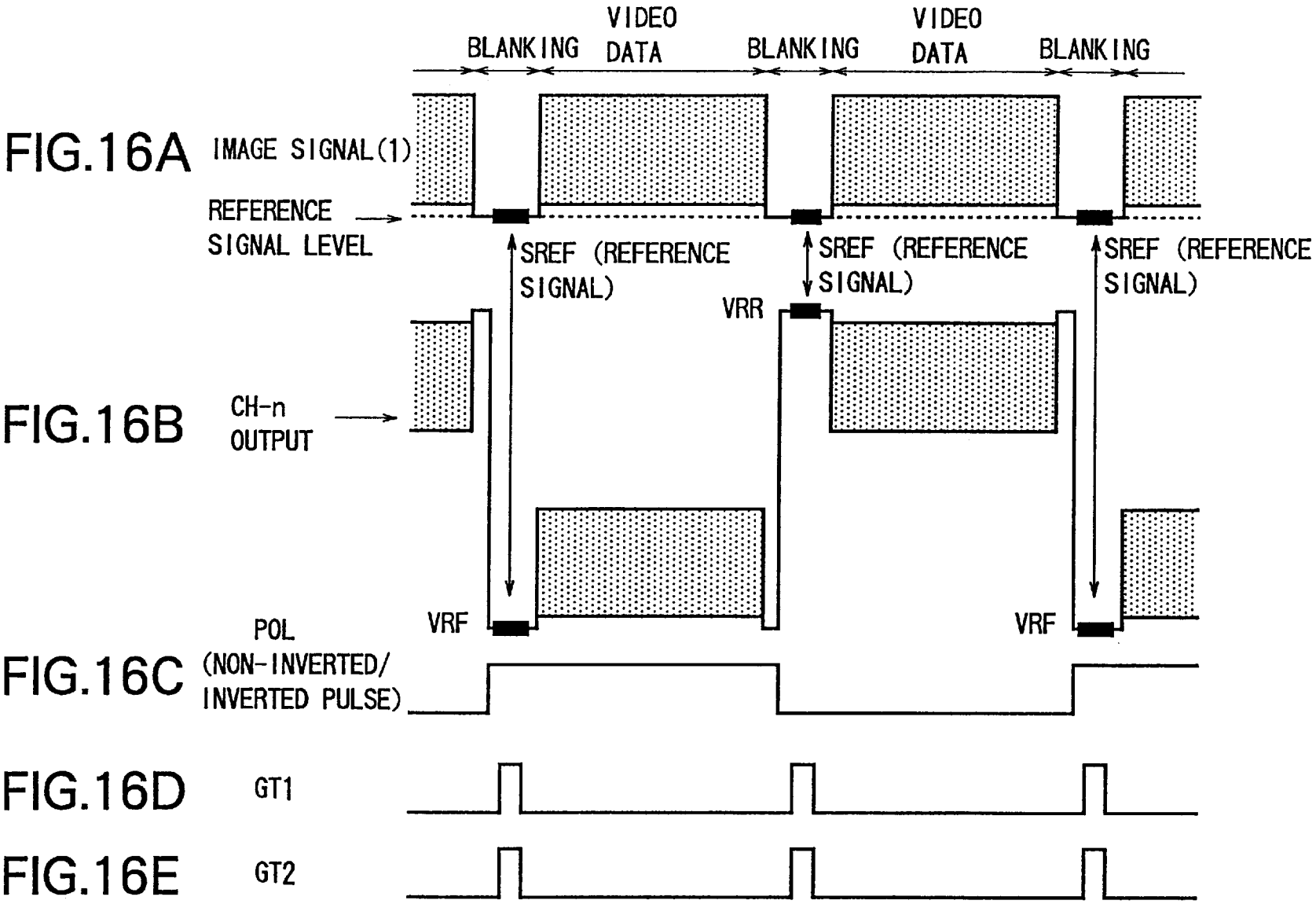
FIGS. 16A to 16E are views of the signal waveforms of different portions of the circuit of FIG. 15.

FIG. 15 is a view of the configuration of an image data drive circuit used for a polycrystalline silicon thin film transistor type liquid crystal display panel according to a sixth embodiment of the present invention and shows an image data drive circuit of an analog system using sample-and-hold circuits. In the figure, the same constituent parts as those of FIG. 6 indicating the third embodiment are represented by the same reference symbols.

Further, an image data drive circuit 30F of FIG. 15 indicates only the drive circuit of one channel n surrounded by the dotted line for simplification.

This image data drive circuit 30F is constituted by, as shown in FIG. 15, sample-and-hold circuits 31-*n*, 32-*n*, and 33-*n*, subtraction circuits 51 and 57, integration circuits 52 and 53, adder circuits 54 and 56, a gain control circuit (GCA) 55, an amplifier AMP3*n* constituting a voltage follower, amplifiers AMP41*a* and AMP41*b* serving as non-inversion circuits, inverting amplifiers AMP42*a* and AMP42*b*, resistors R41 to R48, R52, and R53, and switch circuits P-SW41, P-SW42, G-SW43, G-SW51, and I-SW52.

Note that, in FIG. 15, for the simplification of the figure, the timing signal generation circuit is omitted.

The difference of the sixth embodiment from the fifth embodiment resides in that, in the same way as the third embodiment, a gain control circuit (GCA) 55 with a gain which is controlled by the gain correction signal VGadj is provided between the output of the sample-and-hold circuit 33-*n* and the addition terminal of the adder circuit 54 and in that in place of the switch circuit O-SW53, provision is made of the adder circuit 56 for adding the offset correction signal S52 from the integration circuit 52 and the offset correction signal S53 from the integration circuit 53 and supplying the result as the offset correction signal VOadj to the adder circuit 54 and of the subtraction circuit 57 for subtracting the offset correction signal S52 from the integration circuit 52 and the offset correction signal S53 from the integration circuit 53 and supplying the result as the gain correction signal VGadj to the gain control circuit 55. The gain correction and the offset correction substantially completely eliminate the inter-channel deviation.

Note that the order of connection of the sample-and-hold circuits, gain control circuit, the adder circuits, and the subtraction circuits is not limited to that of FIG. 15 and may be any order.

FIGS. 16A to 16E are views of the signal waveforms of different portions of the circuit of FIG. 15.

In this embodiment, part of the blanking period of the image signal SIM indicated by the thick line in FIG. 16 is used as the reference signal SREF for detecting the offset voltage.

In contrast to the fact that in the fifth embodiment mentioned above, the level of the reference signal is desirably selected to be a level at which vertical stripes due to the inter-channel deviation are visually most remarkable, in the case of the present sixth embodiment, desirably it is set at the tip portion of the image signal. This is for raising the detection sensitivity of the inter-channel deviation.

Note that the offset error and gain error in the circuit of FIG. 15 can be explained similarly as in the third embodiment by using FIG. 8 and FIG. 9, therefore a detailed explanation thereof will be omitted here.

Further, in the sixth embodiment, two gate pulse signals GT1 and GT2 and the non-inversion/inversion switch signal POL are used, but these signals are set with for example the time relationship as shown in FIGS. 17A to 17D.

Namely, with respect to the gate pulse signal GT1 for inserting the reference signal into the image signal, the leading edge of the gate pulse signal GT2 for setting the comparison time must be delayed by the amount of delay time of the sample-and-hold circuit.

Figure 17A:
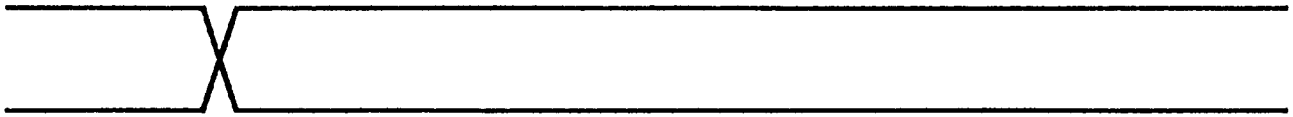
FIGS. 17A to 17D are views for explaining a preferred example of the setting of two gate pulse signals GT1 and GT2 used in the sixth embodiment and a non-inversion/inversion switch signal POL.
Figure 17B:
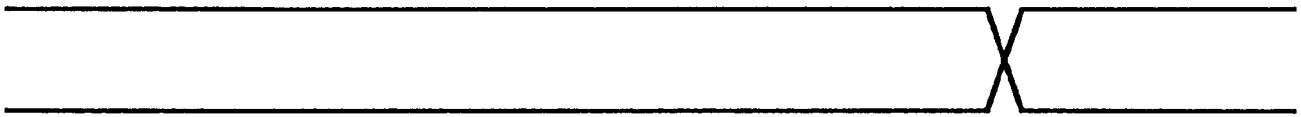
Figure 17C:
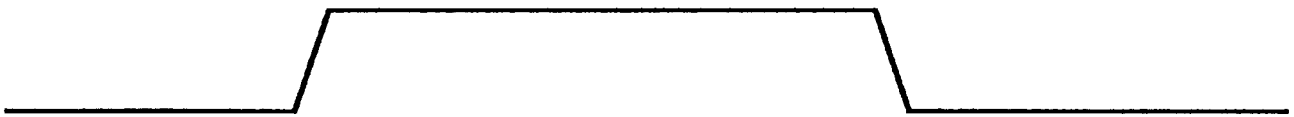
Figure 17D:
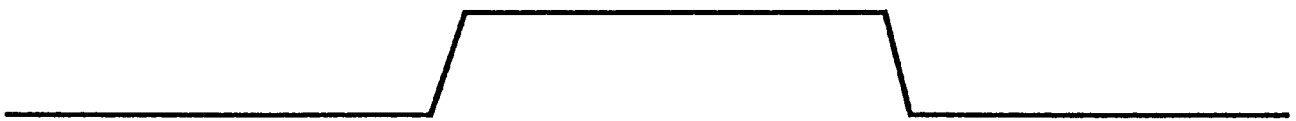

Further, the non-inversion/inversion switch signal POL may be located before the front edge of the gate pulse signal GT1 as shown in FIG. 17A or located behind the rear edge as shown in FIG. 11B of the same figure in principle.

According to the sixth embodiment, effects similar to those by the above fifth embodiment are obtained and, at the same time, the inter-channel deviation can be substantially completely eliminated.

Note that, in the fifth and sixth embodiments, the switch circuit P-SW41 for performing the non-inversion/inversion operation of the image signal and the switch circuit P-SW42 for performing the non-inversion/inversion operation of the reference signal are switched by the same non-inversion/inversion switch signal POL, but it is also possible to perform the switch by different signals POL1 and POL2 as shown in FIGS. 18A to 18F.

Figures 18A, 18B, 18C, 18D, 18E, 18F:
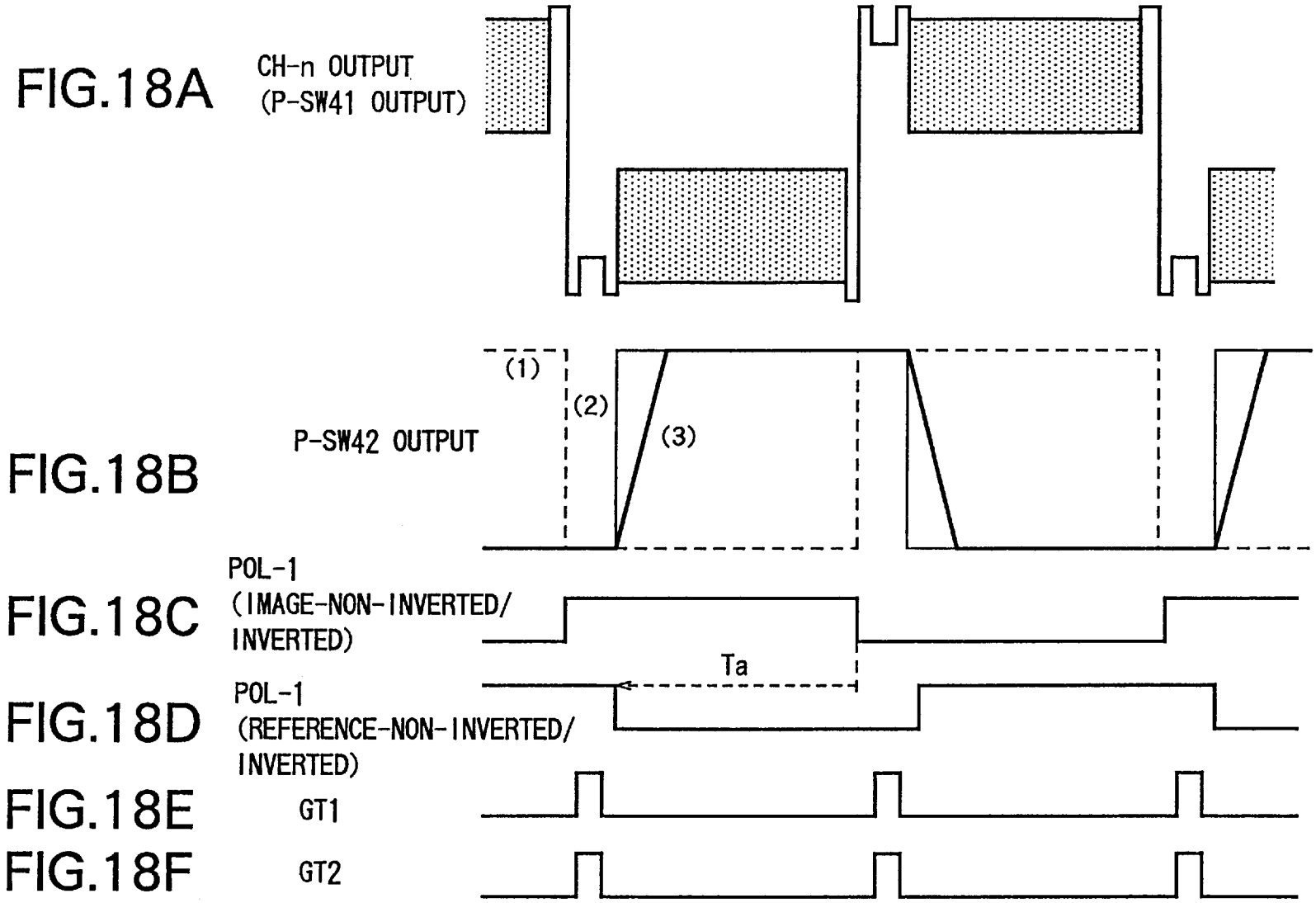
FIGS. 18A to 18F are views of the signal waveforms of different portions of a circuit where switching is controlled by using two non-inversion/inversion switch signals POL in the circuit of FIG. 12 or FIG. 15.
Figure 19:
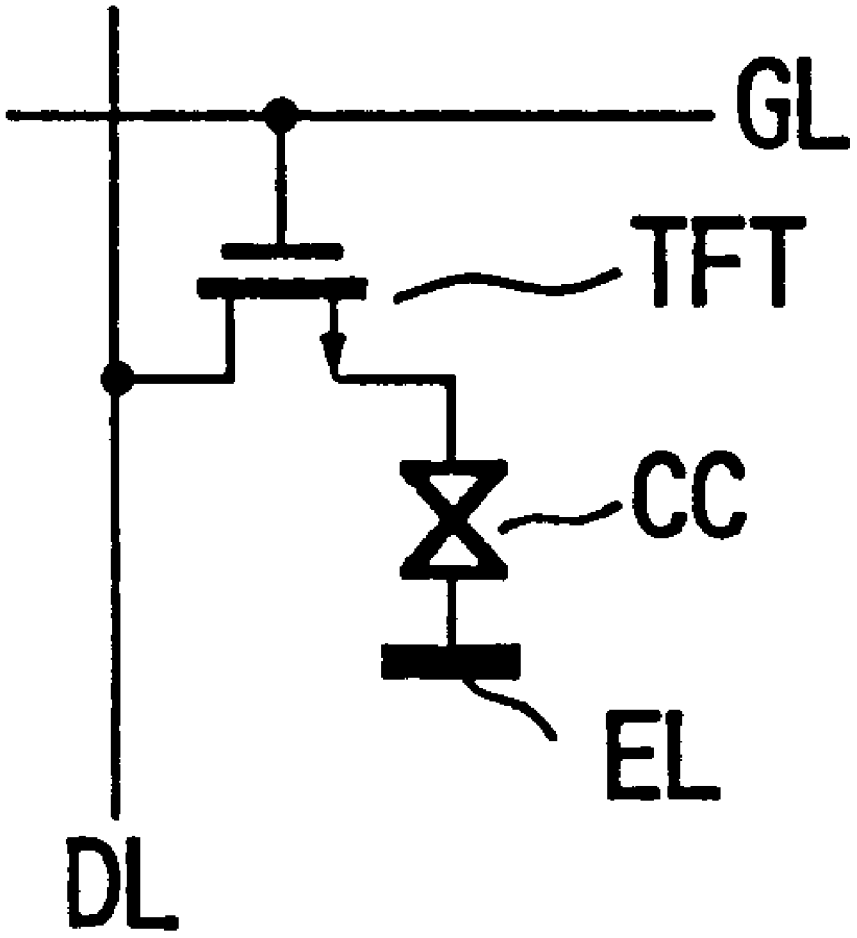
FIG. 19 is a view of a circuit configuration of a cell forming a pixel of a thin film transistor type liquid crystal display panel.
Figure 20:
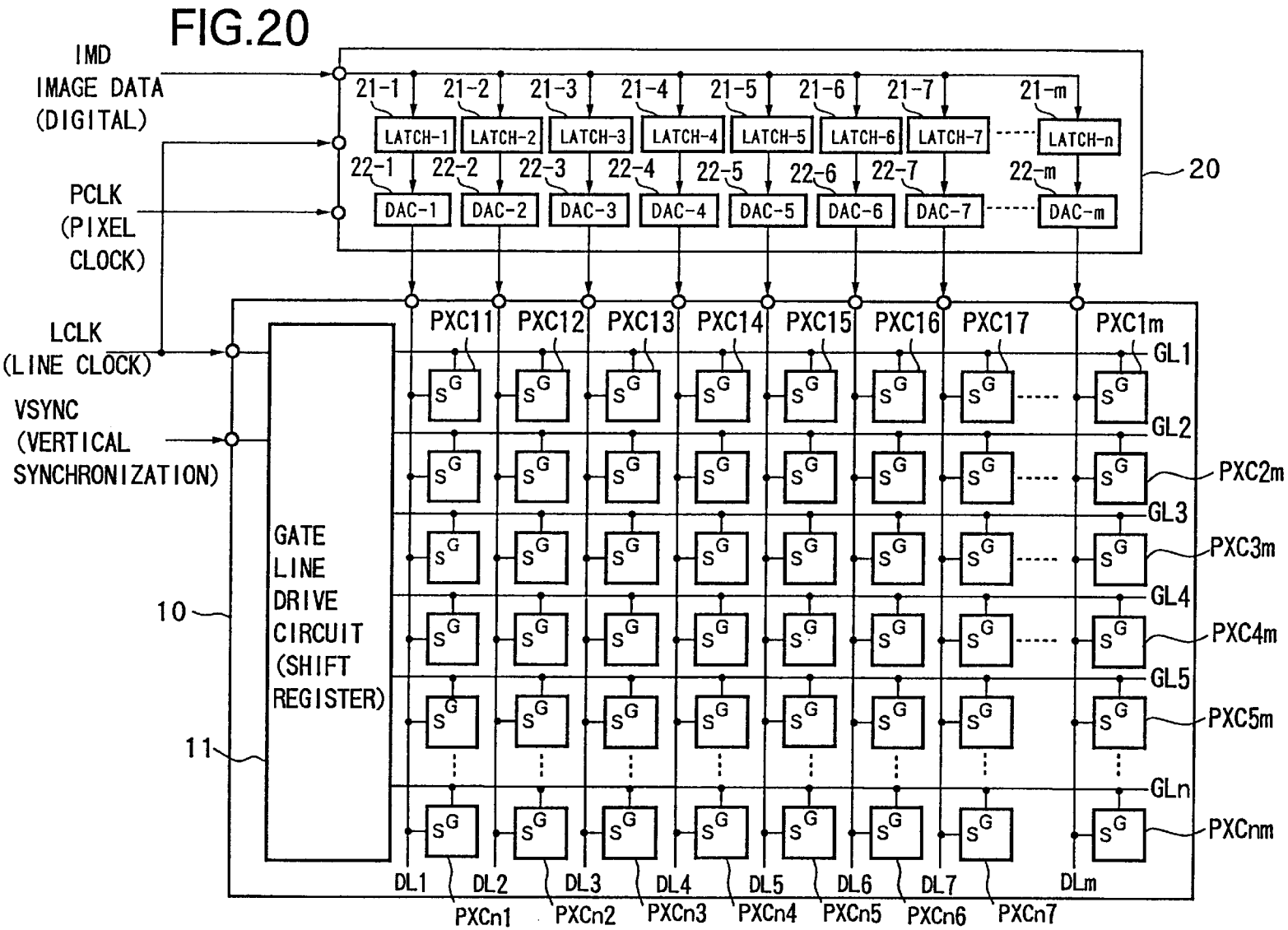
FIG. 20 is a view of the system configuration of a liquid crystal display containing a drive circuit of an amorphous thin film transistor type liquid crystal display panel.
Figure 21:
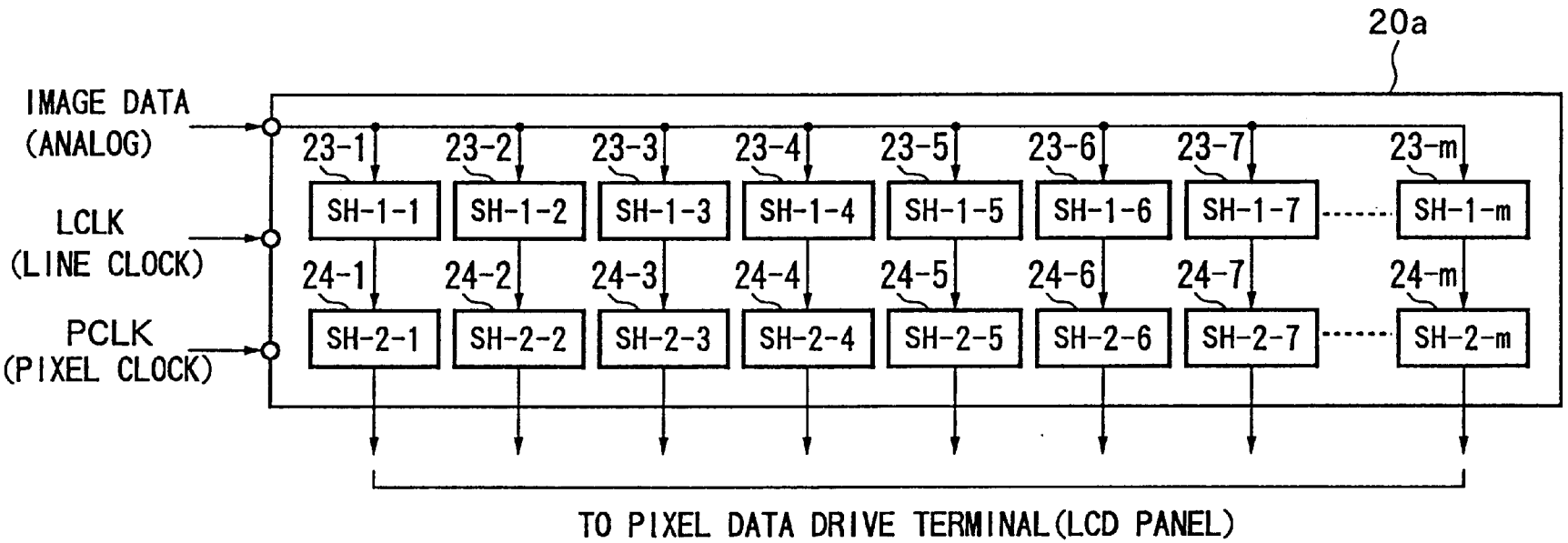
FIG. 21 is a view of another example of the configuration of an image data drive circuit.
Figure 22:
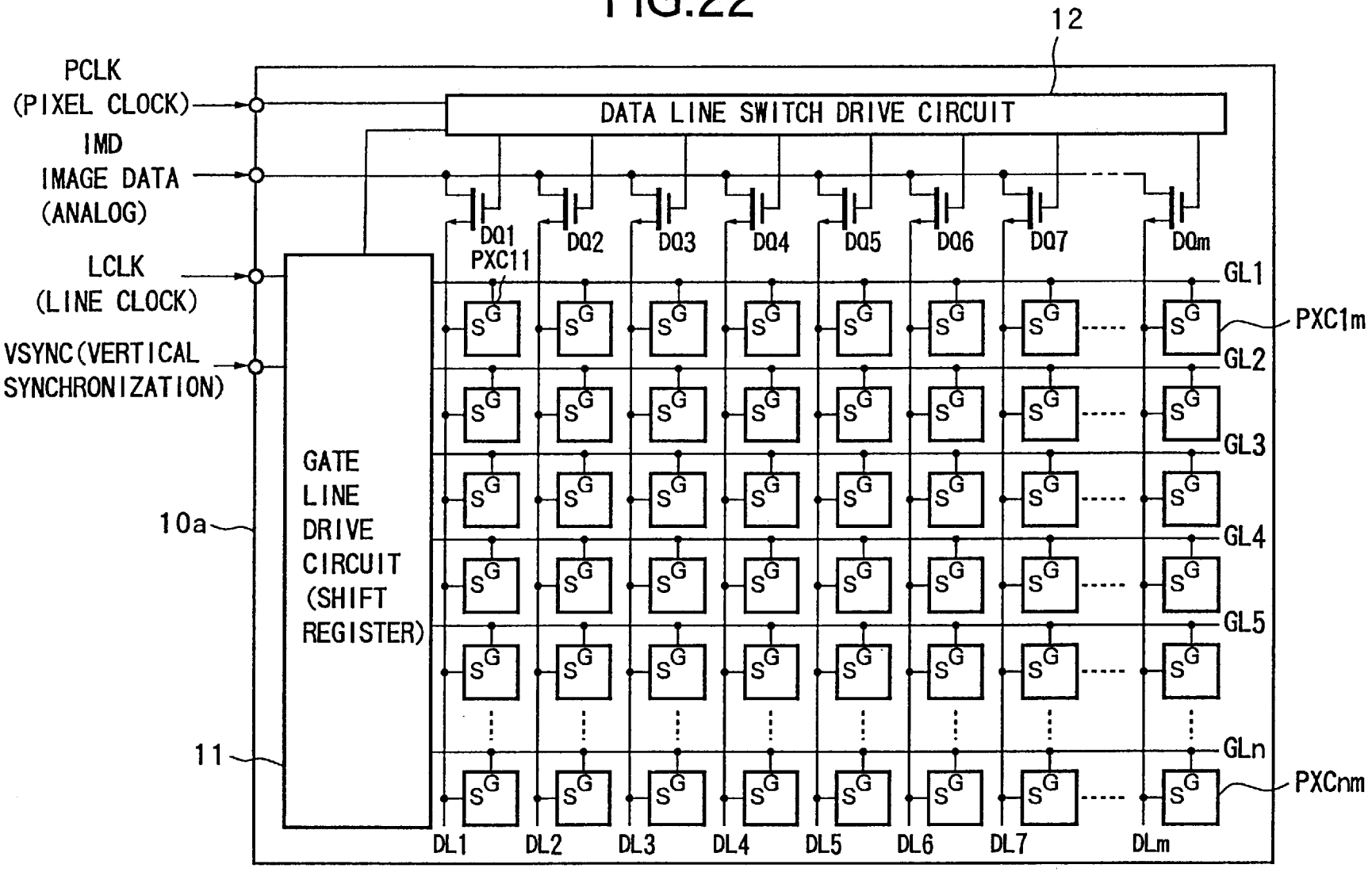
FIG. 22 is a view of another example of the configuration of a liquid crystal display panel.
Figure 23:
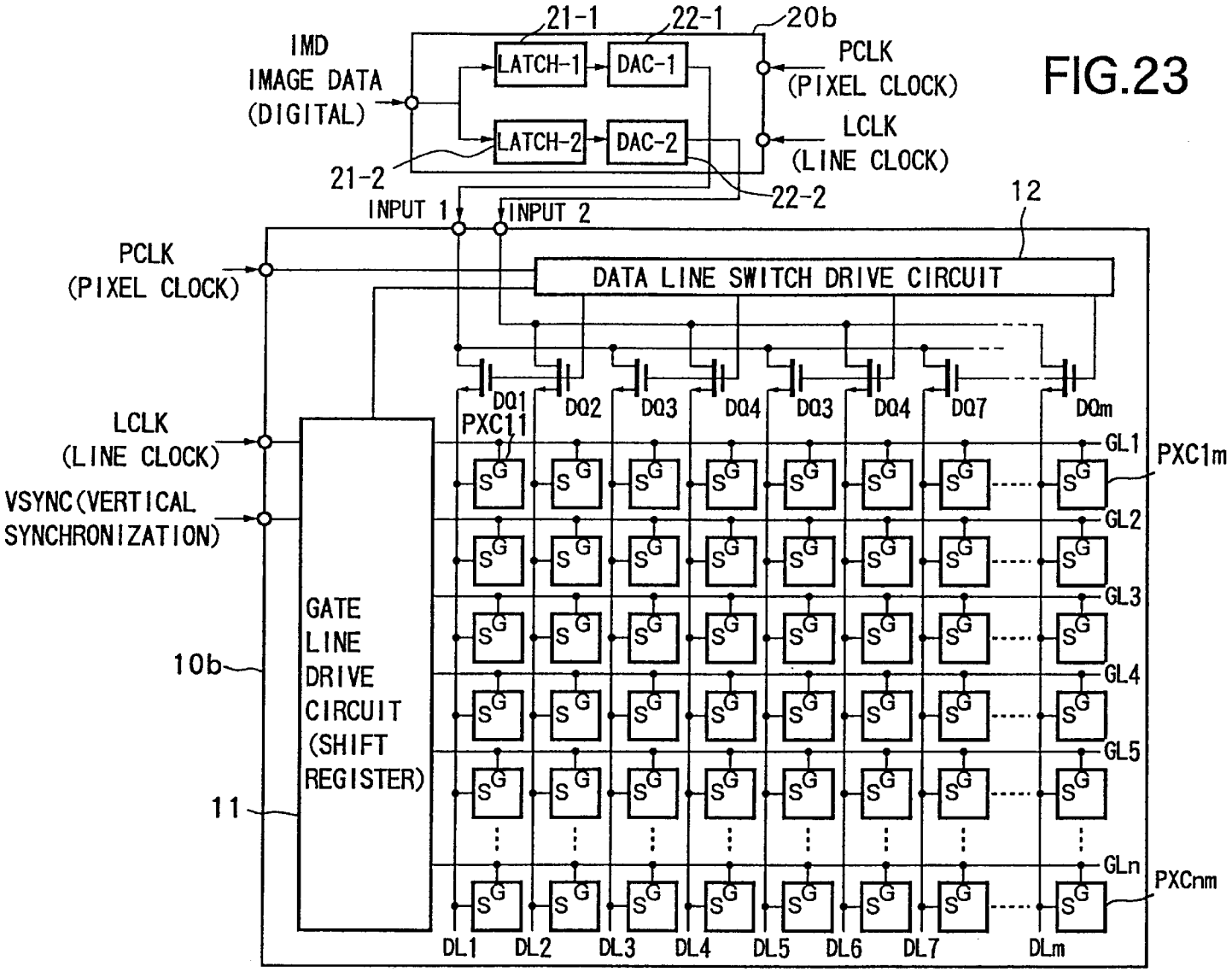
FIG. 23 is a view of the system configuration of a liquid crystal display containing a liquid crystal display panel where a signal is divided into two channels.
Figure 24:
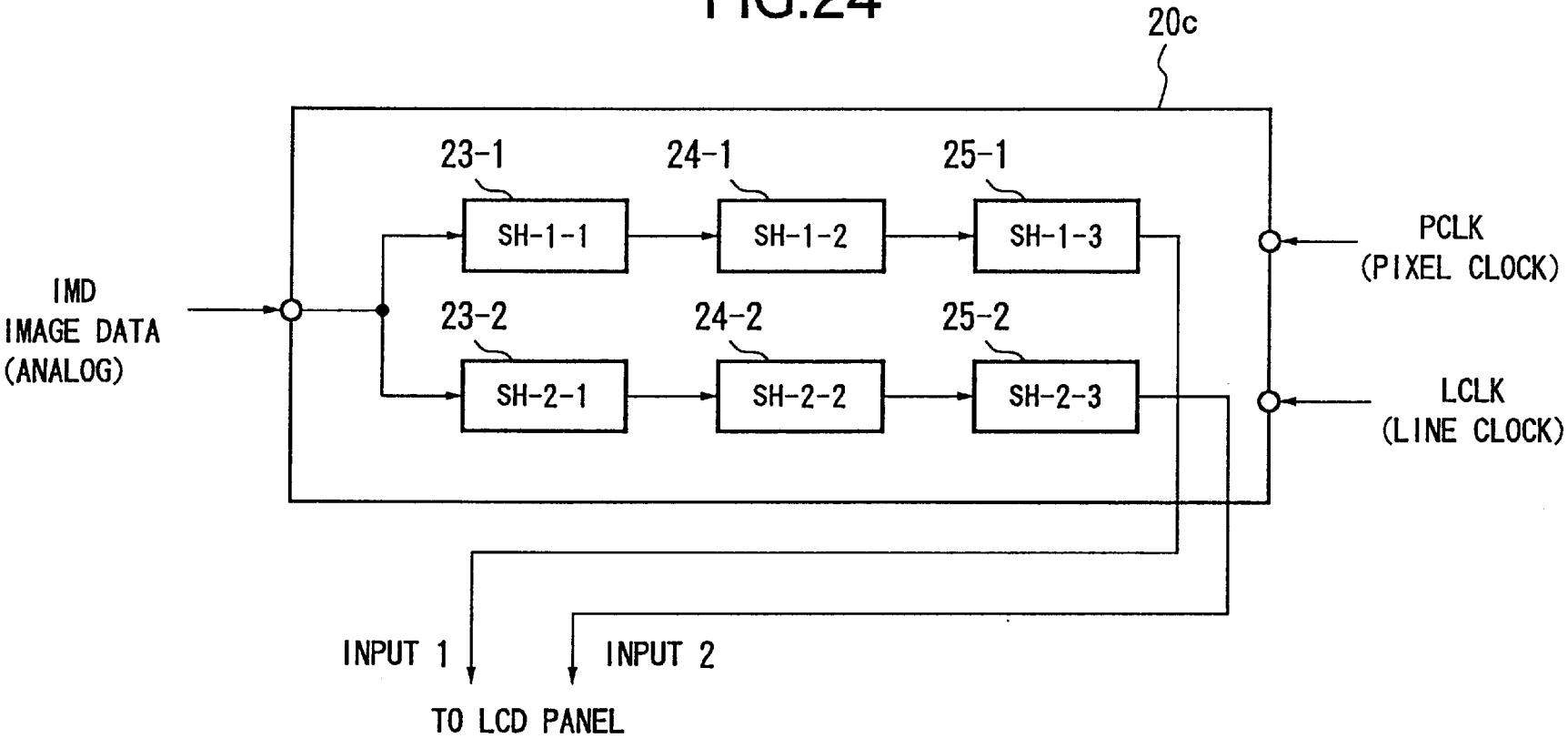
FIG. 24 is a view of an example of the configuration of an image data drive circuit where image data is supplied as analog signals.
Figure 25:
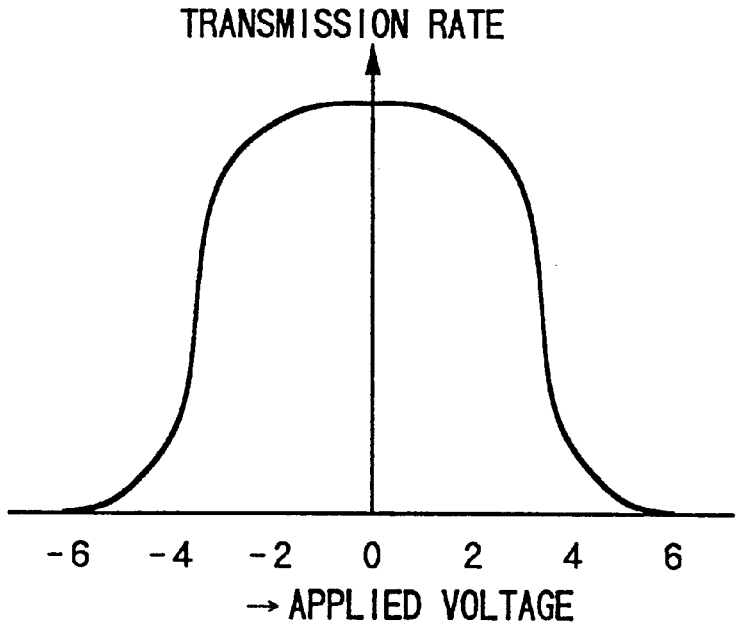
FIG. 25 is a view for explaining an optical characteristic of a liquid crystal element;l
Figure 26:
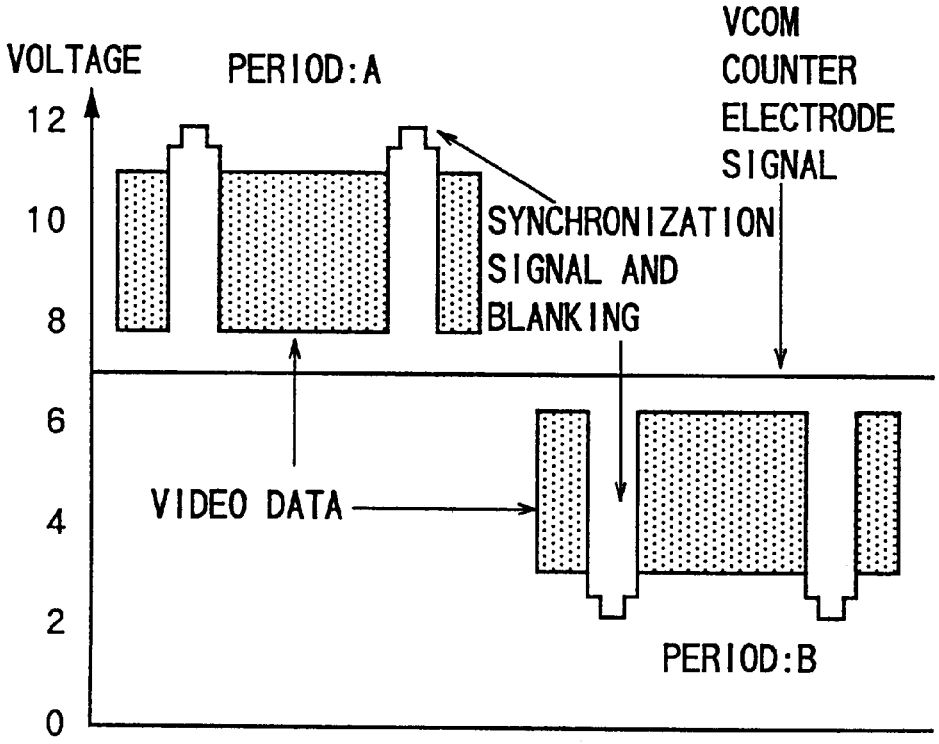
FIG. 26 is a view for explaining a first method for inverting a direction of an electrical field every predetermined period.
Figure 27:
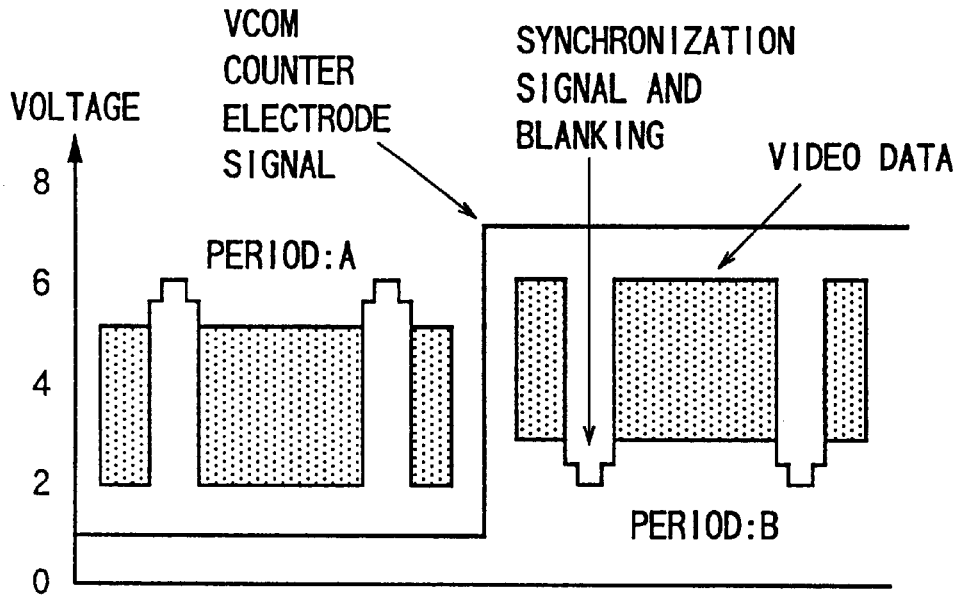
FIG. 27 is a view for explaining a second method for inverting the direction of the electrical field every predetermined period.
Figure 28:
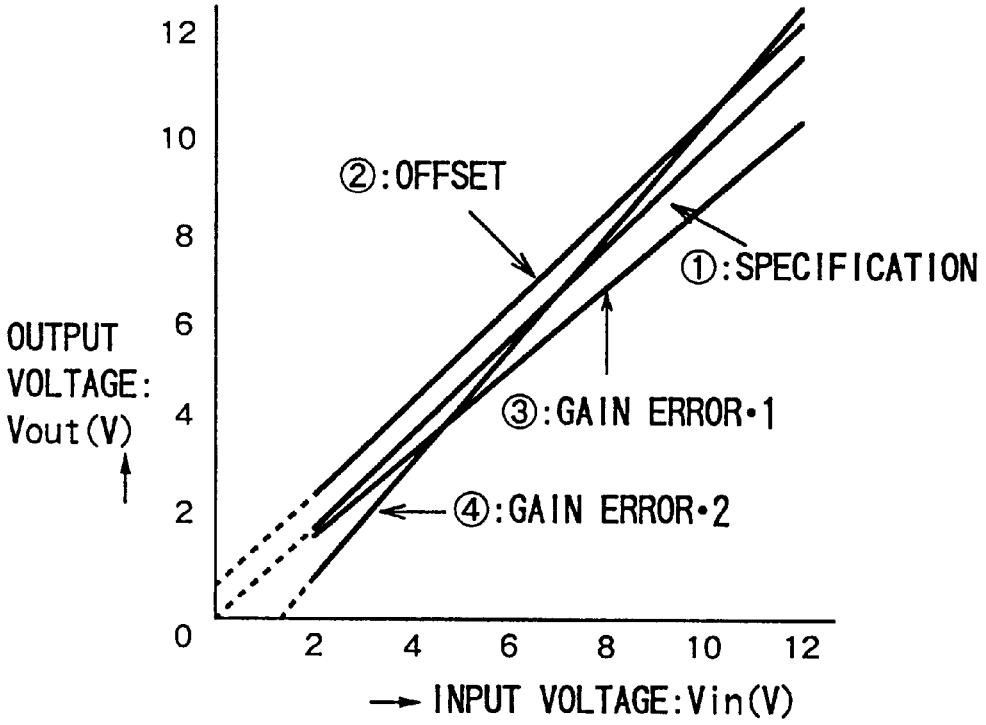
FIG. 28 is a view for explaining an input/output characteristic due to a factor of error.
Figure 29:
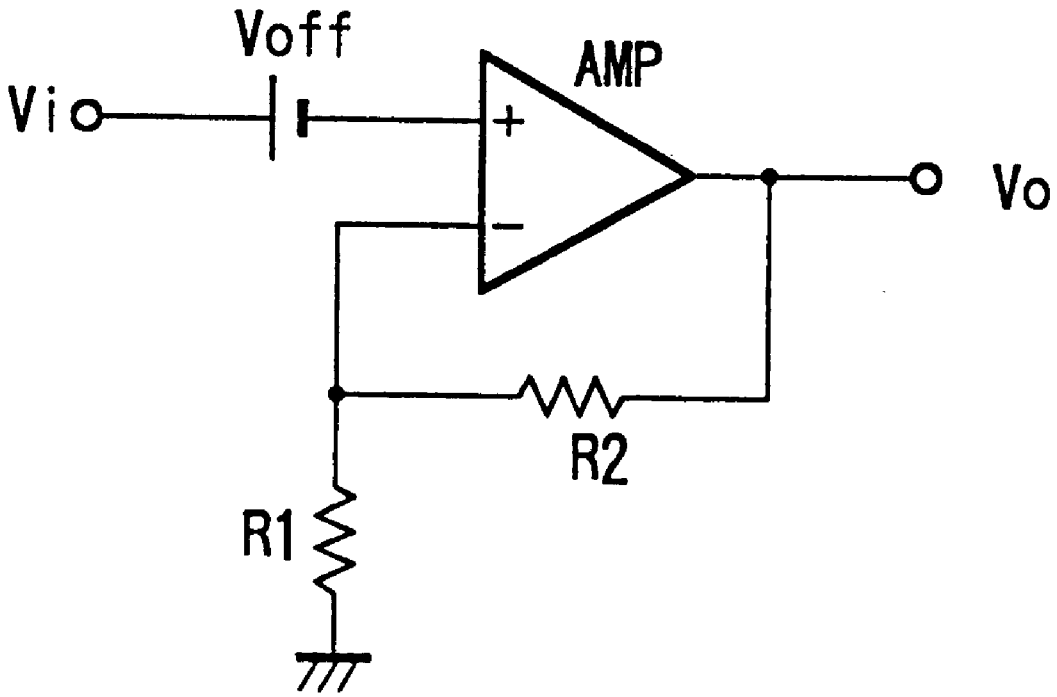
FIG. 29 is a conceptual view for explaining a transmission characteristic of the circuit.
Figure 30:
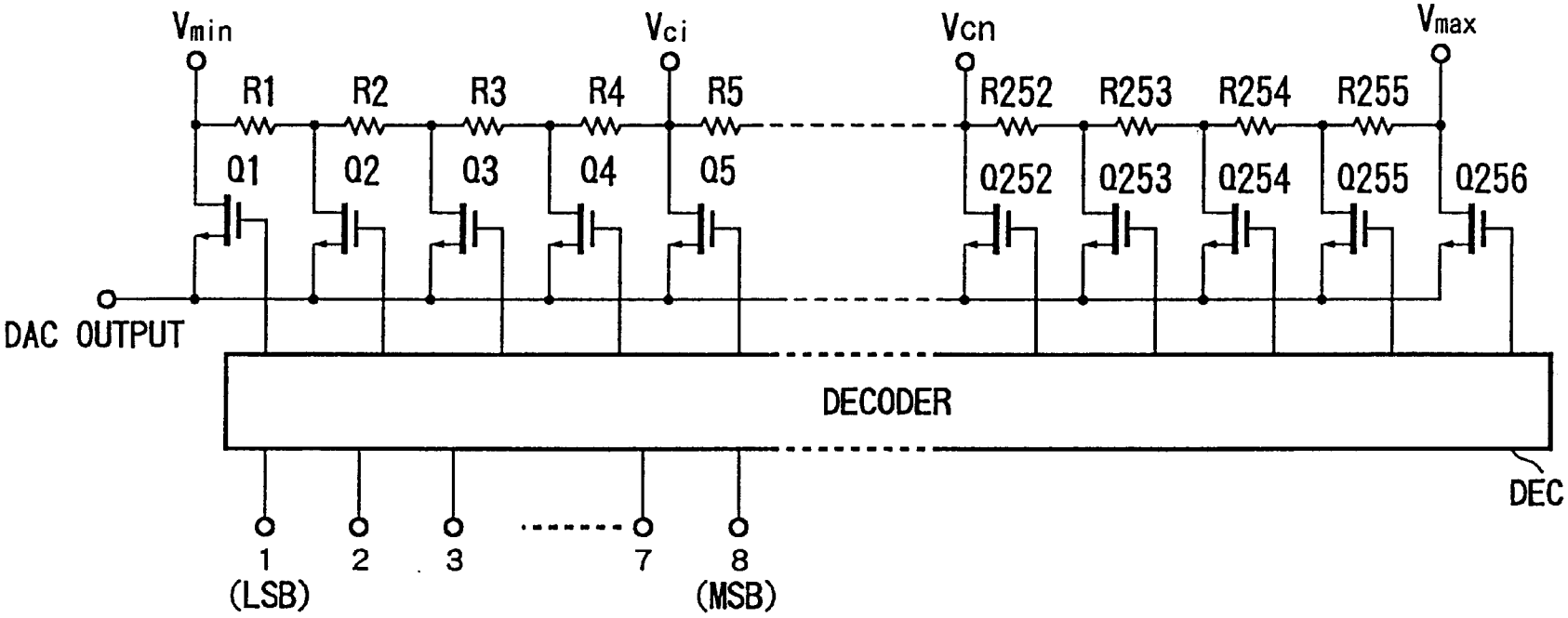
FIG. 30 is a view of a basic circuit of a CMOS type digital-to-analog converter used in the image data drive circuit of an amorphous thin film transistor type liquid crystal display panel.

In the fifth and sixth embodiments, the output of the switch circuit P-SW42 was switched by the image signal inversion, that is, at the same timing as the switch circuit P-SW41 as indicated by 1) in FIG. 18B, but it is also possible to perform the control by the non-inversion/inversion switch signal POL2 advanced from the non-inversion/inversion switch signal POL1 of the image signal by exactly a time Ta.

The resultant output of the switch circuit P-SW42 the waveform shown in (2) in FIG. 18B. This signal is used in only a period where the gate pulse signal GT2 is active as the comparison period, therefore, the operation is the same between the two.

The advantage obtained by adopting such a configuration is that there are no strong demands on the frequency characteristic and operating speed of the amplifiers AMP41*b* and AMP42*b* and switch circuit P-SW42 for performing the non-inversion/inversion operation of the reference signal.

The switch circuits P-SW41 and P-SW42 in FIG. 12 and FIG. 15 are not independent switch circuits in actuality, but are constituted by connection of the amplifiers AMP41*a*, AMP42*a*, AMP41*b*, and AMP42*b*.

The switch circuit P-SW41 and the amplifiers AMP41*a* and AMP42*a* require a band of approximately 100 MHz for the purpose of for example SXGA for passing the image signal, therefore, originally follow the non-inversion/inversion operation at a high speed.

Contrary to this, the switch circuit P-SW42 and the amplifiers AMP41*b* and AMP42*b* generate DC like signals inverted every horizontal scanning period.

However, when the switch circuits P-SW41 and P-SW42 are simultaneously switched, the time from the switching to the comparison operation is short, therefore a considerably high speed operation is required.

Accordingly, as shown in FIGS. 18A to 18F, if the switch circuit P-SW42 is switched early by exactly the time Ta, the operation of the switch circuit P-SW42 and the amplifiers AMP41*b* and AMP2*b* may be extremely low in speed as indicated in the output (3) in FIG. 18B. Therefore, this is extremely effective for the simplification of the circuit and the reduction of the power consumption.

As explained above, according to the present invention, the inter-channel deviation can be reduced and a liquid crystal display of a high image quality can be realized without an adjustment step in the manufacturing line.

Further, according to the present invention, even if there is offset or gain error in the image data drive circuits of a plurality of channels, by using the reference signal in the non-inverted/inverted mode, detecting the sum and difference of the reference signals of input and output, correcting the offset by the sum, and correcting the gain by the difference, it becomes possible to match transmission characteristics completely and make the thin film transistor type liquid crystal display panel display an image of a high quality without vertical stripes.

Further, according to the present invention, since a gain can be imparted to the output buffer, the predetermined output can be obtained at a power supply voltage lower than that of the related art.

By this, there is an extremely large significance in view of the rise of the signal frequency accompanying the increasing fineness of the thin film transistor type liquid crystal display panels and the large capacitance load of the liquid crystal display panels and the resultant increase in the power consumption.

Further, there is the advantage that the reduction of the power supply voltage makes it easier to modify the structure of the device for an increase of speed and miniaturization, so the possibility of use of a high performance device can be increased.

What is claimed is:

1. A liquid crystal display drive circuit for converting image data supplied as serial signals into parallel signals of p number of channels, p being at least 2, and outputting the signals as the image data to the liquid crystal display panel to perform a simultaneous write operation, wherein a reference signal of a predetermined duration and of a voltage set between a white level and a black level is inserted in a blanking period of the image data and wherein provision is made of:

an inverting means for processing the input image data so as to periodically invert and supplying the same to the plurality of channels;

a subtracting means for comparing a first reference voltage and a channel output signal when the output of the inverting means is non-inverted and comparing a second reference voltage and the channel output signal when it is inverted;

an offset correction signal generating means for extracting only the reference signal from among output signals of the subtracting means and generating an offset correction signal corresponding to the non-inverted mode and the inverted mode based on the reference signal; and an adding means for adding the offset correction signals corresponding to the non-inverted mode and the inverted mode to the output signal of the inverting means and outputting the result as the channel output signal to the subtracting means and a liquid crystal display panel.

2. A liquid crystal display drive circuit as set forth in claim 1, wherein the offset correction signal generating means comprises:

a gate circuit for taking out a signal which gates a time position of the reference signal;

a first integrating means for integrating the signal gating the time position of the reference signal from the gate circuit to generate the offset correction signal in a non-Inverted period; and a second integrating means for integrating the signal gating the time position of the reference signal from the gate circuit to generate the offset correction signal in the inverted period.

3. A liquid crystal display drive circuit as set forth in claim 1, wherein:

each channel contains at least two cascade connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

4. A liquid crystal display drive circuit as set forth in claim 2, wherein:

each channel contains at least two cascade connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

5. A liquid crystal display drive circuit as set forth in claim 1, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

6. A liquid crystal display drive circuit as set forth in claim 2, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

7. A liquid crystal display drive circuit for converting image data supplied as serial signals into parallel signals of p number of channels, p being at least 2, and outputting the signals as the image data to the liquid crystal display panel to perform a simultaneous write operation, wherein:

a reference signal of a predetermined duration and of a voltage set between a white level and a black level is inserted in a blanking period of the image data and wherein provision is made of:

an inverting means for processing the input image data so as to periodically invert and supplying the same to the plurality of channels;

a subtracting means for comparing a first reference voltage and a channel output signal when the output of the inverting means is non-inverted and comparing a second reference voltage and the channel output signal when it is inverted;

a gain controlling means for controlling a gain of the image data from the inverting means using a gain in accordance with a gain correction signal;

a correction signal generating means for extracting only the reference signal from among output signals of the subtracting means, generating two correction signals respectively corresponding to the non-inverted mode and the inverted mode based on the reference signal, outputting a sum of the two correction signals as the offset correction signal, and outputting a difference of the two correction signals as the gain correction signal to the gain controlling means; and an offset subtracting means for subtracting the offset correction signal from the correction signal generating means from the output signal of the gain controlling means and outputting the result as the channel output signal to the subtracting means and the liquid crystal display panel.

8. A liquid crystal display drive circuit as set forth in claim 7, wherein the correction signal generating means comprises:

a gate circuit for taking out a signal which gates a time position of the reference signal;

a first integrating means for integrating the signal gating the time position of the reference signal from the gate circuit to generate a first correction signal in a non-inverted period;

a second integrating means for integrating the signal gating the time position of the reference signal from the gate circuit to generate a second correction signal in the inverted period;

an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

9. A liquid crystal display drive circuit as set forth in claim 7, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

10. A liquid crystal display drive circuit as set forth in claim 8, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

11. A liquid crystal display drive circuit as set forth in claim 7, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

12. A liquid crystal display drive circuit as set forth in claim 8, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

13. A liquid crystal display drive circuit as set forth in claim 7, wherein:

each channel contains a cascade-connected latch circuit and analog-to-digital converter between the output of the inverting means and the adding means;

the image data supplied as serial signals is a digital signal; and the analog-to-digital converter is a multiplication type analog-to-digital converter for adding the gain correction signal to the reference voltage for setting a full scale thereof.

14. A liquid crystal display drive circuit as set forth in claim 8, wherein:

each channel contains a cascade-connected latch circuit and analog-to-digital converter between the output of the inverting means and the adding means;

the image data supplied as serial signals is a digital signal; and the analog-to-digital converter is a multiplication type analog-to-digital converter for adding the gain correction signal to the reference voltage for setting a full scale thereof.

15. A liquid crystal display drive circuit for converting image data supplied as serial signals to parallel signals of p number of channels, p being at least 2, and outputting the signals as image data to a liquid crystal display panel to perform a simultaneous write operation, comprising:

a reference signal inserting means for inserting a reference signal of a predetermined duration and of a voltage set between a white level and a black level in a predetermined period of the image data;

a first inverting means for processing the image data in which the reference signal is inserted so as to periodically invert and supplying the same to the plurality of channels;

a second inverting means for processing the reference signal so as to periodically invert and supplying the same to the plurality of channels;

a subtracting means for subtracting the output of the second inverting means from the channel output signal;

an offset correction signal generating means for extracting only a section into which the reference signal is inserted from the output signal of the subtracting means to generate offset correction signals corresponding to the non-inverted mode and the inverted mode based on the reference signal; and an adding means for adding the offset correction signals corresponding to the non-inverted mode and the inverted mode to the output signal of the inverting means and outputting the result as the channel output signal to the subtracting means and liquid crystal display panel.

16. A liquid crystal display drive circuit as set forth in claim 15, further comprising:

an output buffer which has a gain Ab exceeding 1, processes the output signal of the related adding means with the gain Ab, and outputs the result as the channel output signal at the output side of the adding means; and wherein the first inverting means has a gain ±As;

the second inverting means has a gain ±Ab; and a product of the gain ±As of the first inverting means and the gain ±Ab of the output buffer is set to become equal to the gain ±Ab of the second inverting means.

17. A liquid crystal display drive circuit as set forth in claim 15, wherein the offset correction signal generating means comprises:

a gate circuit for taking out a signal which gates a time position of the reference signal;

a first integrating means for integrating the signal gating the time position of the reference signal from the gate circuit to generate the offset correction signal in a non-inverted period; and a second integrating means for integrating the signal gating the time position of the reference signal from the gate circuit to generate the offset correction signal in the inverted period.

18. A liquid crystal display drive circuit as set forth in claim 16, wherein the offset correction signal generating means comprises:

a gate circuit for taking out a signal which gates a time position of the reference signal;

a first integrating means for integrating the signal gating the time position of the reference signal from the gate circuit to generate the offset correction signal in a non-inverted period; and a second integrating means for integrating the signal gating the time position of the reference signal from the gate circuit to generate the offset correction signal in the inverted period.

19. A liquid crystal display drive circuit as set forth in claim 15, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

20. A liquid crystal display drive circuit as set forth in claim 16, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

21. A liquid crystal display drive circuit as set forth in claim 17, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channels in the non-inverted mode and inverted mode.

22. A liquid crystal display drive circuit as set forth in claim 18, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

23. A liquid crystal display drive circuit for converting image data supplied as serial signals to parallel signals of p number of channels, p being at least 2, and outputting the signals as image data to a liquid crystal display panel to perform a simultaneous write operation, comprising:

a reference signal inserting means for inserting a reference signal of a predetermined duration and of a voltage set between a white level and a black level in a predetermined period of the input image data;

a first inverting means for processing the image data into which the reference signal is inserted so as to periodically invert and supplying the same to a plurality of channels;

a second inverting means for processing the reference signal so as to periodically invert and supplying the same to the plurality of channels;

a gain controlling means for controlling a gain of the image data from the inverting means with a gain in accordance with a gain correction signal;

a subtracting means for subtracting the output of the second inverting means from the channel output signal;

a correction signal generating means for extracting only a section into which the reference signal is inserted from the output signal of the subtracting means to generate two correction signals respectively corresponding to the non-inverted mode and the inverted mode based on the reference signal, outputting the sum of the two correction signals as the offset correction signal, and outputting the difference of the two correction signals as the gain correction signal to the gain controlling means; and an offset subtracting means for subtracting the offset correction signal from the correction signal generating means from the output signal of the gain controlling means and outputting the result as the channel output signal to the subtracting means and liquid crystal display panel.

24. A liquid crystal display drive circuit as set forth in claim 23, further comprising:

an output buffer which has a gain Ab exceeding 1, processes the output signal of the adding means with the gain Ab, and outputs the result as the channel output signal at the output side of the adding means; and wherein the first inverting means has a gain ±As;

the second inverting means has a gain ±Ab; and a product of the gain ±As of the first inverting means and the gain ±Ab of the output buffer is set to become equal to the gain ±Ab of the second inverting means.

25. A liquid crystal display drive circuit as set forth in claim 23, wherein the correction signal generating means comprises:

a gate circuit for taking out a signal which gates the time position of the reference signal;

a first integrating means for integrating the signal gating the time position of the reference signal from the gate circuit to generate a first correction signal in the non-inverted period;

a second integrating means for integrating the signal gating the time position of the reference signal from the gate circuit to generate a second correction signal in the inverted period;

an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

26. A liquid crystal display drive circuit as set forth in claim 24, wherein the correction signal generating means comprises:

a gate circuit for taking out a signal which gates the time position of the reference signal;

a first integrating means for integrating the signal gating the time position of the reference signal from the gate circuit to generate a first correction signal in the non-inverted period;

a second integrating means for integrating the signal gating the time position of the reference signal from the gate circuit to generate a second correction signal in the inverted period;

an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

27. A liquid crystal display drive circuit as set forth in claim 23, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

28. A liquid crystal display drive circuit as set forth in claim 24, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

29. A liquid crystal display drive circuit as set forth in claim 25, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

30. A liquid crystal display drive circuit as set forth in claim 26, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

31. A liquid crystal display containing a drive circuit for converting image data supplied as serial signals into parallel signals of p number of channels, p being at least 2, and outputting the signals as the image data to the liquid crystal display panel to perform a simultaneous write operation, wherein a reference signal of a predetermined duration and of a voltage set between a white level and a black level is inserted in a blanking period of the image data and wherein provision is made of:

an inverting means for processing the input image data so as to periodically invert and supplying the same to the plurality of channels;

a subtracting means for comparing a first reference voltage and a channel output signal when the output of the inverting means is non-inverted and comparing a second reference voltage and the channel output signal when it is inverted;

an offset correction signal generating means for extracting only the reference signal from among output signals of the subtracting means and generating an offset correction signal corresponding to the non-inverted mode and the inverted mode based on the reference signal; and an adding means for adding the offset correction signals corresponding to the non-inverted mode and the inverted mode to the output signal of the inverting means and outputting the result as the channel output signal to the subtracting means and a liquid crystal display panel.

32. A liquid crystal display containing a drive circuit as set forth in claim 31, wherein the offset correction signal generating means comprises:

a gate circuit for taking out a signal which gates a time position of the reference signal;

a first integrating means for integrating the signal gating the time position of the reference signal from the gate circuit to generate the offset correction signal in a non-inverted period; and a second integrating means for integrating the signal gating the time position of the reference signal from the gate circuit to generate the offset correction signal in the inverted period.

33. A liquid crystal display containing a drive circuit as set forth in claim 31, wherein:

each channel contains at least two cascade connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

34. A liquid crystal display containing a drive circuit as set forth in claim 32, wherein:

each channel contains at least two cascade connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

35. A liquid crystal display containing a drive circuit as set forth in claim 31, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

36. A liquid crystal display containing a drive circuit as set forth in claim 32, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

37. A liquid crystal display containing a drive circuit for converting image data supplied as serial signals into parallel signals of p number of channels, p being at least 2, and outputting the signals as the image data to the liquid crystal display panel to perform a simultaneous write operation, wherein:

a reference signal of a predetermined duration and of a voltage set between a white level and a black level is inserted in a blanking period of the image data and wherein provision is made of:

an inverting means for processing the input image data so as to periodically invert and supplying the same to the plurality of channels;

a subtracting means for comparing a first reference voltage and a channel output signal when the output of the inverting means is non-inverted and comparing a second reference voltage and the channel output signal when it is inverted;

a gain controlling means for controlling a gain of the image data from the inverting means using a gain in accordance with a gain correction signal;

a correction signal generating means for extracting only the reference signal from among output signals of the subtracting means, generating two correction signals respectively corresponding to the non-inverted mode and the inverted mode based on the reference signal, outputting a sum of the two correction signals as the offset correction signal, and outputting a difference of the two correction signals as the gain correction signal to the gain controlling means; and an offset subtracting means for subtracting the offset correction signal from the correction signal generating means from the output signal of the gain controlling means and outputting the result as the channel output signal to the subtracting means and the liquid crystal display panel.

38. A liquid crystal display containing a drive circuit as set forth in claim 37, wherein the correction signal generating means comprises:

a gate circuit for taking out a signal which gates a time position of the reference signal;

a first integrating means for integrating the signal gating the time position of the reference signal from the gate circuit to generate a first correction signal in a non-inverted period;

a second integrating means for integrating the signal gating the time position of the reference signal from the gate circuit to generate a second correction signal in the inverted period;

an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

39. A liquid crystal display containing a drive circuit as set forth in claim 37, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

40. A liquid crystal display containing a drive circuit as set forth in claim 38, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

41. A liquid crystal display containing a drive circuit as set forth in claim 37, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

42. A liquid crystal display containing a drive circuit as set forth in claim 38, wherein:

each channel contains a cascade-connected latch circuit and analog-to-digital converter between the output of the inverting means and the adding means;

the image data supplied as serial signals is a digital signal; and the first and second reference voltages are levels respectively corresponding to the analog value of the voltage of the reference signal in the non-inverted mode and the inverted mode.

43. A liquid crystal display containing a drive circuit as set forth in claim 37, wherein:

each channel contains a cascade-connected latch circuit and analog-to-digital converter between the output of the inverting means and the adding means;

the image data supplied as serial signals is a digital signal; and the analog-to-digital converter is a multiplication type analog-to-digital converter for adding the gain correction signal to the reference voltage for setting a full scale thereof.

44. A liquid crystal display containing a drive circuit as set forth in claim 38, wherein:

each channel contains a cascade-connected latch circuit and analog-to-digital converter between the output of the inverting means and the adding means;

the image data supplied as serial signals is a digital signal; and the analog-to-digital converter is a multiplication type analog-to-digital converter for adding the gain correction signal to the reference voltage for setting a full scale thereof.

45. A liquid crystal display containing drive circuit for converting image data supplied as serial signals to parallel signals of p number of channels, p being at least 2, and outputting the signals as image data to a liquid crystal display panel to perform a simultaneous write operation, comprising:

a reference signal inserting means for inserting a reference signal of a predetermined duration and of a voltage set between a white level and a black level in a predetermined period of the image data;

a first inverting means for processing the image data in which the reference signal is inserted so as to periodically invert and supplying the same to the plurality of channels;

a second inverting means for processing the reference signal so as to periodically invert and supplying the same to the plurality of channels;

a subtracting means for subtracting the output of the second inverting means from the channel output signal;

an offset correction signal generating means for extracting only a section into which the reference signal is inserted from the output signal of the subtracting means to generate offset correction signals corresponding to the non-inverted mode and the inverted mode based on the reference signal; and an adding means for adding the offset correction signals corresponding to the non-inverted mode and the inverted mode to the output signal of the inverting means and outputting the result as the channel output signal to the subtracting means and liquid crystal display panel.

46. A liquid crystal display containing a drive circuit as set forth in claim 45, further comprising:

an output buffer which has a gain Ab exceeding 1, processes the output signal of the related adding means with the gain Ab, and outputs the result as the channel output signal at the output side of the adding means; and wherein the first inverting means has a gain ±As;

the second inverting means has a gain ±Ab; and a product of the gain ±As of the first inverting means and the gain ±Ab of the output buffer is set to become equal to the gain ±Ab of the second inverting means.

47. A liquid crystal display containing a drive circuit as set forth in claim 45, wherein the offset correction signal generating means comprises:

a gate circuit for taking out a signal which gates a time position of the reference signal;

a first integrating means for integrating the signal gating the time position of the reference signal from the gate circuit to generate the offset correction signal in a non-inverted period; and a second integrating means for integrating the signal gating the time position of the reference signal from the gate circuit to generate the offset correction signal in the inverted period.

48. A liquid crystal display containing a drive circuit as set forth in claim 46, wherein the offset correction signal generating means comprises:

a gate circuit for taking out a signal which gates a time position of the reference signal;

a first integrating means for integrating the signal gating the time position of the reference signal from the gate circuit to generate the offset correction signal in a non-inverted period; and a second integrating means for integrating the signal gating the time position of the reference signal from the gate circuit to generate the offset correction signal in the inverted period.

49. A liquid crystal display containing a drive circuit as set forth in claim 45, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

50. A liquid crystal display containing a drive circuit as set forth in claim 46, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

51. A liquid crystal display containing a drive circuit as set forth in claim 47, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channels in the non-inverted mode and inverted mode.

52. A liquid crystal display containing a drive circuit as set forth in claim 48, wherein:

each channel contains at least two cascade-connected sample-and-hold circuits between the output of the inverting means and the adding means;

the image data supplied as serial signals is an analog signal; and the first and second reference voltages are the signals passing through the inverting means at the point of supply to the channels in the non-inverted mode and inverted mode.

53. A liquid crystal display containing a drive circuit for converting image data supplied as serial signals to parallel signals of p number of channels, p being at least 2, and outputting the signals as image data to a liquid crystal display panel to perform a simultaneous write operation, comprising:

a reference signal inserting means for inserting a reference signal of a predetermined duration and of a voltage set between a white level and a black level in a predetermined period of the input image data;

a first inverting means for processing the image data into which the reference signal is inserted so as to periodically invert and supplying the same to a plurality of channels;

a second inverting means for processing the reference signal so as to periodically invert and supplying the same to the plurality of channels;

a gain controlling means for controlling a gain of the image data from the inverting means with a gain in accordance with a gain correction signal;

a subtracting means for subtracting the output of the second inverting means from the channel output signal;

a correction signal generating means for extracting only a section into which the reference signal is inserted from the output signal of the subtracting means to generate two correction signals respectively corresponding to the non-inverted mode and the inverted mode based on the reference signal, outputting the sum of the two correction signals as the offset correction signal, and outputting the difference of the two correction signals as the gain correction signal to the gain controlling means; and an offset subtracting means for subtracting the offset correction signal from the correction signal generating means from the output signal of the gain controlling means and outputting the result as the channel output signal to the subtracting means and liquid crystal display panel.

54. A liquid crystal display containing a drive circuit as set forth in claim 53, further comprising:

an output buffer which has a gain Ab exceeding 1, processes the output signal of the related adding means with the gain Ab, and outputs the result as the channel output signal at the output side of the adding means; and wherein the first inverting means has a gain ±As;

the second inverting means has a gain ±Ab; and a product of the gain ±As of the first inverting means and the gain ±Ab of the output buffer is set to become equal to the gain ±Ab of the second inverting means.

55. A liquid crystal display containing a drive circuit as set forth in claim 53, wherein the correction signal generating means comprises:

a gate circuit for taking out a signal which gates the time position of the reference signal;

a first integrating means for integrating the signal gating the time position of the reference signal from the gate circuit to generate a first correction signal in the non-inverted period;

a second integrating means for integrating the signal gating the time position of the reference signal from the gate circuit to generate a second correction signal in the inverted period;

an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

56. A liquid crystal display containing a drive circuit as set forth in claim 54, wherein the correction signal generating means comprises:

a gate circuit for taking out a signal which gates the time position of the reference signal;

a first integrating means for integrating the signal gating the time position of the reference signal from the gate circuit to generate a first correction signal in the non-inverted period;

a second integrating means for integrating the signal gating the time position of the reference signal from the gate circuit to generate a second correction signal in the inverted period;

an adding means for adding the first correction signal from the first integrating means and the second correction signal from the second integrating means and outputting the result as the offset correction signal to the offset subtracting means; and a subtracting means for subtracting the second correction signal from the second integrating means from the first correction signal from the first integrating means and outputting the result as the gain correction signal to the gain controlling means.

57. A liquid crystal display containing a drive circuit as set forth in claim 53, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

58. A liquid crystal display containing a drive circuit as set forth in claim 54, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

59. A liquid crystal display containing a drive circuit as set forth in claim 55, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

60. A liquid crystal display containing a drive circuit as set forth in claim 56, wherein:

each channel contains at least two cascade-connected sample-and-hold circuits between the output of the inverting means and the adding means;

the image data supplied as serial signals is an analog signal; and the first and second reference voltages are signals passing through the inverting means at the point of supply to the channel in the non-inverted mode and in the inverted mode.

* * * * *